US006851967B2

(12) United States Patent
Miyoshi et al.

(10) Patent No.: US 6,851,967 B2
(45) Date of Patent: Feb. 8, 2005

(54) WIRE CONNECTOR

(75) Inventors: Kazuaki Miyoshi, Kyoto (JP); Junichiro Kumagai, Kyoto (JP); Hisakazu Yamada, Kyoto (JP); Motoyuki Tomizu, Kyoto (JP)

(73) Assignee: Omron Corporation, Kyoto (JP)

( * ) Notice: Subject to any disclaimer, the term of this patent is extended or adjusted under 35 U.S.C. 154(b) by 0 days.

(21) Appl. No.: 10/343,812

(22) PCT Filed: Aug. 3, 2001

(86) PCT No.: PCT/JP01/06685

§ 371 (c)(1),
(2), (4) Date: Jul. 23, 2003

(87) PCT Pub. No.: WO02/13319

PCT Pub. Date: Feb. 14, 2002

(65) Prior Publication Data

US 2004/0102078 A1 May 27, 2004

(30) Foreign Application Priority Data

Aug. 4, 2000 (JP) ..... 2000-236910
Jun. 19, 2001 (JP) ..... 2001-184355
Jul. 17, 2001 (JP) ..... 2001-216632

(51) Int. Cl.[7] ..... H01R 4/24
(52) U.S. Cl. ..... 439/441; 439/835
(58) Field of Search ..... 439/441, 835, 439/440, 439

(56) References Cited

U.S. PATENT DOCUMENTS 4,759,726 A * 7/1988 Naylor et al. ..... 439/441
4,768,981 A * 9/1988 Hohorst ..... 439/835
5,816,843 A * 10/1998 Gerberding ..... 439/410
5,915,991 A * 6/1999 Roman ..... 439/441
5,993,270 A * 11/1999 Geske et al. ..... 439/835
6,126,494 A * 10/2000 Fuchs et al. ..... 439/835
6,146,187 A * 11/2000 Pallai ..... 439/441
6,146,217 A * 11/2000 Osada ..... 439/835
6,257,580 B1 * 7/2001 Brown ..... 273/274
6,261,120 B1 * 7/2001 Beege et al. ..... 439/441
6,280,233 B1 * 8/2001 Beege et al. ..... 439/441
6,283,801 B1 * 9/2001 Guinda et al. ..... 439/835
6,336,824 B1 * 1/2002 Sorig ..... 439/441
6,595,809 B2 * 7/2003 Matsumoto et al. ..... 439/835
6,682,364 B2 * 1/2004 Cisey ..... 439/441
6,712,649 B2 * 3/2004 Mano et al. ..... 439/835
2004/0116001 A1 * 6/2004 Lenker ..... 439/835

FOREIGN PATENT DOCUMENTS

JP UM-B-8-2924 1/1996
JP A-10-12294 1/1998
JP UM Reg. 3076679 1/2001

OTHER PUBLICATIONS

Translation of Japanese Patent No. JP–UM– Reg. 3076679 filed Jan. 24, 2001 (7 pgs.).
Translation of Japanese Patent No. JP–UM–B–8–2924 filed Jan. 29, 1996 (14 pgs.).
Translation of Japanese Patent No. JP–A–10–12294 filed Jan. 16, 1998 (24 pgs.).

* cited by examiner

*Primary Examiner*—Tho D. Ta
*Assistant Examiner*—Iarisa Tsukerman
(74) *Attorney, Agent, or Firm*—Osha & May L.L.P.

(57) ABSTRACT

In a wire connector, when a manipulation button 40 is pushed into a casing 10, a manipulation portion 43 of the manipulation button 40 pushes down one side of a leaf spring 30, whereas by pressing and locking an upper surface of the manipulation button 40 to a corner portion 11 of the casing 10 due to a reaction of the leaf spring 30. Accordingly, it is possible to provide the small wire connector which is simple in structure, high in reliability of contact, and easy in assembly and connecting operation.

42 Claims, 49 Drawing Sheets

(A) (B)

(A)

(B)

(A)

(B)

(A)

(B)

(A)

(B)

(A)

(B)

(A)

(B)

(A)

(B)

WIRE CONNECTOR

TECHNICAL FIELD

The present invention relates to a wire connector which is referred to as a relay connector, a self-locking terminal device, a connector for wire connection or a relay terminal.

BACKGROUND ART

The prior art and the first task to be solved by the present invention

Conventionally, as a wire connector, there has been known a relay connector provided with plugs and the like which is described in JP-A-10-12294, for example.

That is, here described is a relay connector having a structure which holds an open state by engaging release buttons 11, 25 with outer peripheral surfaces of base housings 5, 19. However, in the above-mentioned conventional example, it is necessary to form engaging catching portions in the base housings 5, 19 and the structure becomes complicated and, at the same time, the miniaturization of the device becomes difficult.

On the other hand, JP-UM-B-8-2924 discloses a self-locking terminal device as a type of wire connector.

That is, one end portion of a wire Y is clamped and held by bringing a locking portion 13 of a locking spring 2 into pressure contact with a side face portion 17 of a terminal fitting 3. However, in the above-mentioned prior art, along with the miniaturization of the device, a spring force becomes small and hence, a desired holding force is not obtained and the reliability of contact is lowered. To the contrary, when the locking spring 2 has a large width uniformly, it is impossible to obtain the dispersion of stress at a spring portion. Further, since a large notch is formed in a back surface of the terminal fitting 3, a stress is concentrated on the notched portion and hence, there arises a drawback that the strength is remarkably deteriorated.

Further, in the above-mentioned both prior arts, in spite of a fact that the positional relationship between the terminal fitting (leaf spring) and a manipulation part is important, the terminal fitting (leaf spring) and the manipulation part are assembled using the housing as the reference. Accordingly, it is necessary to assemble the terminal fitting and the manipulation part to the housing with high positioning accuracy and hence, there arises a drawback that the assembling cannot be performed easily.

Accordingly, in view of the above tasks, it is a first object of the present invention to provide a small-sized wire connector which has a simple constitution, exhibits the high connection reliability, and ensures the easy assembling.

The prior art and the second task to be solved by the present invention

Further, in the above-mentioned self-locking terminal device described in JP-UM-B-8-2924, the locking spring 2 is resiliently deformed by pushing a manipulation button 4 downwardly using a flat-type driver D thus connecting a wire Y.

However, in the above-mentioned self-locking terminal device, in connecting the wire Y, it is necessary to keep on pushing the locking spring 2 using the manipulation button 4 and hence, the operability is poor. Further, since the above-mentioned locking spring 2 is housed in the inside of an insulating body 1, it is difficult to clearly judge whether the locking spring 2 is in a state that the wire Y can be connected or not.

As means which can solve one of the above-mentioned drawbacks, the relay connector having a locking mechanism described in the above-mentioned JP-A-10-12294 is named.

That is, the relay connector has a structure in which by pushing respective one ends of the release buttons 11, 25 into the base housings 5, 19 and engaging them with each other, it is possible to hold an open state that wires 31 can be inserted into the base housings 5, 19.

However, in the above-mentioned relay connector, when the electric connection is established by inserting the wires 31 into the base housings 5, 19, it is necessary to pick one end portions of the release buttons 11, 25 and to pull out them from the base housings 5, 19. Accordingly, it is impossible to perform all manipulations using a same tool. That is, to pull out the release buttons 11, 25, it is necessary to replace the tool with a different tool thus worsening the operational efficiency.

Further, it is difficult to adjust a force for pulling out the release buttons 11, 25 and hence, there is a possibility that the release buttons 11, 25 are excessively pulled causing the rupture of the release buttons 11, 25.

Accordingly, in view of the above drawbacks, it is a second object of the present invention to provide a wire connector which can facilitate the judging a state whether the mounting or the dismounting of the wire is possible or not, can perform the mounting and the dismounting merely by a pushing manipulation thus enhancing the operational efficiency of the wire connection, and can eliminate the possibility of rupture of constitutional parts.

The prior art and the third task to be solved by the present invention

Further, as another wire connector, for example, as a relay terminal which connects a programmable controller and a large number of electric appliances by way of wires, there has been known a fixing structure of an interface terminal platform which is disclosed in the Japanese Utility Model Registration 3076679. The interface terminal platform is used for connecting the programmable controller with various types of sensors or another interface terminal platform using wires. While the interface terminal platform is connected to the programmable controller through a connector at one side thereof, the interface terminal platform is connected to an inputting/outputting equipment such as a sensor, a motor or the like through a connection portion which is formed of a screw terminal provided to the other side. Here, along with the miniaturization of the control device such as the programmable controller, there has been also a request for the miniaturization of the interface terminal platform.

The relay terminal which constitutes the above-mentioned interface terminal platform has a structure in which an electric connection is established by clamping and fixing the wires using the screw terminal and the terminal fitting. However, a screw head portion of the screw terminal has a diameter greater than a diameter of the wire and hence, when the screw terminal is used for connecting a large number of wires, it is difficult to make a size of the connection portion smaller than the diameter of the above-mentioned screw head. Accordingly, it is difficult to collect the connection portions in high density so that it is difficult to reduce a floor area of the relay terminal.

Further, in arranging the screw terminals in a plurality of rows on a same plane, when the number of rows becomes three or four, it is difficult to pull out the wire of the row positioned in the midst of the rows and hence, such an arrangement cannot be adopted in a practical use.

Accordingly, when the screw terminals are arranged in many rows, they cannot be arranged on the same plane and it is necessary to form a stepped portion for every row of the connection portions. As a result, when the connection portions of many rows are adopted, that is, when the number of rows is three or four, a height size of the terminals is increased in proportion to the number of rows and hence, the miniaturization cannot be achieved.

Further, with respect to a terminal fitting in the inside of the housing, one end of the terminal fitting is directly connected or bonded to a printed circuit board and the other end of the terminal fitting is engaged with the screw terminal. Accordingly, when the stepped portion is provided for every row, it is necessary to prepare terminal fittings which differ in height. As a result, when it is required to form the connection portions in a plurality of rows, for example, three rows or four rows, it is necessary to prepare the terminal fittings which differ in height size and this has been a cause to increase kinds of parts to be produced and administrated and to push up a cost.

The third object of the present invention is, in view of the above-mentioned drawback, to provide a miniaturized small wire connector which can connect a large number of wires using a small number of parts and at a low cost.

DISCLOSURE OF THE INVENTION

Means for Solving the First Task

A wire connector according to the present invention is, in view of the above-mentioned first task, constituted such that the wire connector comprises a housing, a conductive fitting which is housed in the inside of the housing, a leaf spring which is bent in an approximately V shape and has a one-side end portion thereof brought into pressure contact with the conductive fitting, and a manipulation button which is slidably inserted into the housing in an axial direction, wherein by pushing one end portion of the manipulation button in the direction toward the housing, the other end portion of the manipulation button pushes a one-side end portion of the leaf spring downwardly to generate the resilient deformation of the leaf spring, an upper face of a shaft portion of the manipulation button is pressed to a fixed part due to a reaction of the resilient deformation so as to lock the manipulation button, while by pulling out the manipulation button from the housing, the one end portion of the leaf spring is resiliently restored and a wire which is inserted into the inside of the housing is clamped by the one-side end portion of the leaf spring and the conductive fitting.

Further, another wire connector according to the present invention comprises a box-shaped casing having an approximately L-shaped recessed portion which is formed by providing a corner portion at a side corner portion thereof, a conductive fitting which has a front face portion capable of being housed in the recessed portion of the casing and forms a bent lug on an upper end peripheral portion thereof, a leaf spring which is bent in an approximately V shape and brings a one-side end portion thereof into pressure contact with a lower face of the bent lug of the conductive fitting, and a manipulation button which has a shaft portion thereof inserted into the casing such that the shaft portion is slidable in a sideward direction and has a distal end portion of a lower face of the shaft portion formed into a manipulation portion which is capable of pushing an upper face of one side of the leaf spring, wherein when the manipulation button is pushed into the inside of the casing, the manipulation portion pushes down the one side of the leaf spring, whereas an upper face of the shaft portion of the manipulation button is pushed and locked to a corner portion of the casing due to a reaction of the leaf spring.

Accordingly, with a provision of either one of the above-mentioned inventions, it is no more necessary to form engaging portions on outer side faces of a casing as in the case of the prior art whereby the structure can be simplified and the miniaturization of the device is facilitated.

As another wire connector according to the present invention, the wire connector may be constituted such that the wire connector comprising a box-shaped casing having an approximately L-shaped recessed portion which is formed by providing a corner portion at a side corner portion thereof, a conductive fitting which has a front face portion capable of being housed in the recessed portion of the casing and forms a bent lug on an upper end peripheral portion thereof, a leaf spring which is bent in an approximately V shape and brings a one-side end portion thereof into pressure contact with a lower face of the bent lug of the conductive fitting, and a manipulation button which has a shaft portion thereof inserted into the casing such that the shaft portion is slidable in a sideward direction and has a distal end portion of a lower face of the shaft portion formed into a manipulation portion which is capable of pushing an upper face of one side of the leaf spring, wherein a bent portion of the leaf spring has a wide width and, at the same time, a fitting opening which allows the fitting of the bent portion thereinto is formed on the front face portion of the conductive fitting.

Accordingly, according to this invention, since only the bent portion has a wide width, it is possible to ensure a spring force which can achieve the desired reliability of contact without deforming the conductive fitting. Particularly, since the bent portion having a wide width is fitted into the fitting opening of the conductive fitting, it is possible to save a space for housing the leaf spring so that the device can be miniaturized.

Further, another wire connector according to the present invention is constituted such that the wire connector comprises a box-shaped casing having an inverted T-shaped recessed portion which is formed while providing corner portions at both side corner portions thereof, a conductive fitting which has a front face portion capable of being housed in the recessed portion of the casing and has an upper-end center peripheral portion formed into a bent lug, a pair of leaf springs which are bent in an approximately V shape and bring one-side end portions thereof into pressure contact with a lower face of the bent lug of the conductive fitting, and a pair of manipulation buttons which have shaft portions thereof slidably inserted into the casing and form manipulation portions which are capable of pushing one-side upper faces of the leaf springs on lower-face distal end portions of the shaft portions, wherein when the manipulation buttons are pushed into the inside of the casing, each manipulation portion pushes down one-side of the leaf spring, whereas an upper face of the shaft portion of the manipulation button is pressed and locked to the corner portion of the casing due to a reaction of the leaf spring.

According to this invention, it is no more necessary to form engaging portions on an outside face of the casing as in the case of the prior art and hence, the structure can be simplified and the miniaturization of the device is facilitated. Further, two wires which are inserted into the casing can be connected to each other so that it is possible to select the different connection mode thus enhancing the availability of the wire connector.

Further, the wire connector according to the present invention is constituted such that the wire connector comprises a box-shaped casing having an inverted T-shaped recessed portion which is formed while providing corner portions at both side corner portions thereof, a conductive fitting which has a front face portion capable of being housed in the recessed portion of the casing and has an upper-end center peripheral portion formed into a bent lug, a pair of leaf springs which are bent in an approximately V shape and bring one-side end portions thereof into pressure contact with a lower face of the bent lug of the conductive fitting, and a pair of manipulation buttons which have shaft portions thereof slidably inserted into the casing and form manipulation portions which are capable of pushing one-side upper faces of the leaf springs on lower-face distal end portions of the shaft portions, wherein the bent portions of the leaf springs have a wide width and fitting openings which allow fitting of the bent portions thereinto are formed in the front face portion of the conductive fitting.

According to the present invention, in addition to the above-mentioned advantageous effects, since only the bent portion has a wide width, it is possible to ensure a spring force which can achieve the desired reliability of contact without deforming the conductive fitting. Particularly, since the bent portion having a wide width is fitted into the fitting opening of the conductive fitting, a space for housing the leaf spring can be saved and hence, the device can be miniaturized.

Further, one embodiment of the above-mentioned wire connector according to the present invention may be constituted such that a stopper pawl portion is formed on the conductive fitting and a groove portion which can be engaged with the stopper pawl portion is formed in the shaft portion of the manipulation button in the sliding direction.

Accordingly, according to this embodiment, even when the manipulation button is not brought into pressure contact with the leaf spring, there is no possibility that the manipulation button is removed from the casing.

Further, the embodiment of the wire connector according to the present invention may be constituted such that a terminal platform is formed by integrally connecting a plurality of casings. Still further, the embodiment of the wire connector according to the present invention may be constituted such that into a connection fitting receiving portion which surrounds a terminal of the conductive fitting which projects from the casing, a connection fitting projection which projects from other casing and covers a terminal receiving portion of the conductive fitting is fitted thus establishing an electric connection. The embodiment of the wire connector according to the present invention may be also constituted such that into a connection fitting receiving portion which surrounds a terminal mounted on a printed circuit board, a connection fitting projection which projects from the casing and covers a terminal receiving portion of the conductive fitting is fitted to thus establishing an electric connection.

Not to mention the connections of wires together, the wire connector according to the present invention is applicable to the connection of wires to a printed circuit board whereby the availability of the wire connector is enhanced.

Means for Solving the Second Task

A wire connector according to the present invention is, in view of the above-mentioned second task, constituted such that in the wire connector in which by pushing one end portion of a manipulation button which is slidably inserted into a housing in an axial direction toward the housing, one end portion of a leaf spring which is housed in the housing is resiliently deformed and locked by the other end portion of the manipulation button, while by pulling out the manipulation button from the housing, one end portion of the leaf spring is resiliently restored and a wire which is inserted into the housing is clamped by one end portion of the leaf spring and the conductive fitting housed in the housing, wherein one end portion of a lever is rotatably supported in the vicinity of one end portion of the manipulation button, by pushing down the other end portion of the lever toward the housing, the manipulation button is pulled out by making use of a principle of lever.

Further, another wire connector according to the present invention is constituted such that in the wire connector in which by pulling out one end portion of a manipulation button which is slidably inserted into a housing in an axial direction from the housing, one end portion of a leaf spring which is housed in the housing is resiliently deformed and locked by the other end portion of the manipulation button, while by pushing the manipulation button into the housing, one end portion of the leaf spring is resiliently restored and a wire which is inserted into the housing is clamped by one end portion of the leaf spring and the conductive fitting housed in the housing, wherein one end portion of a lever is rotatably supported in the vicinity of one end portion of the manipulation button, and by pushing down the other end portion of the lever toward the housing, the manipulation button is pulled out by making use of a principle of lever.

In any one of the above-mentioned inventions, by pushing down the manipulation button and the lever, it is possible to mount or dismount the wire in one manipulation. Accordingly, it is possible to perform the mounting and dismounting operation of the wire using a same tool and hence, it is unnecessary to replace the tools whereby it is possible to obtain the wire connector which can be easily handled and can exhibit the high operability.

Further, the pulling-out of the manipulation button is performed by making use of a principle of lever such that the other end of the lever which has one end thereof rotatably supported on the manipulation button is pushed downwardly. Accordingly, there exists a limit with respect to a pulling-out quantity of the manipulation button and hence, there is no possibility that the manipulation button ruptures by an error as in the case of the conventional example.

Further, in the embodiment of the wire connector according to the present invention, the position of the lever differs corresponding to the position of the manipulation button. Accordingly, it is possible to judge a state whether the wire can be inserted or not based on the position of the lever whereby the wire connector which exhibits the further improved operability can be obtained.

As an embodiment of the present invention, an approximately cruciform manipulation recessed portion may be formed in an end face of one end portion of the manipulation button. Further, a manipulation recessed portion may be formed in the other end portion of the lever.

According to this embodiment, since the manipulation recessed portion is formed in one end portions of the manipulation button and the lever, it is possible to perform the positioning of the manipulation tool rapidly and accurately and hence, it gives rise to an advantageous effect that it is possible to obtain the wire connector which can further enhance the operability.

Further, another wire connector according to the present invention is constituted such that the wire connector comprising a conductive fitting which has a front face portion capable of being housed in the inside of a housing, forms a bent lug horizontally on an upper-end left side peripheral portion thereof, and forms a position restricting tongue horizontally at a neighboring position which is lower than the bent lug by one stage, a leaf spring which is bent in an approximately V shape, is mounted on the conductive fitting, and brings a one-side end portion thereof into pressure contact with a lower face of the bent lug of the conductive fitting, and a manipulation button which is slidably inserted into the housing in an axial direction, wherein by pushing one end portion of the manipulation button in the axial direction, the other end portion of the manipulation button pushes down one side of the leaf spring, whereas an upper face of the shaft portion of the manipulation button is pressed and locked to the position restricting tongue of the conductive fitting by a reaction of the leaf spring, while by pulling out the manipulation button in the axial direction, one end portion of the leaf spring is resiliently restored so that a wire which is inserted into the inside of the housing is clamped by one end portion of the leaf spring and the bent lug of the conductive fitting.

According to the present invention, it is no more necessary to form engaging portions on an outer face of the casing as in the case of the prior art and hence, the structure of the housing can be simplified and the miniaturization of the device is facilitated. Particularly, since the manipulation button is supported only by the conductive fitting, it is possible to select a material of the casing so that the degree of freedom in designing can be expanded. Further, since the positional relationship between the metal-made conductive fitting and the manipulation button can be decided by the conductive fitting and the manipulation button, it is possible to obtain an advantageous effect that the assembling accuracy is enhanced.

Further, another wire connector according to the present invention is constituted such that the wire connector comprises a conductive fitting which has a front face portion capable of being housed in the inside of a housing, forms a bent lug horizontally on an upper-end center peripheral portion thereof, and forms position restricting tongues horizontally respectively at both neighboring sides of the upper-end center peripheral portion which are lower than the bent lug by one stage, a pair of leaf springs which are bent in an approximately V shape, are mounted on the conductive fitting, and bring one-side end portions thereof into pressure contact with a lower face of the bent lug of the conductive fitting, and a pair of manipulation buttons which are slidably inserted into the housing in an axial direction, wherein by pushing one end portions of the manipulation buttons in the axial direction, the other end portions of the manipulation buttons push down one sides of the leaf springs, whereas upper faces of the shaft portions of the manipulation buttons are pressed and locked to the position restricting tongue of the conductive fitting due to a reaction of the leaf spring, while by pulling out the manipulation buttons in the axial direction, one end portions of the leaf springs are resiliently restored so that wires which are inserted into the inside of the housing are clamped by one end portions of the leaf springs and the bent lug of the conductive fitting.

According to the present invention, in addition to the above-mentioned advantageous effects, it is possible to connect two wires inserted into the casing with each other so that a different connection mode can be selected thus increasing the availability of the wire connector.

Further, as an embodiment of the present invention, a stopper pawl portion may be formed on the conductive fitting and a groove portion which can be engaged with the stopper pawl portion may be formed in the shaft portion of the manipulation button in the sliding direction.

According to this embodiment, according to this embodiment, even when the manipulation button is not brought into pressure contact with the leaf spring, there is no possibility that the manipulation button is removed from the casing.

Means for Solving the Third Task

The wire connector according to the present invention is, to achieve the above-mentioned third object, constituted such that the wire connector comprises a housing, a connector which is mounted on the housing and to which input/output lines which are connected to an external equipment are capable of being connected, a printed circuit board which is arranged substantially parallel to a connection face of the housing and is electrically connected to a terminal of the connector, and a large number of connection units which are arranged on the connection face of the housing, are electrically connected to the connector by way of the printed circuit board, and are respectively connected to input/output lines of a large number of electric equipments, wherein the connection unit comprises conductive fittings which are respectively arranged below a large number of wire insertion holes which are formed in parallel in the left and right direction at a given pitch on a connection face which is coplanar with the connection face of the housing thus forming a row and also forms rows in front of and behind the row, and are connected to the printed circuit board, holding spring portions which are respectively arranged below the wire insertion holes and are mounted on the conductive fittings, and manipulation buttons which are axially movably inserted into manipulation button insertion holes which are respectively arranged in parallel at positions adjacent to the wire insertion holes, wherein by manipulating the holding spring portions by moving the manipulation buttons having upper end portions thereof projected from the connection face of the housing in the axial direction, holding and releasing of the wires inserted through the wire insertion holes are performed.

According to the present invention, screw terminals are not used and the wires are connected by slidably moving the manipulation buttons in the axial direction and hence, the wires can be connected in a concentrated manner so that a relay terminal having a small floor area can be obtained. Further, since the connection units are all arranged on the same plane, relay terminal having a low height can be obtained. Further, the conductive fittings which are arranged between the connection face of the casing and the printed circuit board may have the same height. Accordingly, it is unnecessary to prepare a large kinds of conductive fittings which differ in height as in the case of the prior art so that the administration of part is facilitated whereby the production cost can be reduced.

In this manner, according to the present invention, it is possible to obtain the miniaturized and inexpensive wire connector which exhibits the small floor area and the small height.

Further, another wire connector according to the present invention is constituted such that the wire connector comprises a housing, a connector which is mounted on the housing and to which input/output lines which are connected to an external equipment are capable of being connected, a printed circuit board which is arranged substantially parallel to a connection face of the housing and is electrically connected to a terminal of the connector, and a large number of connection units which are arranged on the connection face of the housing, are electrically connected to the connector by way of the printed circuit board, and are respectively connected to input/output lines of a large number of electric equipments, wherein the connection unit comprises conductive fittings which are respectively arranged below a large number of wire insertion holes which are formed in parallel in the left and right direction at a given pitch on a connection face which is coplanar with the connection face of the housing thus forming a row and forms another separate rows in front of and behind the row by displacing the wire insertion holes in the lateral direction by a given size, and are connected to the printed circuit board, holding spring portions which are respectively arranged below the wire insertion holes and are mounted on the conductive fittings, and manipulation buttons which are axially movably inserted into manipulation button insertion holes which are respectively arranged in parallel at positions adjacent to the wire insertion holes, wherein by manipulating the holding spring portions by moving the manipulation buttons having upper end portions thereof projected from the connection face of the housing in the axial direction, holding and releasing of the wires inserted through the wire insertion holes are performed.

According to the present invention, in addition to the above-mentioned advantageous effects, the wire insertion holes are displaced by a given pitch. Accordingly, there is no possibility that the held wires are overlapped to the manipulation buttons and hence the operation is not obstructed, whereby it is possible to obtain the wire connector which can further enhance the operability.

As an embodiment of the present invention, a lever which is operated to pull out the shaft portion in the axial direction may be rotatably mounted on an upper end portion of the manipulation button.

According to this embodiment, it is possible to perform the mounting and dismounting of the wire by the same operation to push the manipulation button and lever and hence, the mounting and dismounting of the wire can be performed using the same tool so that it is unnecessary to change the tool whereby it is possible to obtain the wire connector which can be easily handled and can exhibit the high operability.

BRIEF DESCRIPTION OF THE DRAWINGS

FIG. 15 shows an operation state of the connector for wire connection shown in FIG. 14, wherein FIG. 15A is a plan view before performing the operation and FIG. 15B is a plan view after performing the operation.

FIG. 16 is a perspective view showing an assembled state, wherein FIG. 16A is a perspective view showing the assembled state when one connector for wire connection is assembled and FIG. 16B is a perspective view showing the assembled state when a plurality of connectors for wire connection are assembled.

FIG. 18 is an enlarged perspective view of constitutional parts shown in FIG. 17, wherein FIG. 18A is an enlarged perspective view of a lever and FIG. 18B is an enlarged perspective view of a manipulation button.

FIG. 19 is a view showing a state in which the manipulation button and the lever shown in FIG. 18 are assembled, wherein FIG. 19A is a perspective view and FIG. 19B is a front view.

FIG. 20 shows an operation state of the connector for wire connection shown in FIG. 17, wherein FIG. 20A is a front view before performing the operation and FIG. 20B is a front view after performing the operation.

FIG. 21 shows the connector for wire connection shown in FIG. 20, wherein FIG. 21A is a perspective view before performing the operation and FIG. 21B is a perspective view after performing the operation.

FIG. 22 shows a state in which a plurality of connectors for wire connection which constitute wire connectors of the third embodiment are assembled, wherein FIG. 22A is a perspective view before performing an operation and FIG. 22B is a perspective view after performing an operation.

FIG. 24 is a view showing an operation state of the connector for wire connection shown in FIG. 23, wherein FIG. 24A is a perspective view before performing the operation and FIG. 24B is a perspective view after performing the operation.

FIG. 25 is a view showing an operation state of the connector for wire connection shown in FIG. 23, wherein FIG. 25A is a front view before performing the operation and FIG. 25B is a front view after performing the operation.

FIG. 33 is a bottom plan view showing the relay terminal of the sixth embodiment according to the present invention, wherein FIG. 33A is a bottom plan view before mounting and FIG. 33B is a bottom plan view after mounting.

FIG. 47 is an enlarged perspective view of parts constituting the connection unit according to the seventh embodiment, wherein FIG. 47A is an enlarged perspective view of a lever and FIG. 47B is an enlarged perspective view of a manipulation button.

FIG. 48 is a view showing a state in which the manipulation buttons and the lever shown in FIG. 47 are assembled, wherein FIG. 48A is a perspective view and FIG. 48B is a front view.

FIG. 49 is a view showing a manipulation state of the relay terminal shown in FIG. 46, wherein FIG. 49A is a front view before performing an operation and FIG. 49B is a front view after performing the operation.

BEST MODE FOR CARRYING OUT THE INVENTION

Figure 1:
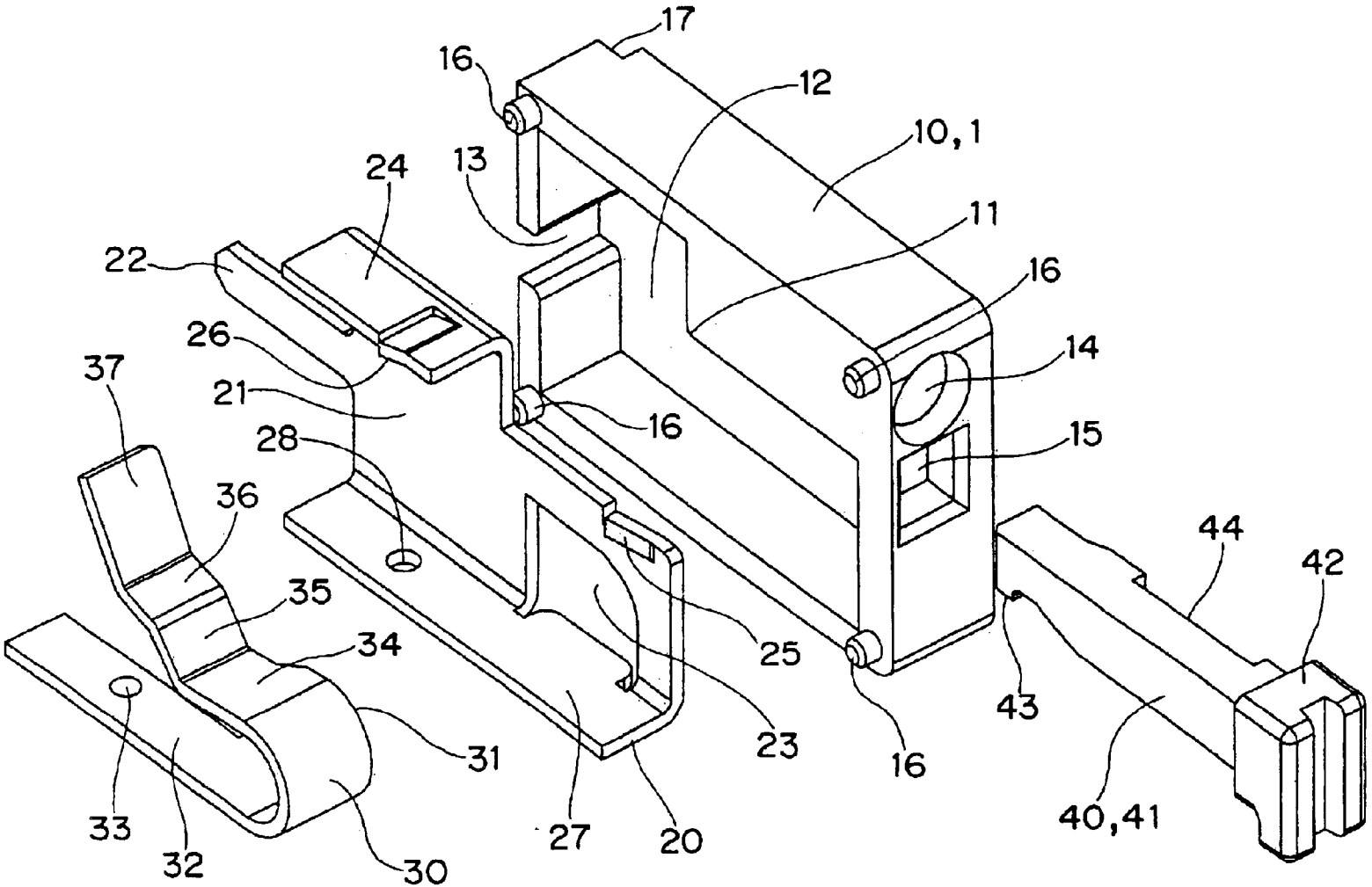
FIG. 1 is an exploded perspective view showing a connector for wire connection of the first embodiment of a wire connector according to the present invention.
Figure 2:
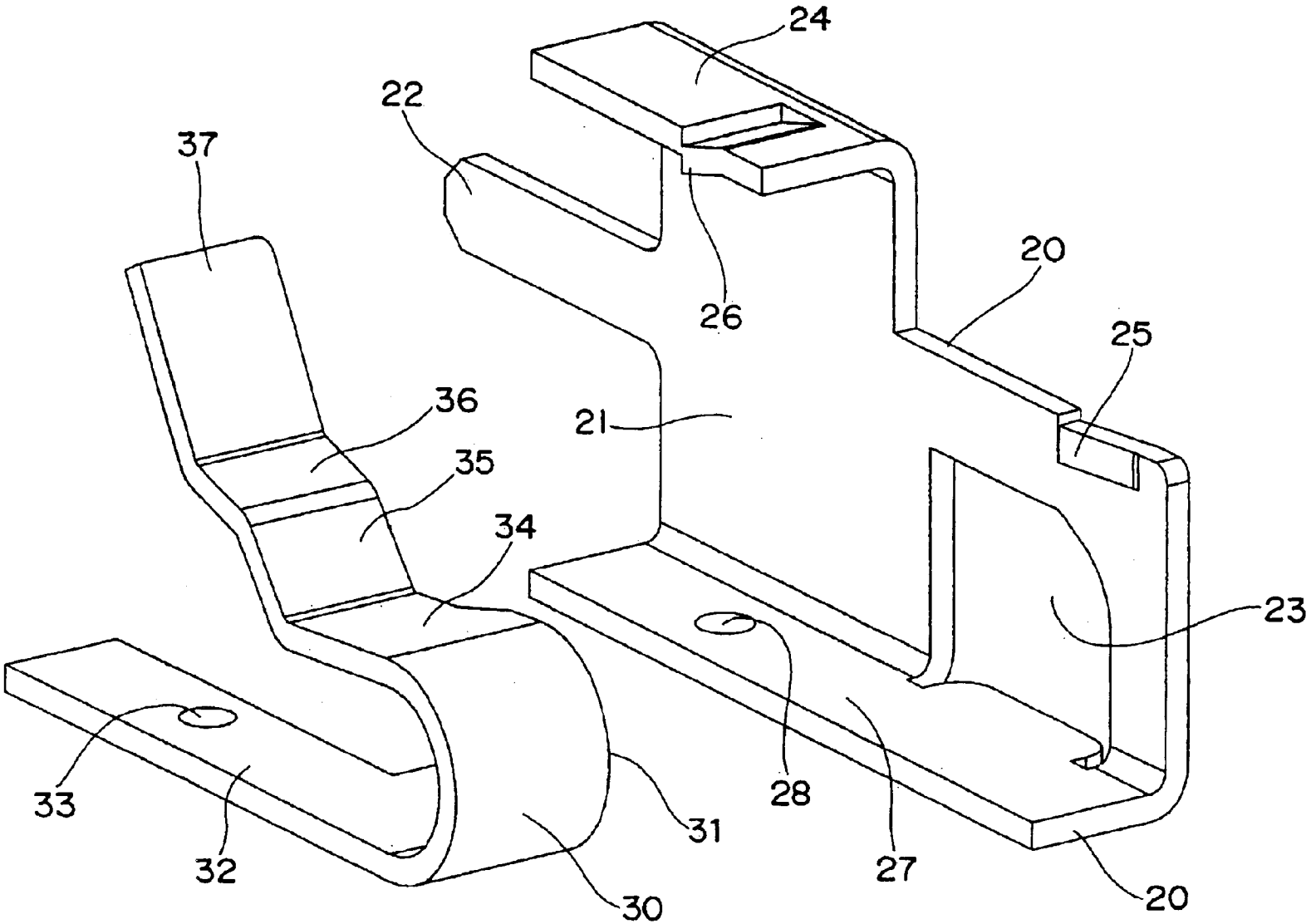
FIG. 2 is an enlarged perspective view of constitutional parts shown in FIG. 1.
Figure 3:
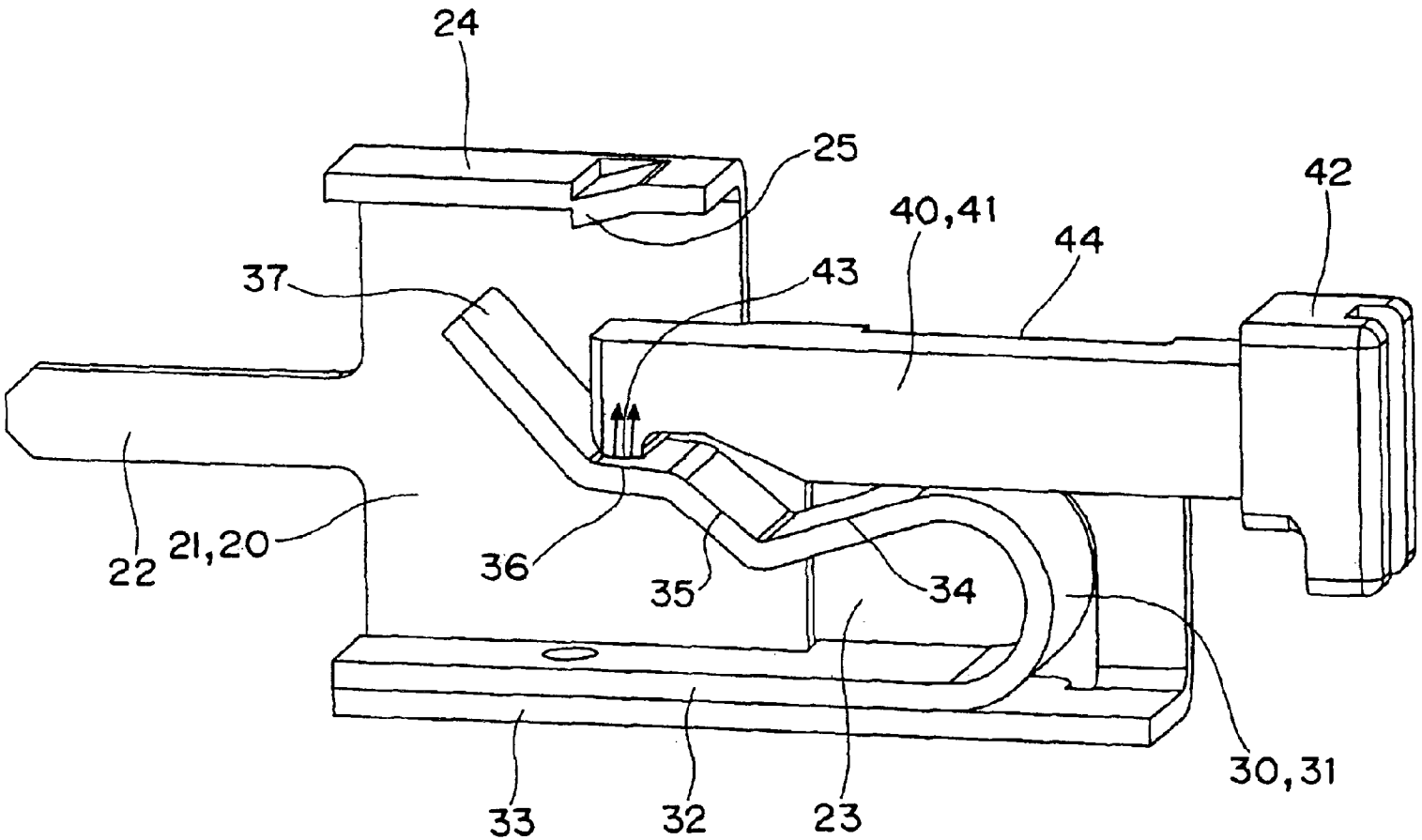
FIG. 3 is a perspective view showing a state in which the constitutional parts shown in FIG. 1 are assembled.
Figure 4:
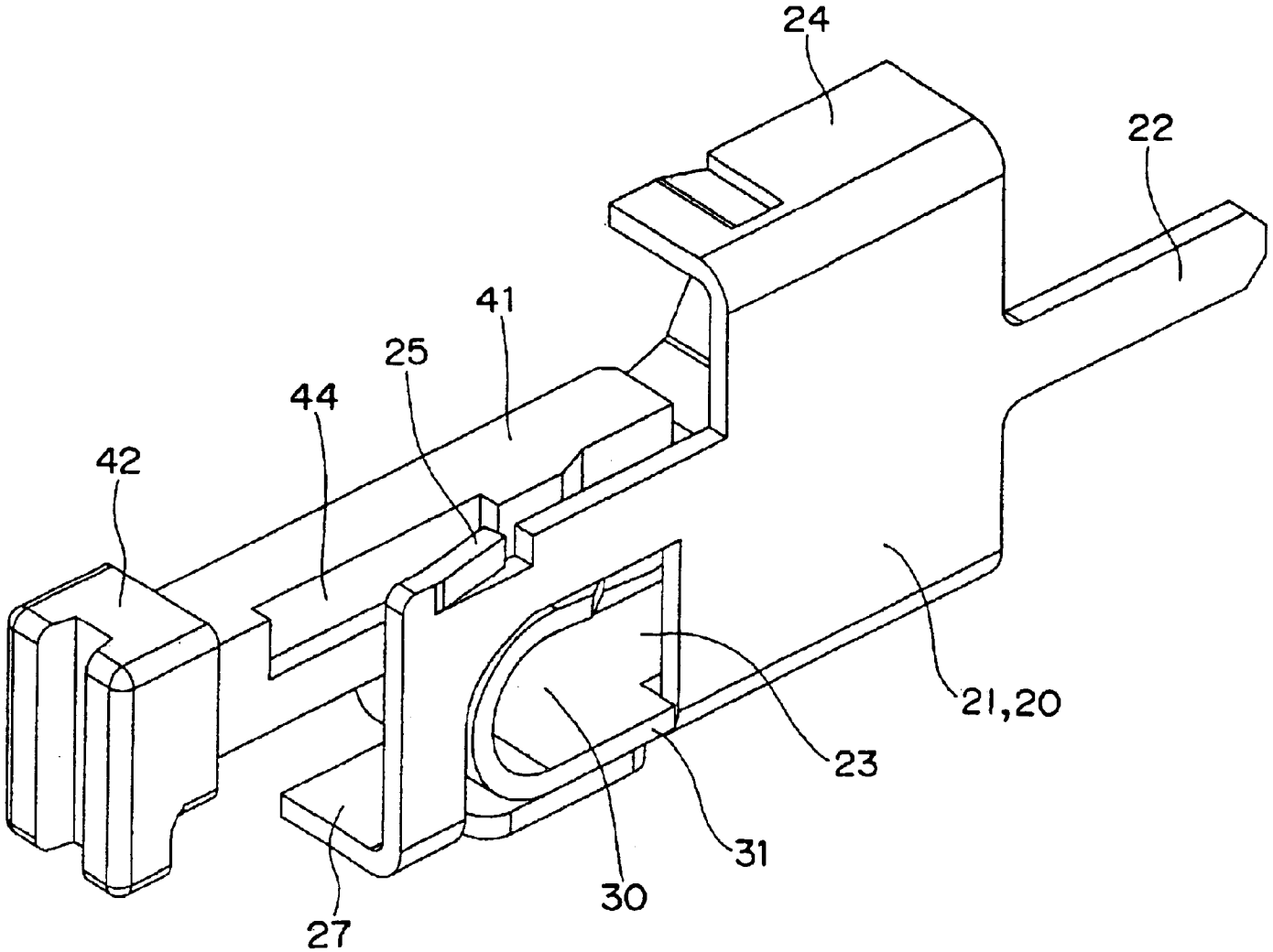
FIG. 4 is a perspective view as viewed from an angle different from a viewing angle of FIG. 3.

The first embodiment of a wire connector according to the present invention is directed to a connector 1 for wire connection which substantially comprises, as shown in FIG. 1 to FIG. 13, a casing 10, a conductive fitting 20, a leaf spring 30, a manipulation button 40, and a cover 50.

The casing 10 is a box having a rectangular parallelepiped shape and defines an approximately L-shaped recessed portion 12 by forming a position restricting corner portion 11 in the inside thereof. A notched portion 13 into which a terminal described later is fitted is formed in one of opposing side end faces, while a wire insertion hole 14 and a manipulation button insertion hole 15 are formed in the other of the opposing side end faces. Further, with respect to the casing 10, positioning projections 16 are projected from corner portions of an open-side front face, while recessed portions 17 into which the projections 16 are fitted are formed in corner portions of a back face.

When necessary, push-insertion holes (not shown in the drawing) are respectively formed in the corner portions of the back face of the casing 10, wherein by inserting the projections 16 into the push-insertion holes under pressure, a plurality of casings 10 may be integrally joined.

The conductive fitting 20 includes a front face portion 21 having a shape which allows the conductive fitting 20 to be fitted into the recessed portion 12 of the casing 10. A terminal 22 is extended in a sideward direction from a left end peripheral portion of the front face portion 21, while a fitting opening 23 is formed in a right half of one side of the conductive fitting 20. Further, with respect to an upper end peripheral portion of the front face portion 21, an upper bent lug 24 is formed on a left side peripheral portion, while a stopper pawl 25 is formed in an erected shape on a right side peripheral portion. On the above-mentioned upper bent lug 24, a stopper projection 26 which prevents the removal of a wire 2 described later is formed by projection machining. On the other hand, a lower bent lug 27 is formed on a lower end peripheral portion of the front face portion 21. A positioning hole 28 is formed in the lower bent lug 27.

A leaf spring 30 is bent in an approximately V shape, wherein a bent portion 31 has a large width and can be fitted into the fitting opening 23 of the conductive fitting 20. Then, a positioning projection 33 which is engaged with the positioning hole 28 of the conductive fitting 20 is formed in a bottom face portion 32 of the leaf spring 30 by projection machining. Further, in a bridging portion 34 extending from the bent portion 31, a first bent portion 35, a second bent portion 36 and a pushing tongue portion 37 are sequentially formed.

Accordingly, when the positioning projection 33 of the leaf spring 30 is fitted into the positioning hole 28 of the lower bent lug 27, the pushing tongue portion 37 is brought into pressure contact with a lower face of the upper bent lug 24 due to a spring force of the leaf spring 30 and hence, both ends of the leaf spring 30 are brought into contact with the conductive fitting 20 and are held by the conductive fitting 20. Then, the above-mentioned conductive fitting 20 is assembled to the casing 10 such that the conductive fitting 20 is fitted into the recessed portion 12 of the casing 10.

The manipulation button 40 is constituted of a shaft portion 41 which can be inserted into the insertion hole 15 formed in the casing 10 and a head portion 42 which has one end thereof integrally formed with the shaft portion 41 and defines an insertion position of the above-mentioned shaft portion 41. The manipulation button 40 defines a manipulation portion 43 on a distal end of a lower face of the shaft portion 41 and a stepped portion 44 for preventing removal is formed on an upper end peripheral portion of an inwardly directed face in a sliding direction.

Accordingly, when the shaft portion 41 of the manipulation button 40 is pushed into the casing 10 through the insertion opening 15 of the casing 10, the stepped portion 44 is engaged with the stopper pawl 25 of the conductive fitting 20 (FIG. 4), and the shaft portion 41 is brought into contact with the first bent portion 35 after reaching the bridging portion 34 of the leaf spring 30. In this state, the removal of the manipulation button is prevented by the stopper pawl 25.

Figure 5:
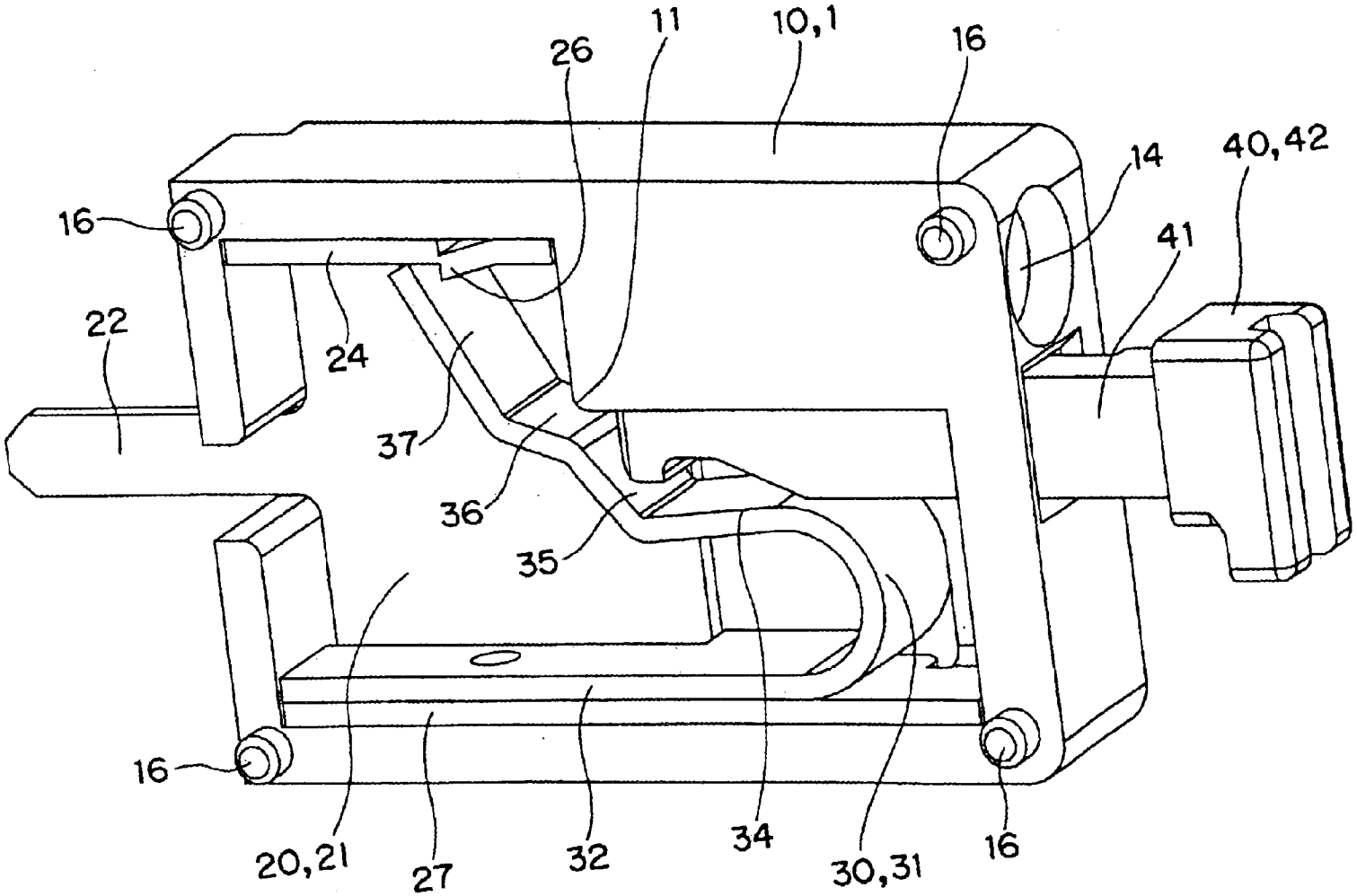
FIG. 5 is a perspective view showing a state in which the constitutional parts shown in FIG. 1 are all assembled.
Figure 6:
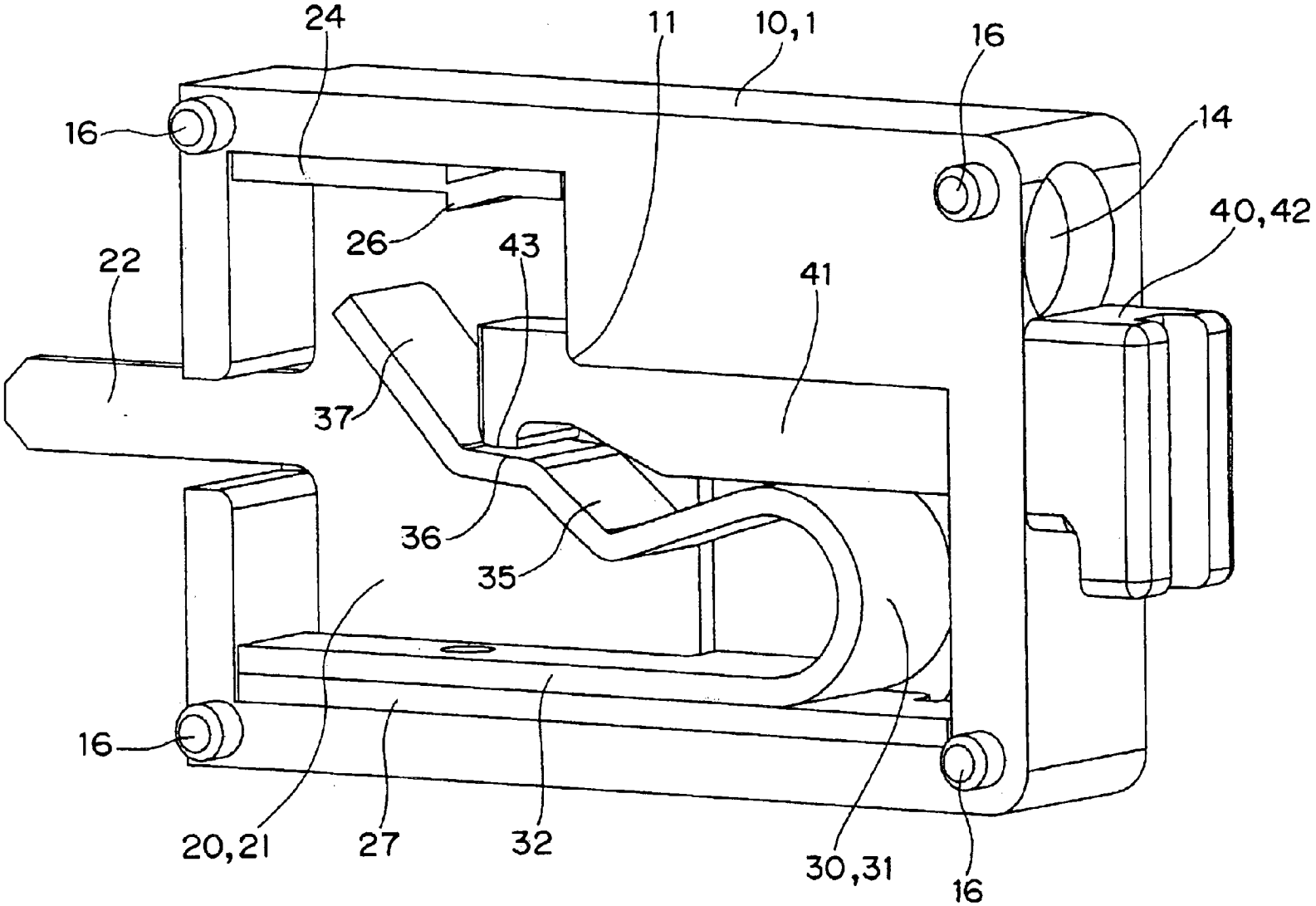
FIG. 6 is a perspective view showing an operation state of FIG. 5.
Figure 7:
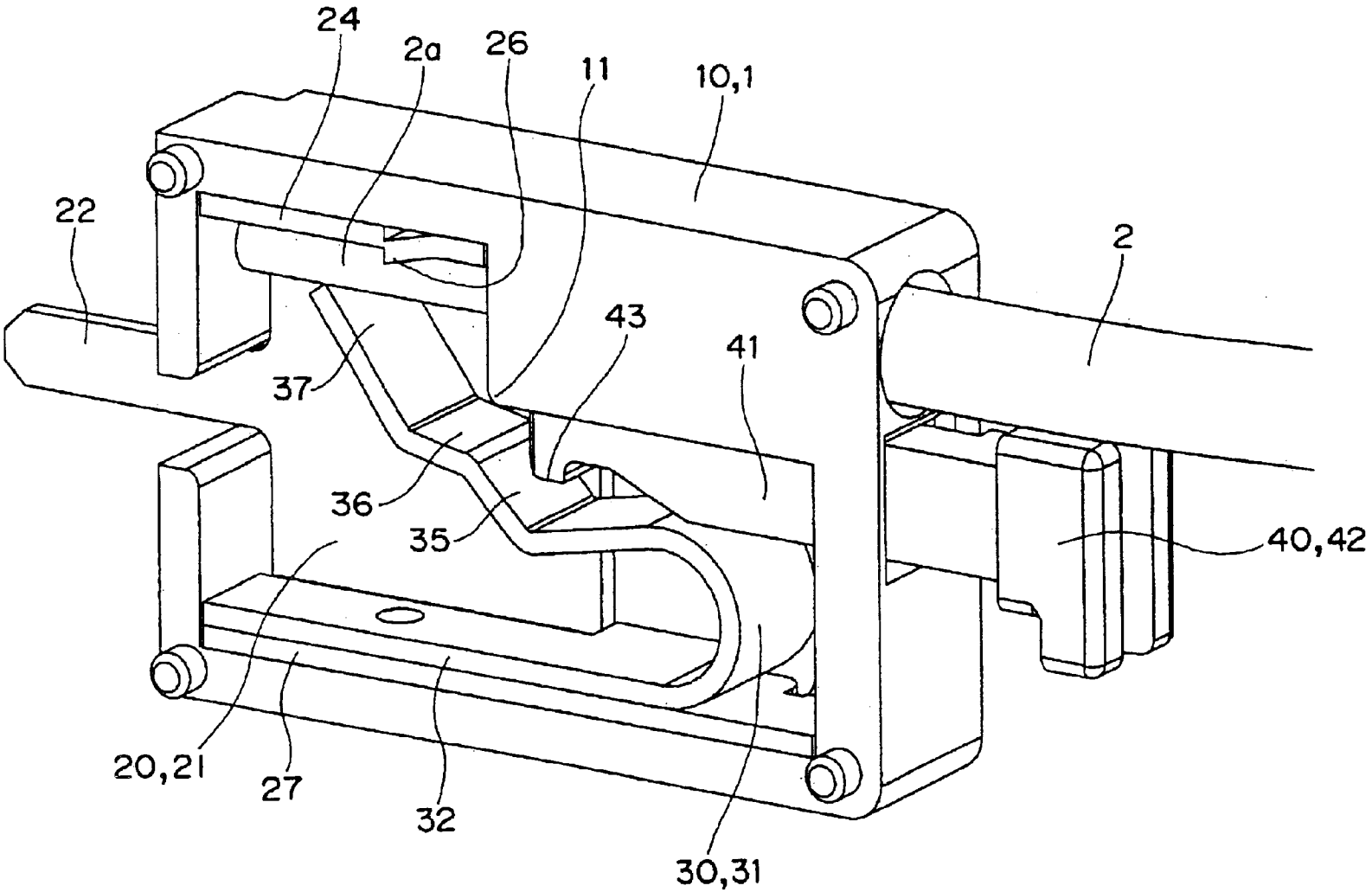
FIG. 7 is a perspective view showing a state in which a wire is assembled to the first embodiment shown in FIG. 6.

Further, as shown in FIG. 5, when the manipulation button 40 is pushed into the casing 10, the manipulation portion 43 gets over the first bent portion 35 and reaches the second bent portion 36 against the spring force of the bent portion 31 and, at the same time, the head portion 42 is brought into contact with an outer side face of the casing 10 so that the position of the manipulation button 40 is restricted. Accordingly, the pushing tongue portion 37 is pressed downwardly thus giving rise to a gap between the pushing tongue portion 37 and the upper bent lug 24 of the conductive fitting 20. Here, the manipulation portion 43 is pressed upwardly due to the spring force of leaf spring 30 and hence, an upper face of the shaft portion 41 is brought into contact with the corner portion 11 of the casing 10 and is locked thereto (FIG. 6). Accordingly, there is no possibility that the manipulation button 40 is freely restored. Subsequently, when the manipulation button 40 is pulled back after inserting the wire 2 into the casing 10 through the insertion hole 14 of the casing 10, the leaf spring 30 is restored due to the spring force thereof. Accordingly, the upper bent lug 24 of the conductive fitting 20 and the pushing tongue portion 37 of the leaf spring 27 clamp a lead 2*a* thus establishing an electric connection (FIG. 7). Here, since the stepped portion 44 of the manipulation button 40 is engaged with the stopper pawl 25 of the conductive fitting 20, there is no possibility that the manipulation button 40 is removed.

Figure 8:
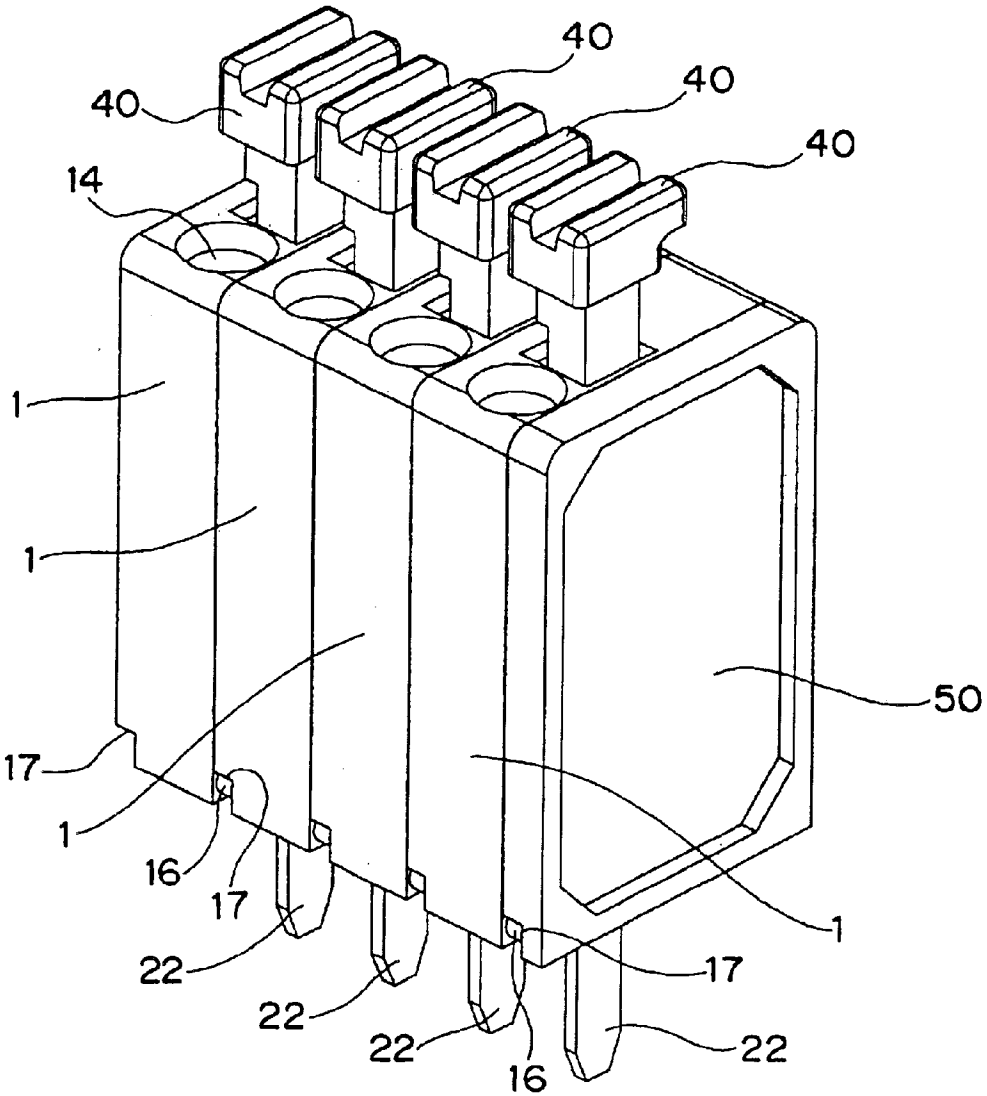
FIG. 8 is a perspective view showing a state in which a plurality of connectors for wire connection of the first embodiment according to the present invention are assembled.

Further, when four wires are connected to each other, for example, as shown in FIG. 8, the projections 16 of the casing 10 are fitted into the recessed portions 17 which are formed in a back face of other casing 1 so that four casings 10 are integrally joined. Here, by covering an open-ended face of the casing 10 with the cover 50, a terminal platform may be formed.

Figure 9:
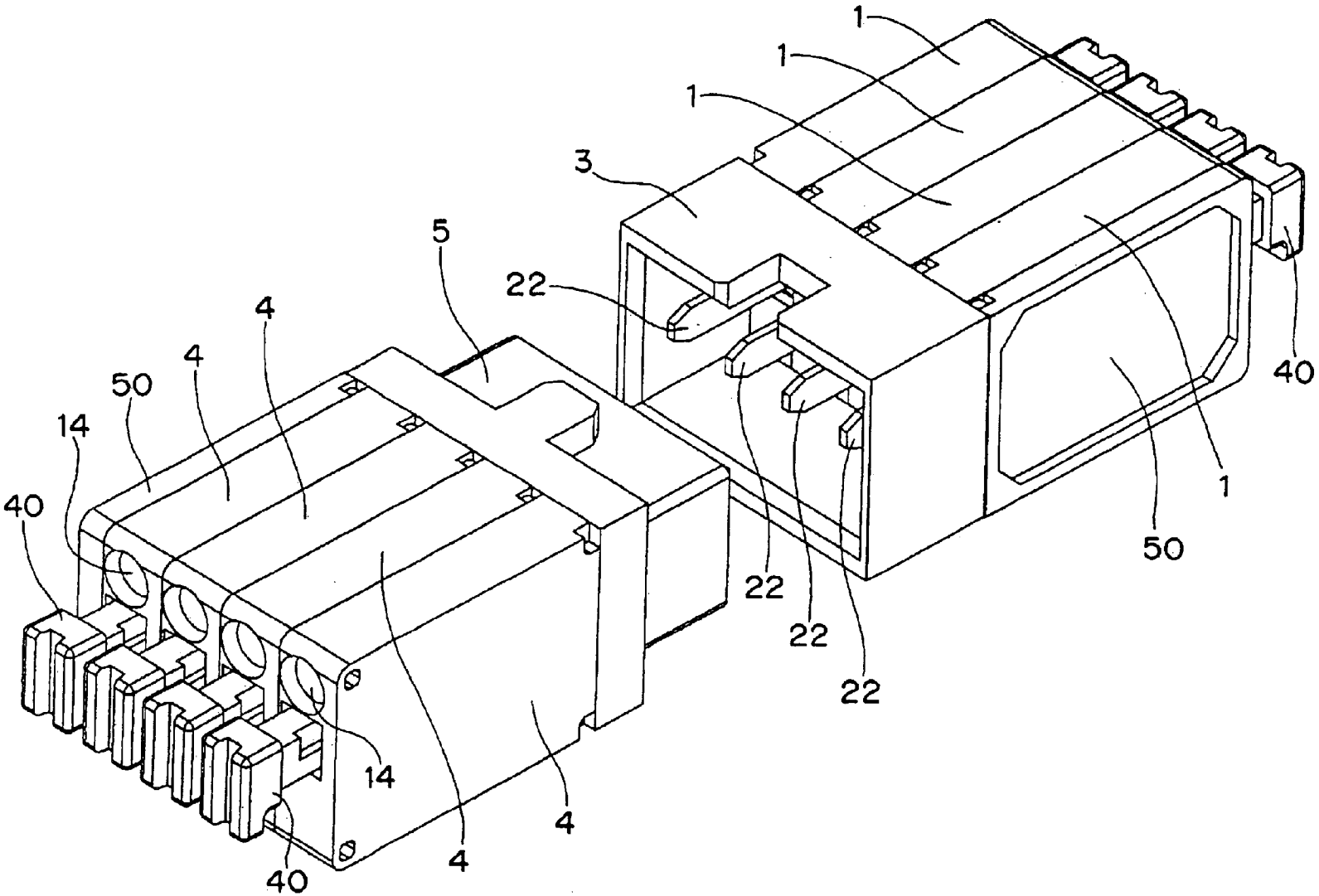
FIG. 9 is a perspective view for explaining the manner of connecting the connector for wire connection with another connector for wire connection.
Figure 10:
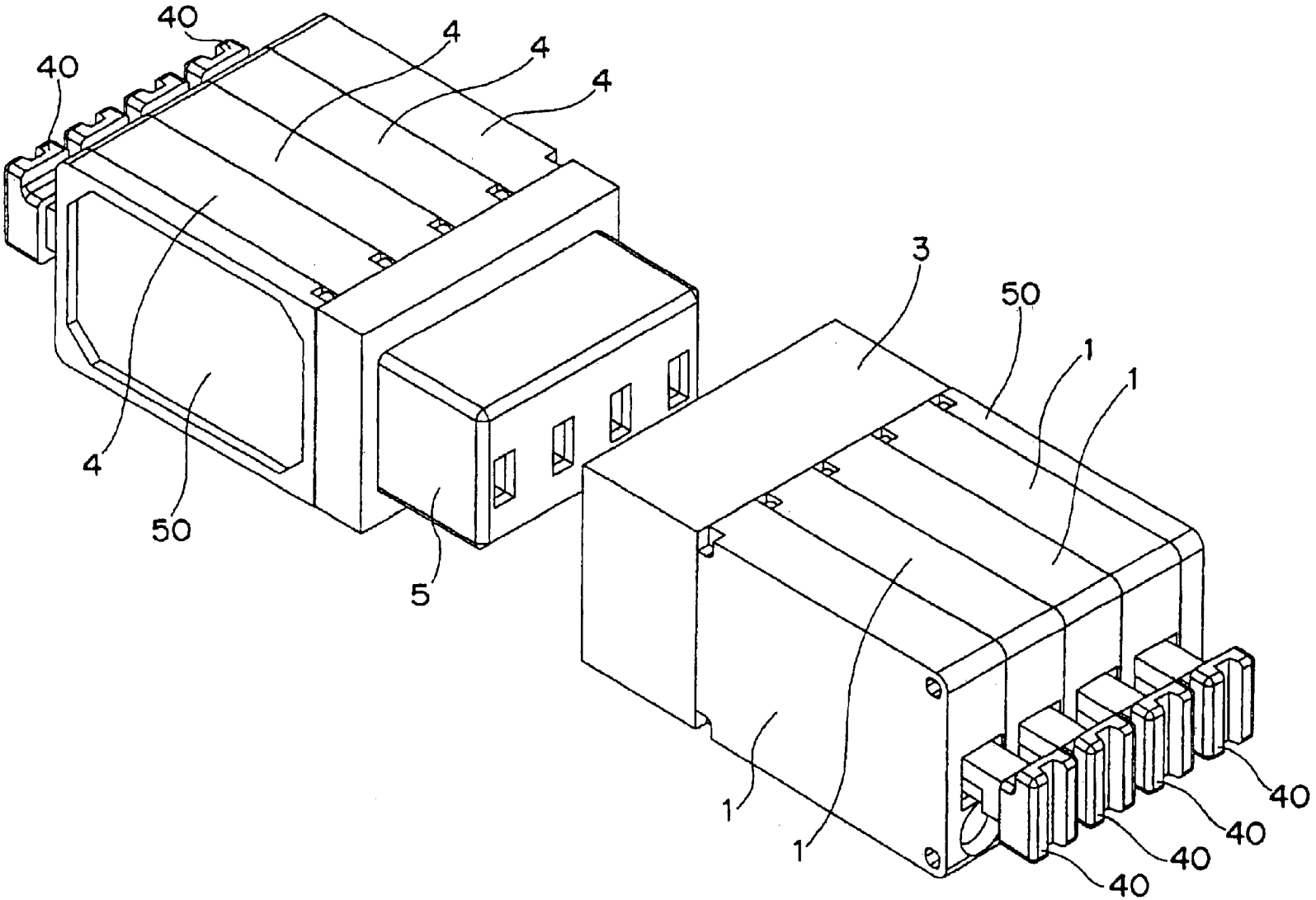
FIG. 10 is a perspective view as viewed from an angle different from a viewing angle of FIG. 9.

Further, as shown in FIG. 9, a fitting receiving portion 3 is mounted on the terminal platform of FIG. 8. On the other hand, connectors 4 for wire connection each of which incorporates a conductive fitting provided with a terminal receiving portion (not shown in the drawing) which clamps the terminal 22 are integrally joined to each other in the same manner as the above-mentioned connector 4 for wire connection and a fitting projection 5 is assembled to the connectors 4 for wire connection. Further, the connection may be established by fitting the fitting projection 5 into the fitting receiving portion 3 shown in FIG. 10. Here, for facilitating the understanding of explanation, the wires are not shown in the drawing.

Figure 11:
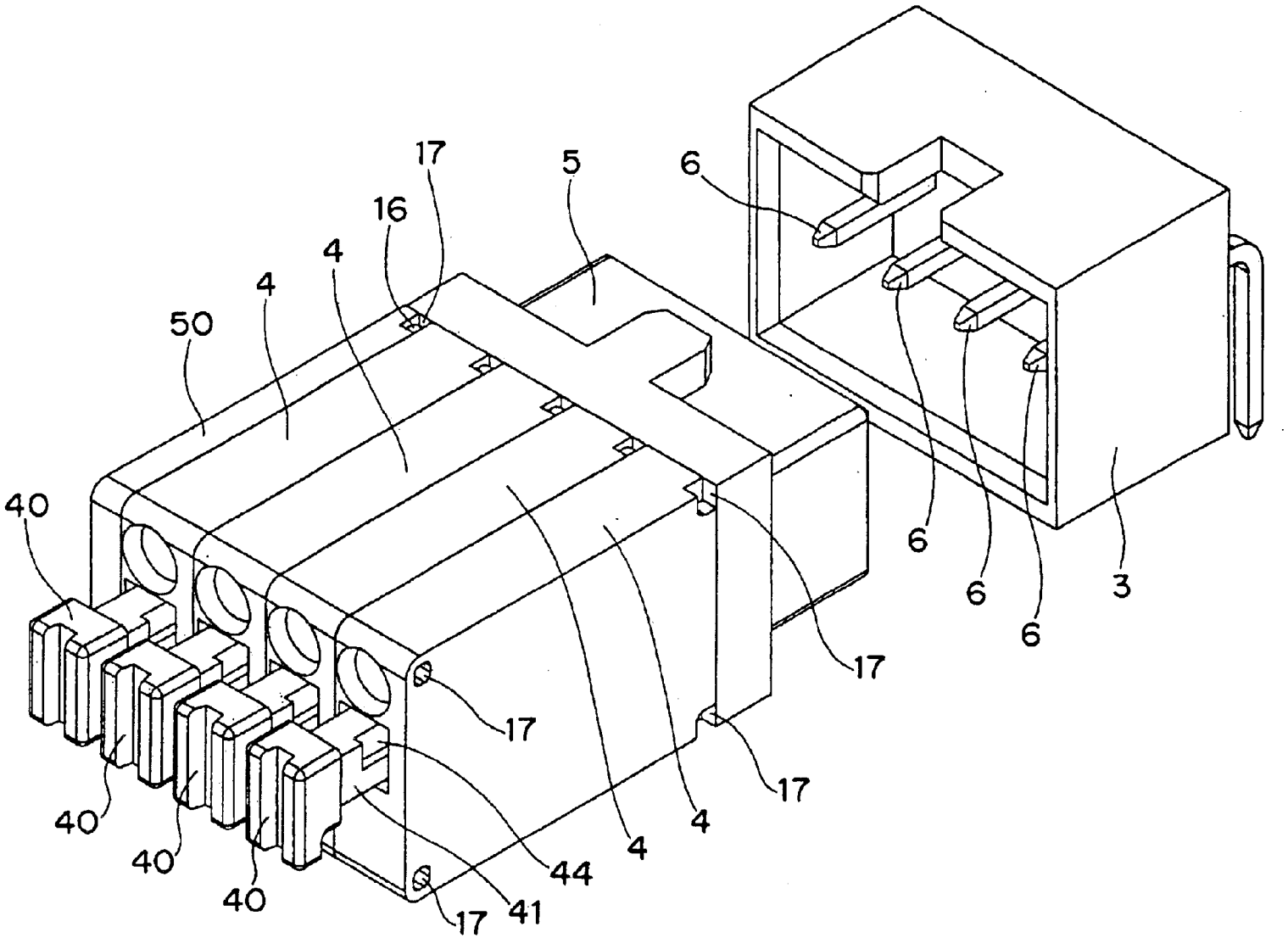
FIG. 11 is a perspective view for explaining a method for connecting the connector for wire connection with a printed circuit board.
Figure 12:
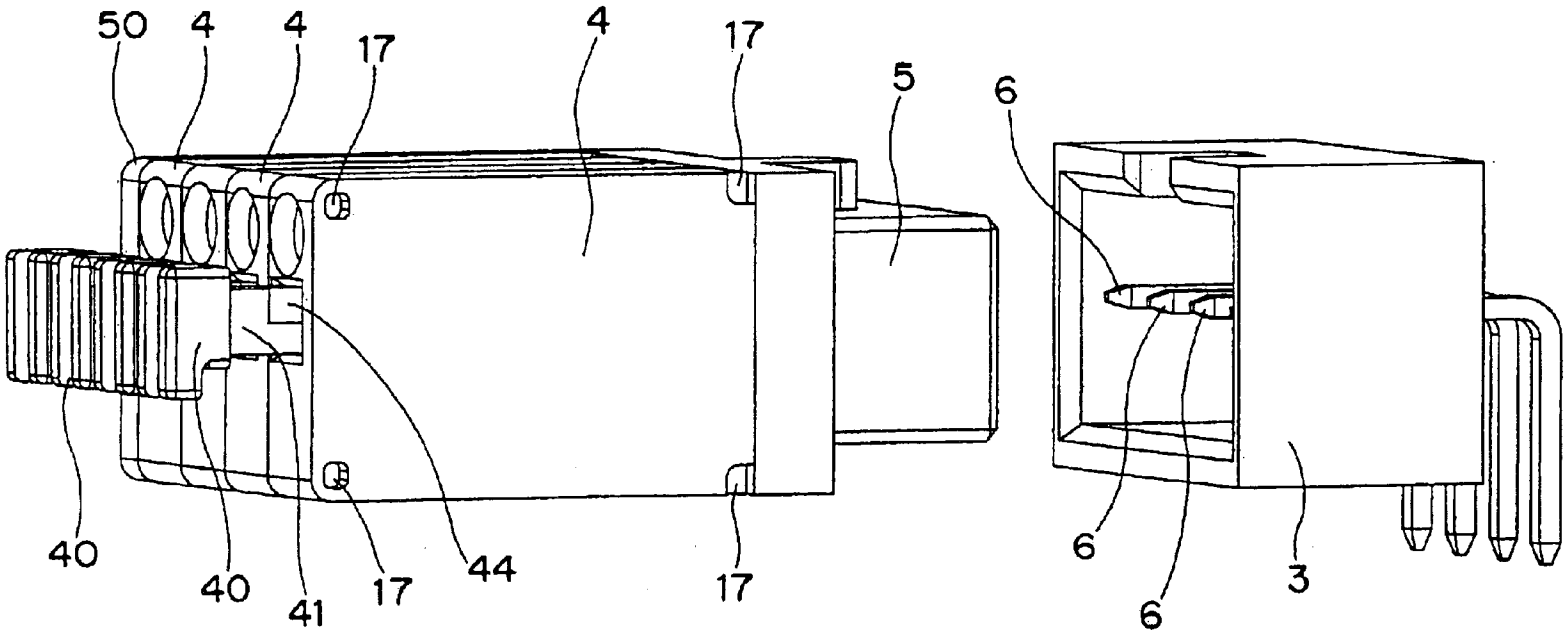
FIG. 12 is a perspective view as viewed from an angle different from a viewing angle of FIG. 11.

The present invention is not limited to a case in which a plurality of wires are connected to each other and may be applicable to a case in which wires are connected to a printed circuit board as shown in FIG. 11 and FIG. 12.

That is, the fitting projection 5 is mounted on four connectors 4 for wire connection which are integrally joined. On the other hand, four terminals 6 which are supported on the fitting receiving portion 3 are mounted on a printed circuit board not shown in the drawing. Further, the integral connection may be performed by fitting the fitting projection 5 into the fitting receiving portion 3.

Figure 13:
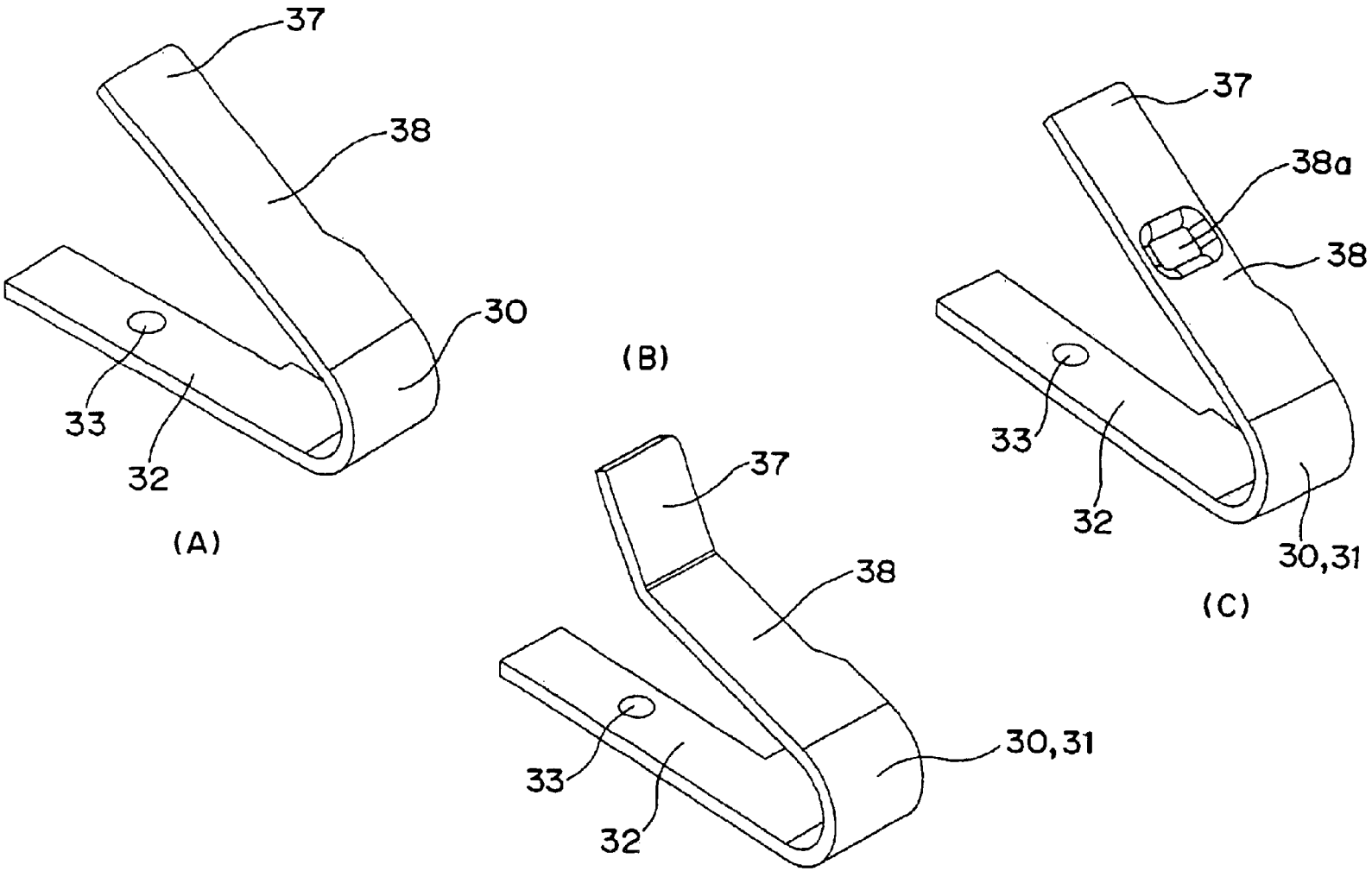
FIG. 13 is a perspective view showing modifications of a bent leaf spring.

Here, the shape of the above-mentioned leaf spring 30 is not limited to the above-mentioned shape, and the bridging portion, the first bent portion and the second bent portion may be formed into a bridging portion 38 having a same inclined face as shown in FIG. 13(A). Further, as shown in FIG. 13 (B), the leaf spring 30 may be formed in a shape that only the pushing tongue portion 37 is bent in an erected manner from the bridging portion 38. Further, as shown in FIG. 13(C), a positioning hole 38*a* may be formed in the bridging portion 38 in place of the second bent portion.

Figure 14:
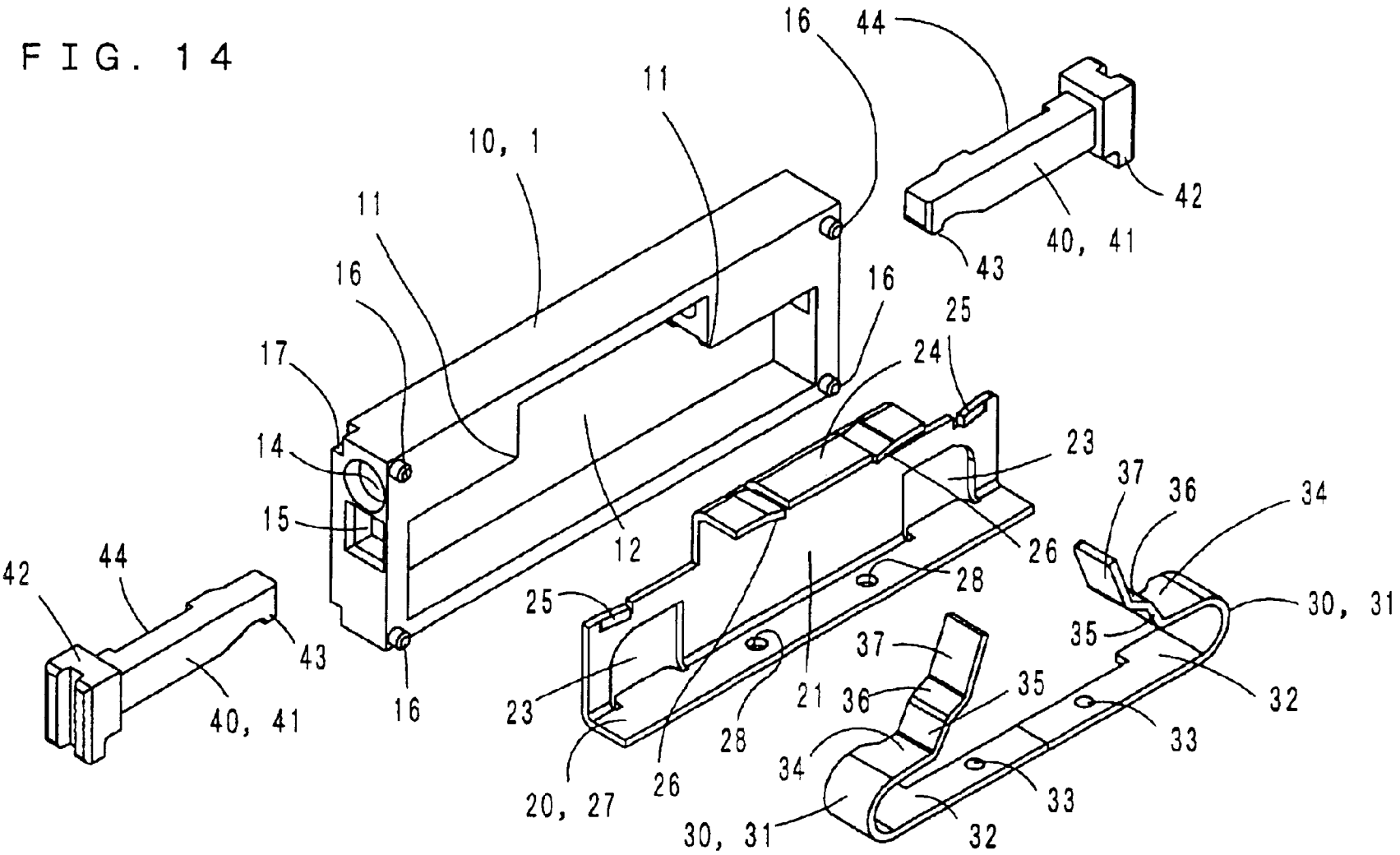
FIG. 14 is an exploded perspective view showing a connector for wire connection of the second embodiment of a wire connector according to the present invention.
Figure 15:
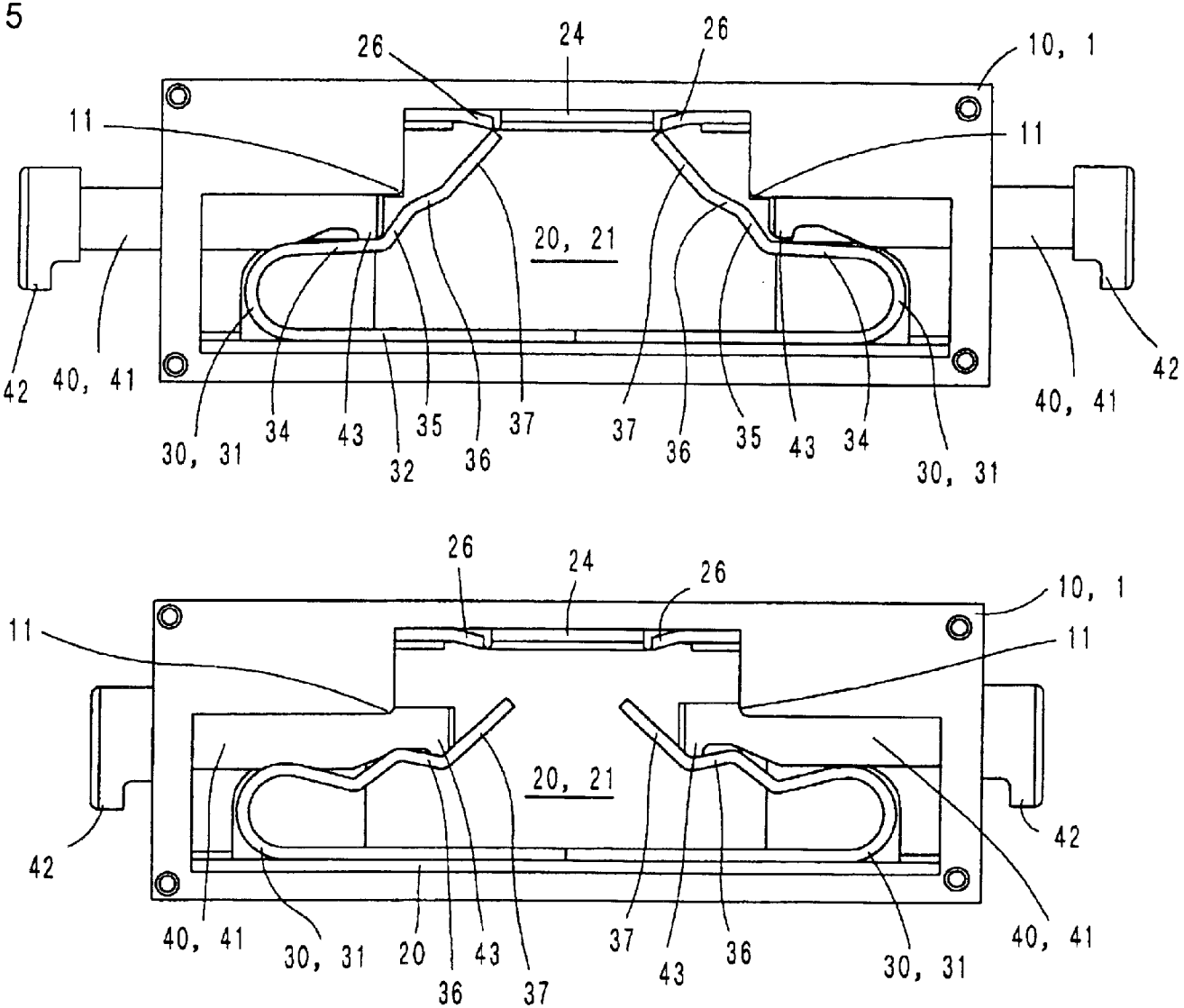
Figure 16:
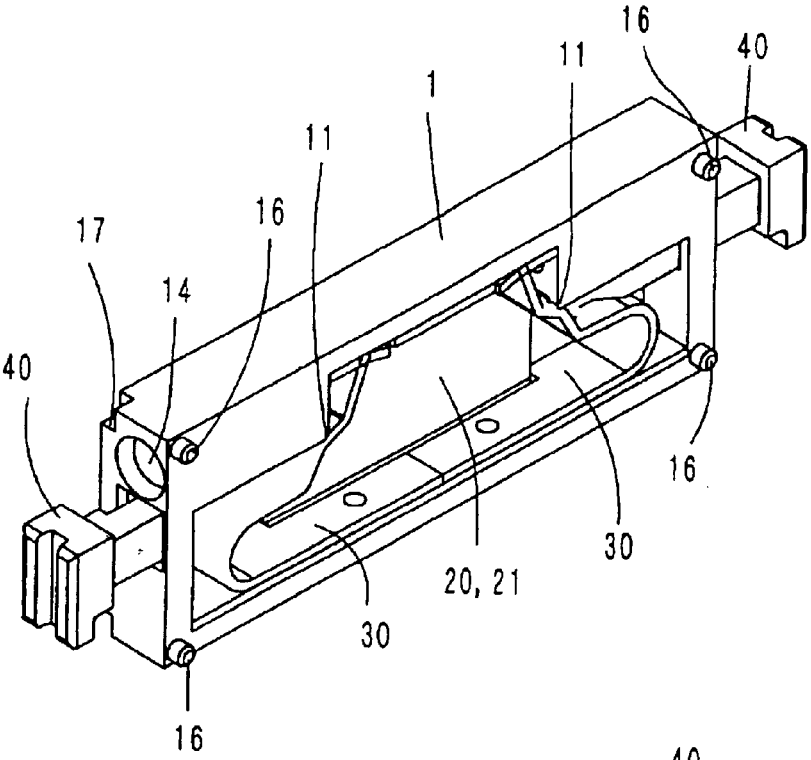
Figure 16:
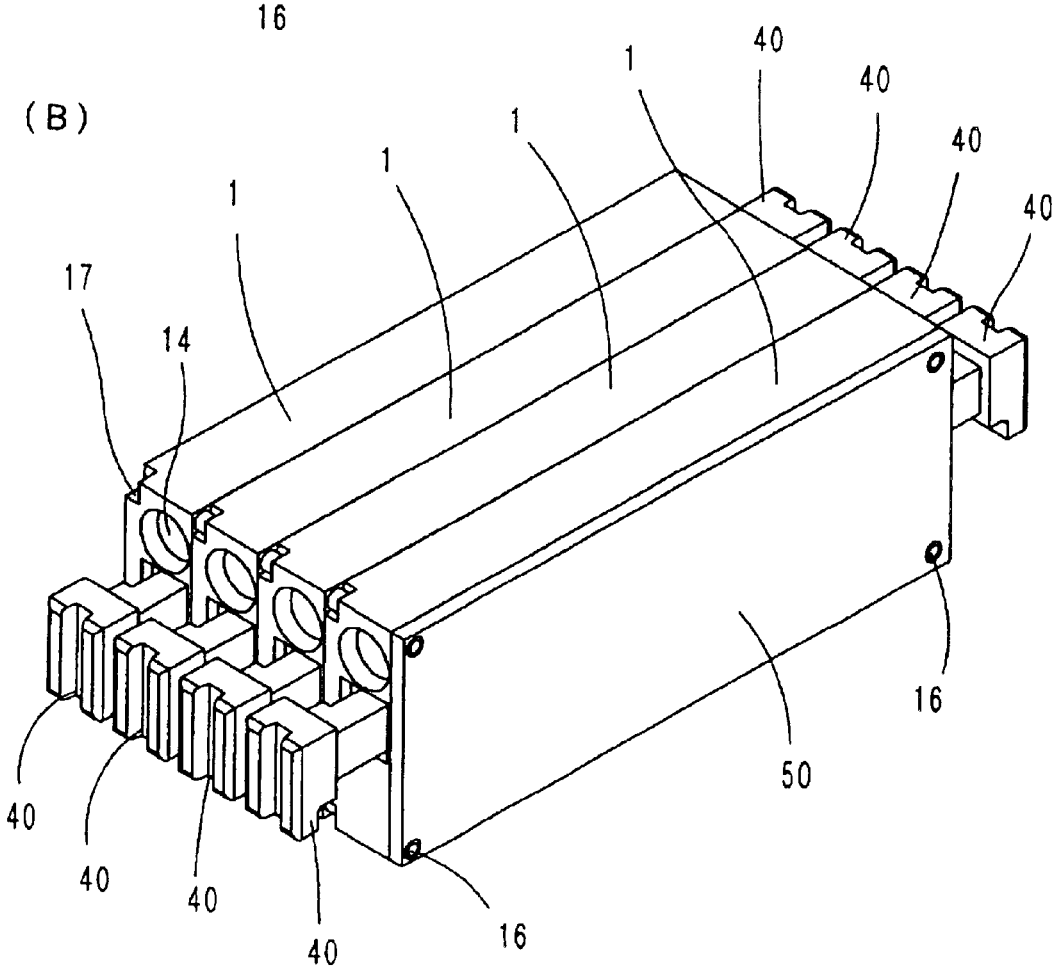
Figure 17:
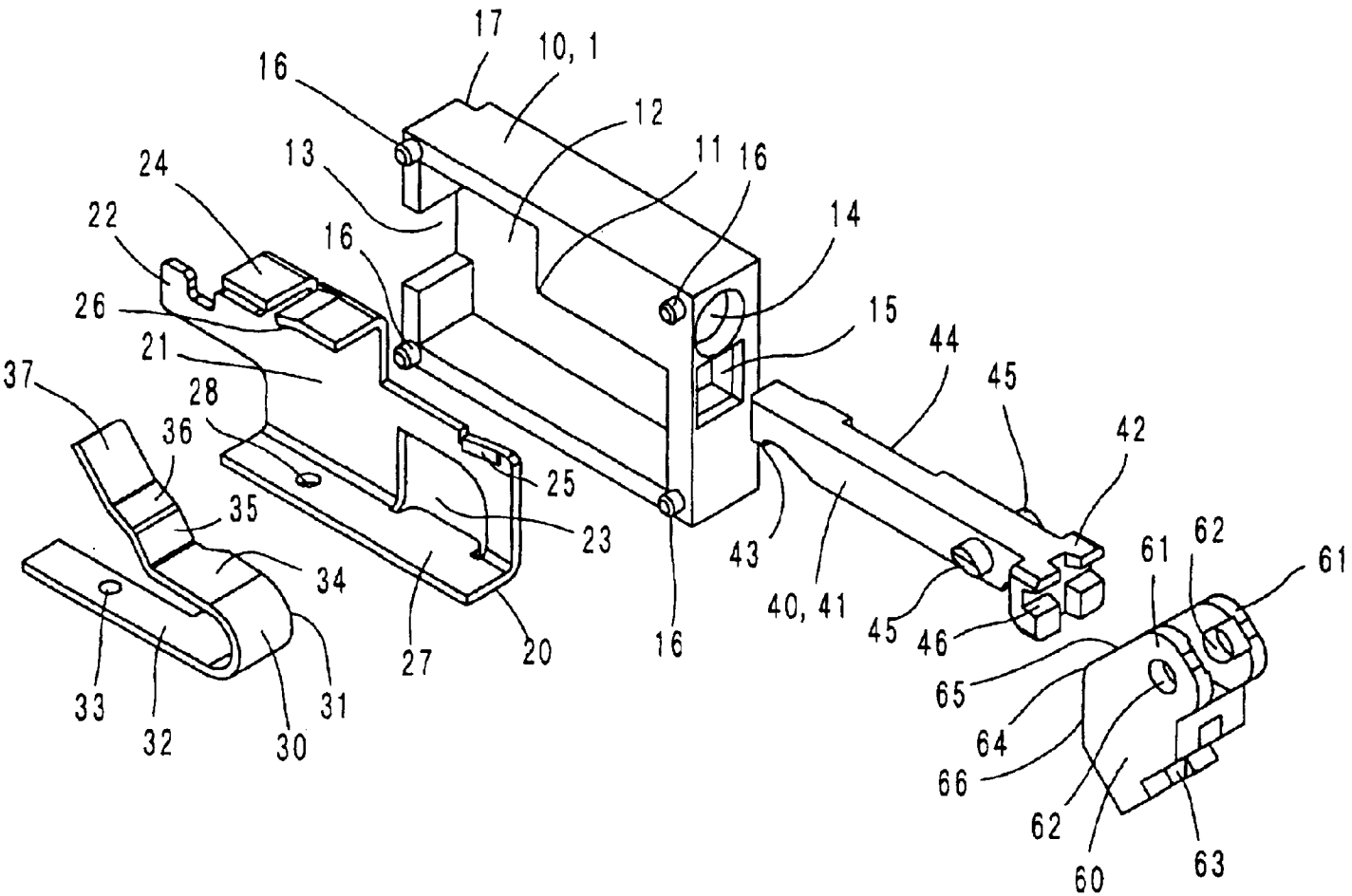
FIG. 17 is an exploded perspective view showing a connector for wire connection of the third embodiment of a wire connector according to the present invention.
Figure 18:
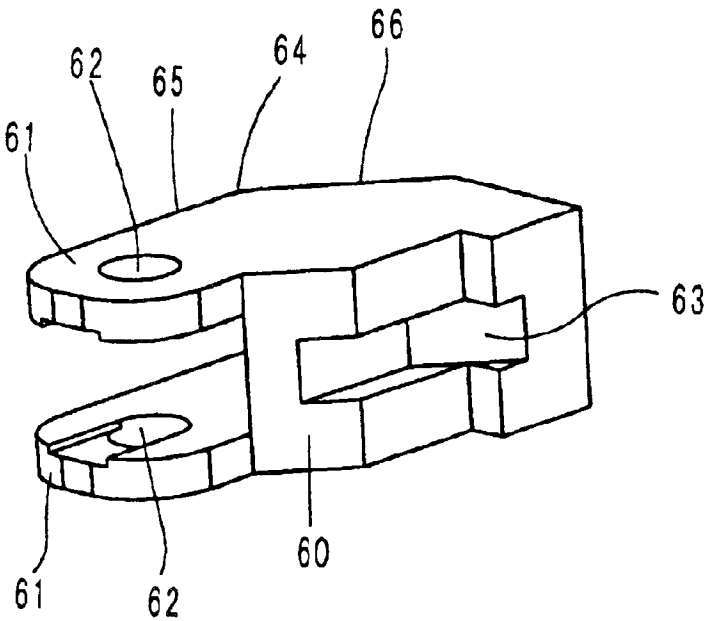
Figure 18:
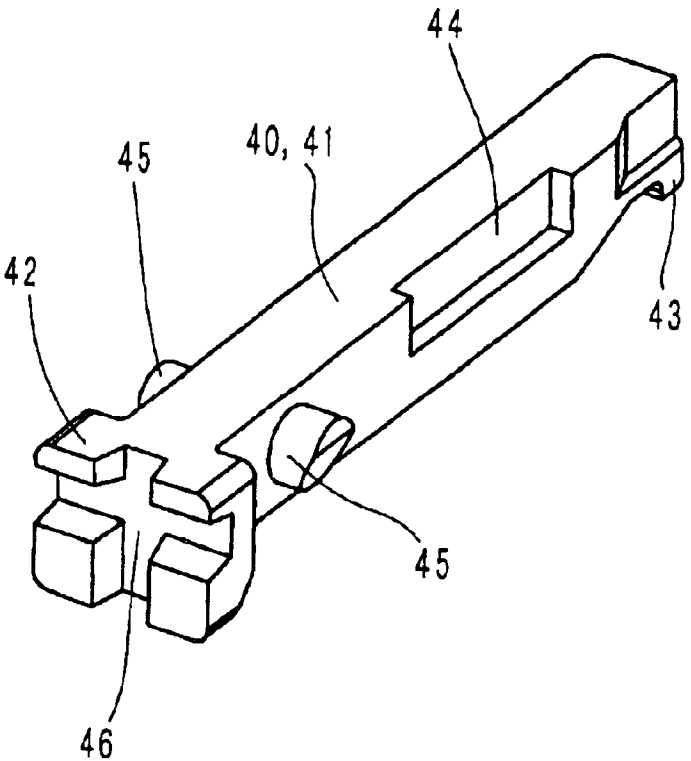
Figure 19:
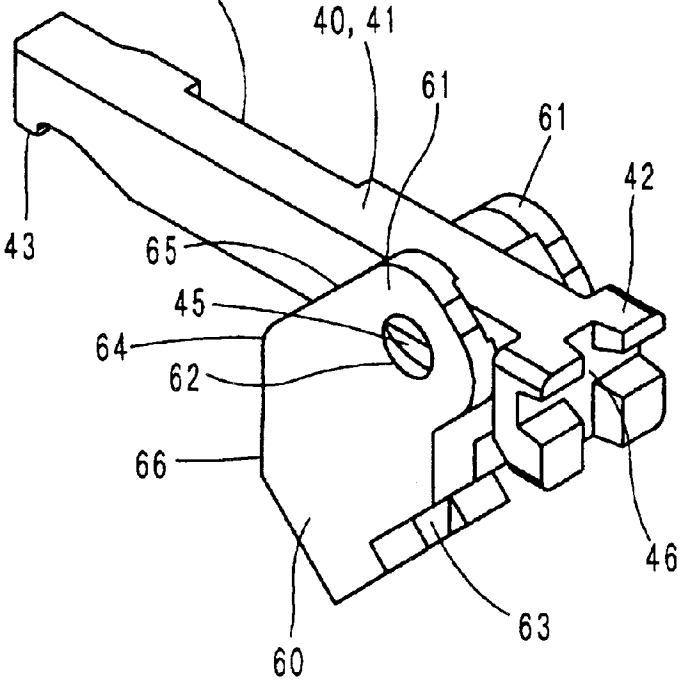
Figure 19:
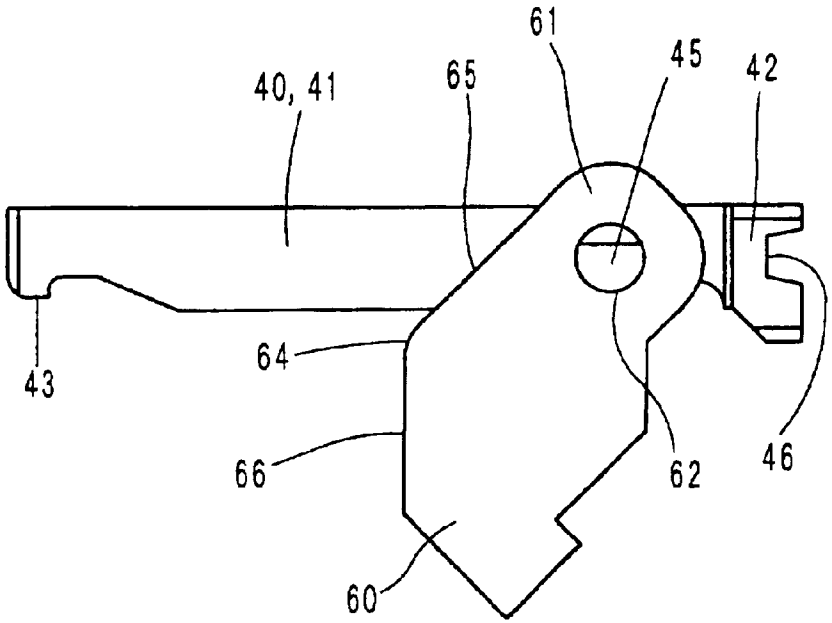
Figure 20:
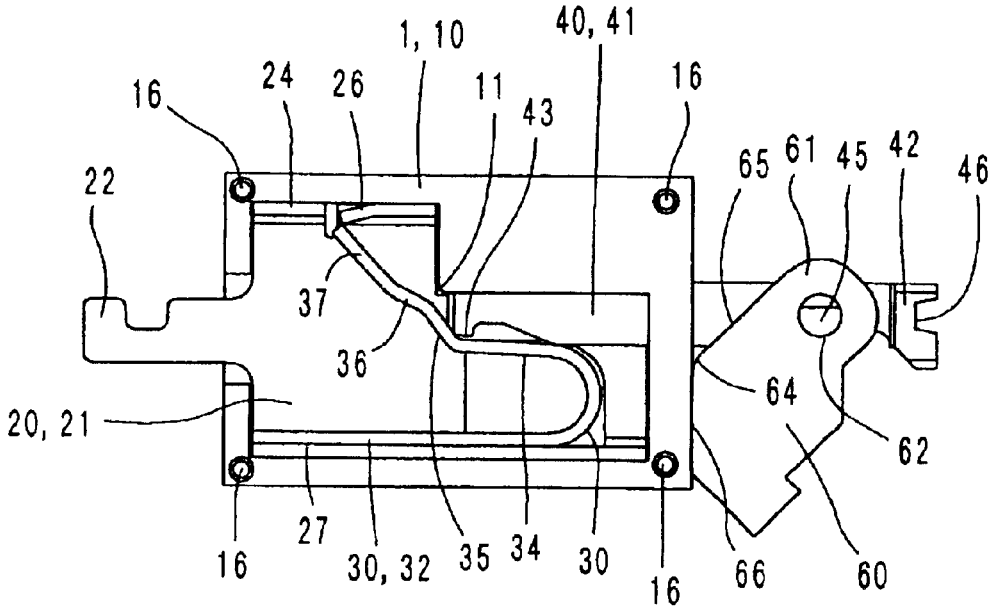
Figure 20:
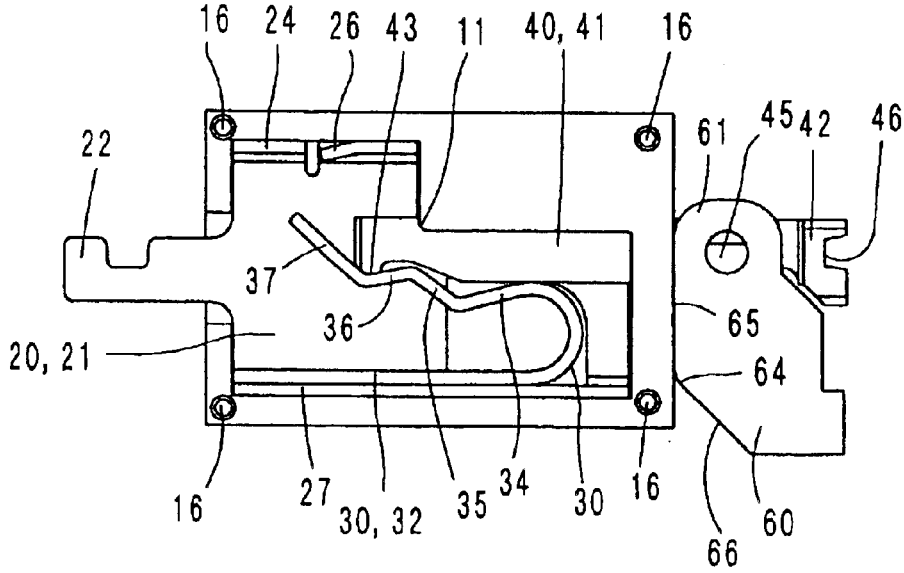
Figure 21:
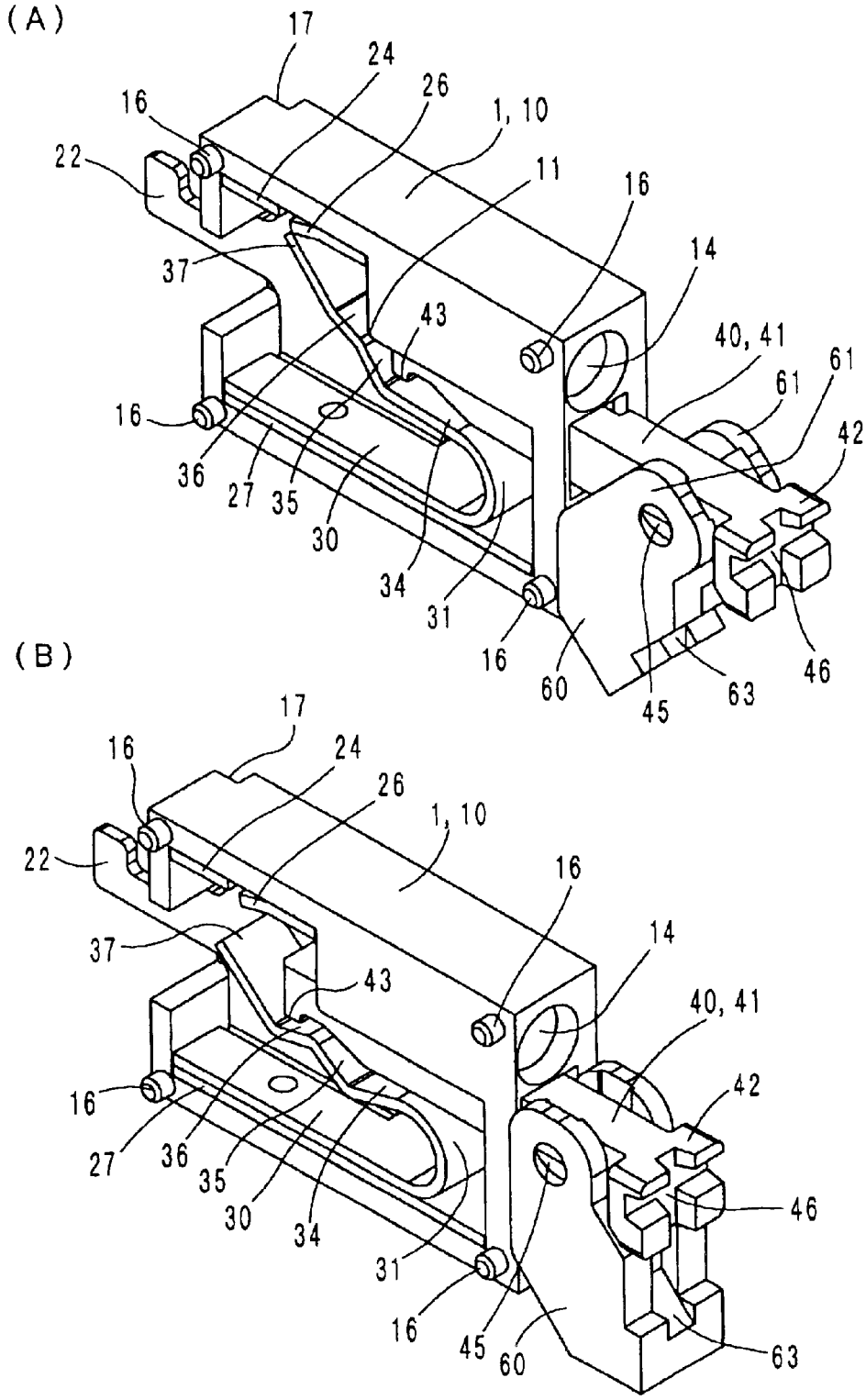
Figure 22:
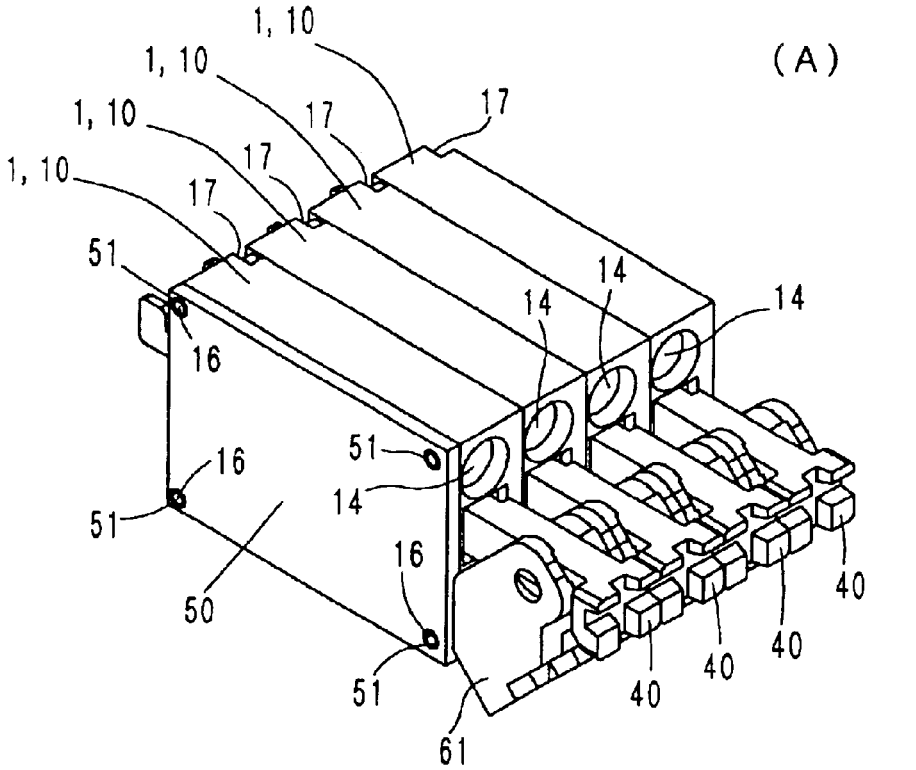
Figure 22:
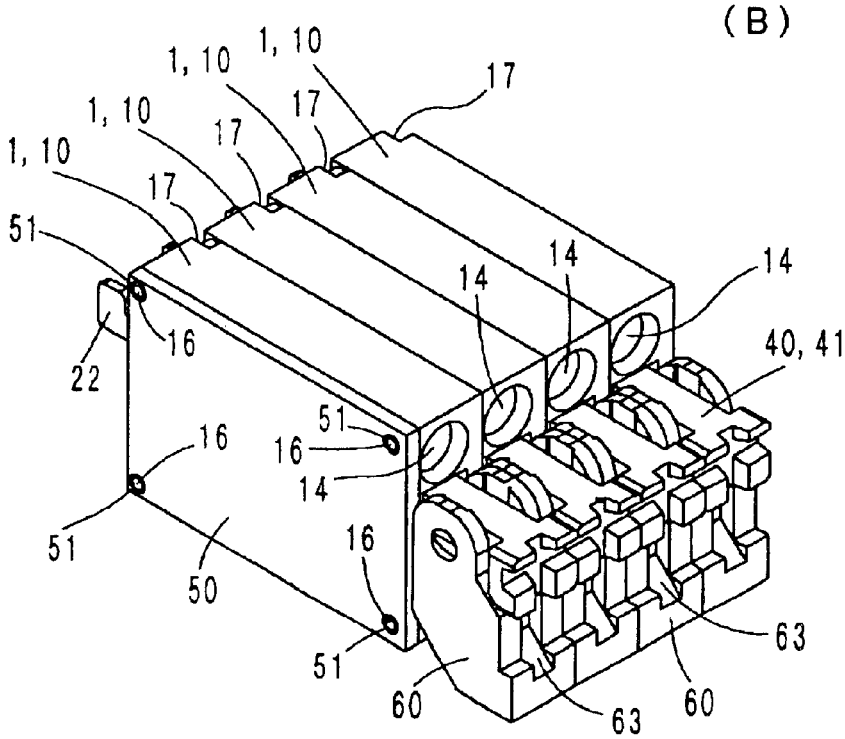

A connector 1 for wire connection according to the second embodiment of the present invention is, as shown in FIG. 14 to FIG. 16, applicable to a case in which two wires are connected substantially coaxially. Here, the connector 1 for wire connection according to this embodiment is substantially comprised of a casing 10, a conductive fitting 20, leaf springs 30, 30, and manipulation buttons 40, 40 and a cover 50.

The casing 10 is formed of a box having a rectangular parallelepiped shape and an inverse T-shaped recessed portion 12 is defined by forming a pair of position restricting corner portions 11, 11 in the inside thereof. In opposing both-side end faces, wire insertion holes 14 and a manipulation button insertion hole 15 are respectively formed coaxially. Further, with respect to the casing 10, while positioning projections 16 are projected from corner portions of an open-ended side front face thereof, recessed portions 17 into which the projections 16 can be fitted are formed at corner portions of the back face thereof.

Further, when necessary, push-insertion holes (not shown in the drawing) are respectively formed in the corner portions of the back face of the casing 10, wherein by inserting the projections 16 into the push-insertion holes under pressure, a plurality of casings 10 may be integrally joined.

The conductive fitting 20 includes a front-face portion 21 having a shape which allows the conductive fitting 20 to be fitted into the recessed portion 12 of the casing 10. A pair of fitting openings 23 are respectively formed in both sides of the front face portion 21. Further, with respect to an upper end peripheral portion of the front-face portion 21, an upper bent lug 24 is formed at a central peripheral portion and, at the same time, stopper pawls 25 are respectively formed at both side peripheral portions in an erected manner by cutting. On the above-mentioned upper bent lug 24, a pair of stopper projections 26, 26 which prevent the withdrawal of wires 2 described later are formed by projection machining. On the other hand, a lower bent lug 27 is formed on a lower end peripheral portion of the front face portion 21. A pair of positioning holes 28, 28 are formed in the lower bent lug 27.

The leaf springs 30 are formed by bending thereof in an approximately V shape and bent portions 31 thereof have a wide width and can be fitted into the fitting openings 23 of the conductive fitting 20. Further, on the bottom face portions 32 of the leaf springs 30, positioning projections 33 which are engaged with the positioning holes 28 of the conductive fitting 20 are formed by projection machining. Further, in a bridging portion 34 which is extended from the above-mentioned bent portion 31, a first bent portion 35, a second bent portion 36 and a pushing tongue portion 37 are sequentially formed.

Accordingly, when the positioning projections 33 of the leaf springs 30 are fitted into the positioning holes 28 of the lower bent lug 27, the pushing tongue portions 37 are brought into pressure contact with a lower face of the upper bent lug 24 due to the spring force of the leaf springs 30 and hence, both ends of the leaf springs 30 are brought into pressure contact with the conductive fitting 20 and held by the conductive fitting 20. Then, the conductive fitting 20 is assembled to the casing 10 such that the conductive fitting 20 is fitted into the recessed portion 12 of the above-mentioned casing 10.

The manipulation button 40 is constituted of a shaft portion 41 which can be inserted into the insertion hole 15 of the casing 10 and a head portion 42 which integrally formed on one end of the shaft portion 41 and defines an insertion position of the above-mentioned shaft portion 41.

The manipulation button 40 defines a manipulation portion 43 on a distal end of a lower face of the shaft portion 41 and a stepped portion 44 for preventing removal is formed on an upper end peripheral portion of an inwardly directed face in a sliding direction.

Accordingly, as shown in FIG. 15A, when the shaft portions 41 of the manipulation buttons 40 are pushed into the casing 10 through the insertion openings 15 of the casing 10, the stepped portions 44 are engaged with the stopper pawls 25 of the conductive fitting 20, and the shaft portions 41 are brought into contact with the first bent portions 35 after reaching the bridging portions 34 of the leaf spring 30. In this state, the removal of the manipulation buttons are prevented by the stopper pawls 25.

As shown in FIG. 15B, when the manipulation buttons 40 are further pushed into the casing 10, the manipulation portions 43 get over the first bent portions 35 and reach the second bent portions 36 against the spring force of the bent portions 31 and, at the same time, the head portions 42 are brought into contact with outer side faces of the casing 10 so that the positions of the manipulation buttons 40 are restricted. Accordingly, the pushing tongue portions 37 are pressed downwardly thus giving rise to gaps between the pushing tongue portions 37 and the upper bent lug 24 of the conductive fitting 20. Here, the manipulation portions 43 are pressed upwardly due to the spring force of leaf spring 30 and hence, upper faces of the shaft portions 41 are brought into contact with the corner portions 11 of the casing 10 and are locked thereto. Accordingly, there is no possibility that the manipulation buttons 40 are freely restored. When the manipulation buttons 40 are pulled back after inserting the wires (not shown in the drawing) into the casing 10 through the insertion hole 14 of the casing 10, the leaf springs 30 are restored due to the spring force thereof. Accordingly, the upper bent lug 24 of the conductive fitting 20 and the pushing tongue portions 37 of the leaf springs 27 clamp leads not shown in the drawing thus establishing an electric connection (FIG. 15A). Here, since the stepped portions 44 of the manipulation buttons 40 are stopped by the stopper pawls 25 of the conductive fitting 20, there is no possibility that the manipulation buttons 40 are removed.

Further, when four wires are connected to each other, for example, as shown in FIG. 16, the projections 16 of the casing 10 are fitted into the recessed portions 17 which are formed on the back face of other casing 1 so that four casings 10 are integrally joined. Here, by covering an open-ended face of the casing 10 with the cover 50, a terminal platform may be formed.

According to the second embodiment, since a pair of wires can be connected to each other approximately coaxially, it gives rise to an advantage that it is possible to provide the connection which differs from the connection of the first embodiment whereby the application of the wire connector is expanded.

The third embodiment is directed to a case in which the invention is applied to a connector 1 for wire connection which is, as shown in FIG. 17 to FIG. 22, substantially comprised of a casing 10, a conductive fitting 20, a leaf spring 30, a manipulation button 40, a cover 50 and a lever 60.

The casing 10 is a box having a rectangular parallelepiped shape and defines an approximately L-shaped recessed portion 12 by forming a position restricting corner portion 11 in the inside thereof. A notched portion 13 into which a terminal is fitted is formed in one of opposing side end faces, while a wire insertion hole 14 and a manipulation button insertion hole 15 are formed in the other opposing side end face. Further, with respect to the casing 10, positioning projections 16 are projected from corner portions of an open-side front face, while recessed portions 17 into which the projections 16 can be fitted are formed in corner portions of a back face.

The conductive fitting 20 includes a front face portion 21 having a shape which allows the conductive fitting 20 to be fitted into the recessed portion 12 of the casing 10.

A terminal 22 is extended in a sideward direction from a left end peripheral portion of the front face portion 21, while a fitting opening 23 is formed in a right half of one side of the conductive fitting 20. Further, with respect to an upper end peripheral portion of the front face portion 21, an upper bent lug 24 is formed on a left side peripheral portion, while a stopper pawl 25 is formed in an erected shape on a right side peripheral portion. On the above-mentioned upper bent lug 24, a stopper projection 26 which prevents the removal of a wire described later is formed. On the other hand, a lower bent lug 27 is formed on a lower end peripheral portion of the front face portion 21. A positioning hole 28 is formed in the lower bent lug 27.

A leaf spring 30 is bent in an approximately V shape, wherein a bent portion 31 has a large width and can be fitted into the fitting opening 23 of the conductive fitting 20. Then, a positioning projection 33 which is engaged with the positioning hole 28 of the conductive fitting 20 is formed in a bottom face portion 32 of the leaf spring 30 by projection machining. Further, in a bridging portion 34 extending from the bent portion 31, a first bent portion 35, a second bent portion 36 and a pushing tongue portion 37 are sequentially formed.

Accordingly, when the positioning projection 33 of the leaf spring 30 is fitted into the positioning hole 28 of the lower bent lug 27, the pushing tongue portion 37 is brought into pressure contact with a lower face of the upper bent lug 24 due to a spring force of the leaf spring 30 and hence, both ends of the leaf spring 30 are brought into pressure contact with the conductive fitting 20 and the conductive fitting 20 is held. Then, the above-mentioned conductive fitting 20 is assembled to the casing 10 such that the conductive fitting 20 is fitted into the recessed portion 12 of the casing 10.

The manipulation button 40 is constituted of a shaft portion 41 which can be inserted into the insertion hole 15 of the casing 10 and a head portion 42 which is integrally formed on one end of the shaft portion 41 and defines an insertion position of the above-mentioned shaft portion 41. The manipulation button 40 defines a manipulation portion 43 on a distal end of a lower face of the shaft portion 41 and a stepped portion 44 for preventing removal is formed on an upper end peripheral portion of an inwardly directed face in a sliding direction. Further, on the shaft portion 41, a pair of support projections 45, 45 which rotatably support the lever 60 described later on opposing faces in the vicinity of the head portion 42 are formed. Further, cruciform manipulation recessed portion 46 is formed in a distal end face of the head portion 42. Here, the shape of the manipulation recessed portion 46 is not limited to the above-mentioned shape and may be formed of a simple straight groove or a simple circular recessed portion.

Accordingly, when the shaft portion 41 of the manipulation button 40 is pushed into the casing 10 through the insertion opening 15 of the casing 10, the stepped portion 44 is engaged with the stopper pawl 25 of the conductive fitting 20, and the shaft portion 41 is brought into contact with the first bent portion 35 after reaching the bridging portion 34 of the leaf spring 30. In this state, since the stopper pawl 25 of the conductive fitting 20 is engaged with the stepped portion 44, the removal of the manipulation button 40 is prevented by the stopper pawl 25.

The cover 50 is, as shown in FIG. 22A and FIG. 22B, formed of a plate-like body having a planar shape capable of covering an open-ended face of the casing 10 and fitting holes 51 into which the positioning projections 16 of the casing 10 can be inserted are formed in corner portions of the cover 50.

The lever 60 is, as shown in FIG. 18A, FIG. 19A and FIG. 19B, a member for pulling up the above-mentioned manipulation button. Shaft holes 62 which allow the engagement of support projections 45 of the manipulation button 40 therewith are formed in a pair of extending arm portions 61, 61. Accordingly, by engaging the shaft holes 62 of the lever 60 with the support projections 45, 45 of the above-mentioned manipulation button 40, the lever 60 is rotatably supported. Further, The lever 60 includes a manipulation groove 63 extending from base portions of the arms 61 and arranges rotatable fulcrums 64 on surfaces of the arms 61 opposed to the manipulating groove 63. At both sides of the rotatable fulcrums 64, position restricting tapered faces 65, 66 are formed at given angles.

Subsequently, the manner of using the above-mentioned connector 1 for wire connection is explained.

First of all, as shown in FIGS. 20A, 20B and FIGS. 21A, 21B, when the head portion 42 of the manipulation button 40 is pushed, the manipulation portion 43 gets over the first bent portion 35 and reaches the second bent portion 36 against the spring force of the bent portion 31 of the leaf spring 30. On the other hand, the lever 60 is rotated using the projections 45 as fulcrums and the tapered faces 65 are brought into pressure contact with outer faces of the casing 10 so as to position and restrict the manipulation button 40. Accordingly, the pushing tongue portion 37 is pressed downwardly thus giving rise to a gap between the pushing tongue portion 37 and the engaging projection 26 of the conductive fitting 20. Here, the manipulation portion 43 is pressed upwardly due to the spring force of the leaf spring 30 and hence, an upper face of the shaft portion 41 is brought into pressure contact with the corner portion 11 of the casing 10 and is locked thereto (FIG. 20B). Accordingly, there is no possibility that the manipulation button 40 is freely restored.

Subsequently, when a tool (not shown in the drawing) is positioned and pushed into the manipulation groove 63 of the lever 60 after inserting the wire not shown in the drawing into the casing 10 through the insertion hole 14 of the casing 10, due to a principle of lever, the lever 60 is rotated using the rotatable fulcrums 64 as a fulcrum. Accordingly, the manipulation button 40 is pulled upwardly and hence, the leaf spring 30 is restored due to the spring force thereof. As a result, the engaging projection 26 of the conductive fitting 20 and the pushing tongue portion 37 of the leaf spring 27 clamp the wire thus establishing an electric connection. Here, since the stepped portion 44 of the manipulation button 40 is stopped by the stopper pawl 25 of the conductive fitting 20, there is no possibility that the manipulation button 40 is removed.

Further, when four wires are connected to each other, for example, as shown in FIG. 22A and FIG. 22B, the projections 16 of the casing 10 are fitted into the recessed portions 17 which are formed on the back face of other casing 1 so that four casings 10 are integrally joined. Here, by covering an open-ended face of the casing 10 with a cover 50, a terminal platform may be formed. For facilitating the understanding of explanation, the wires are not shown in the drawings.

Figure 23:
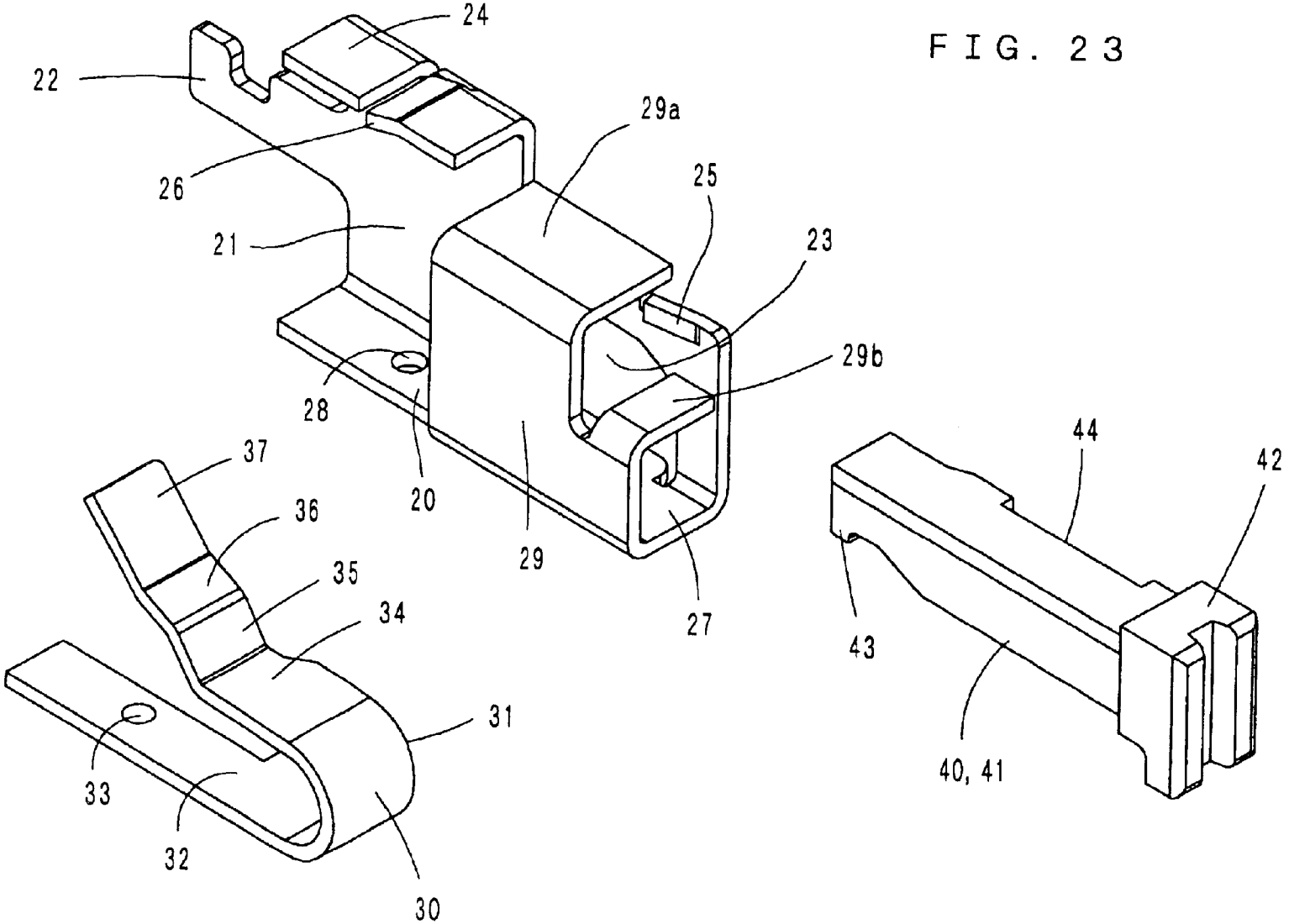
FIG. 23 is an exploded perspective view showing a connector for wire connection which constitutes the fourth embodiment of a wire connector according to the present invention.
Figure 24:
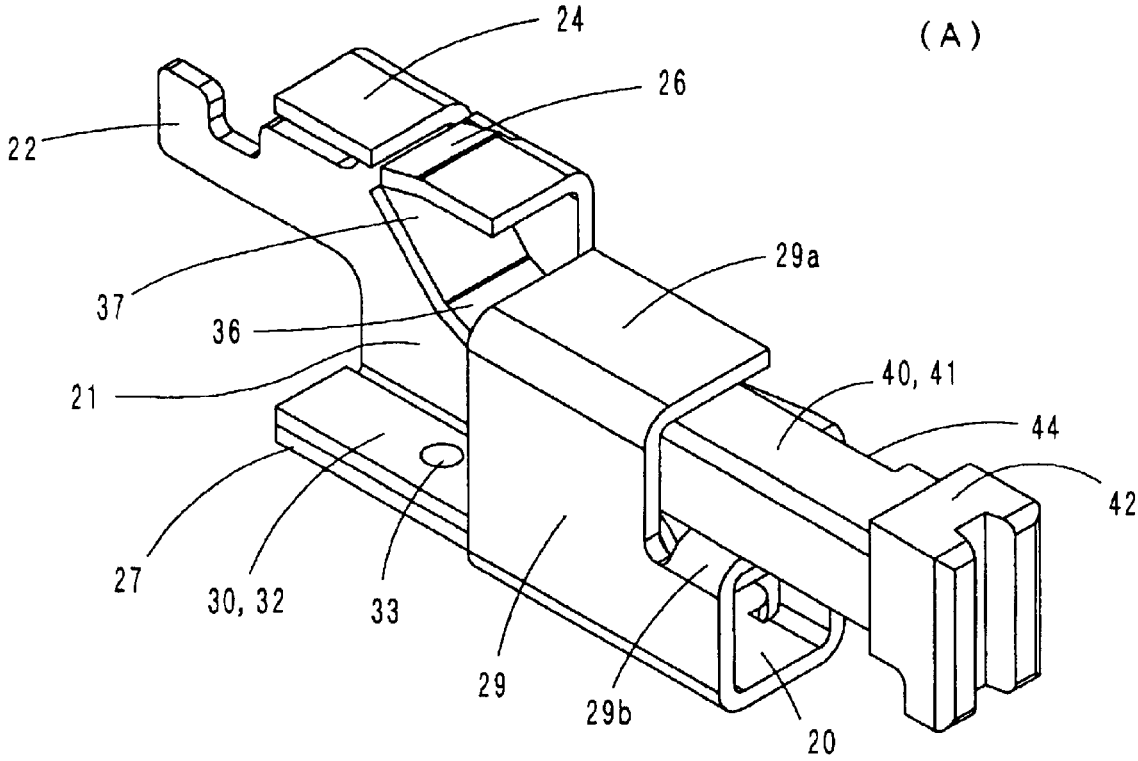
Figure 24:
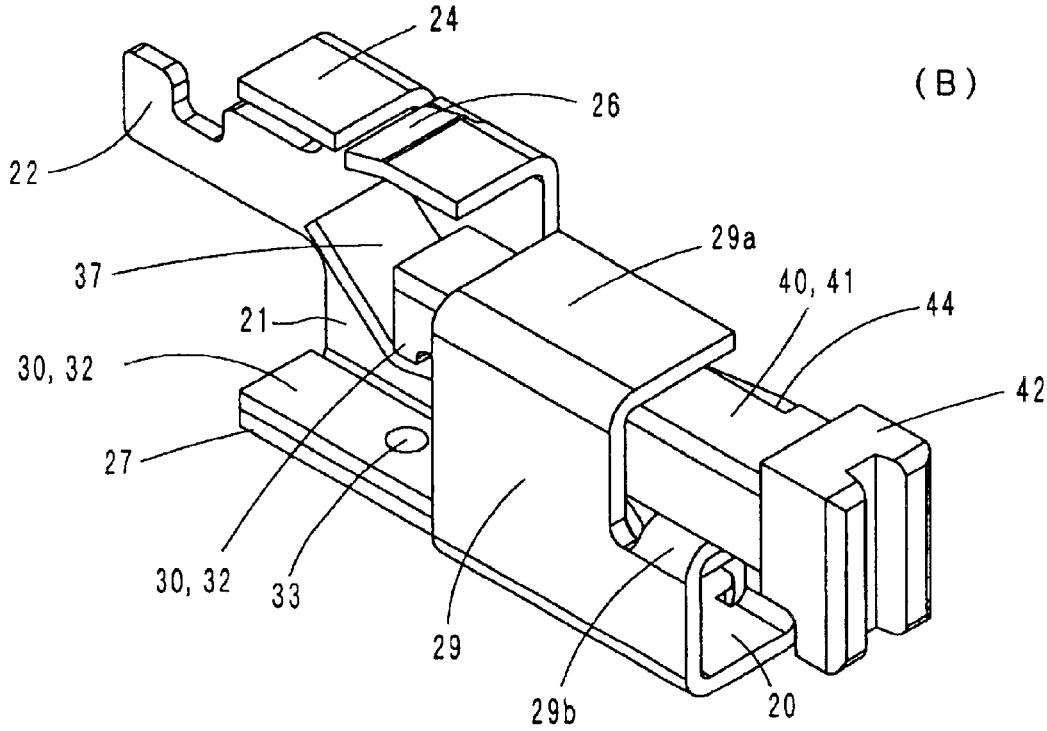
Figure 25:
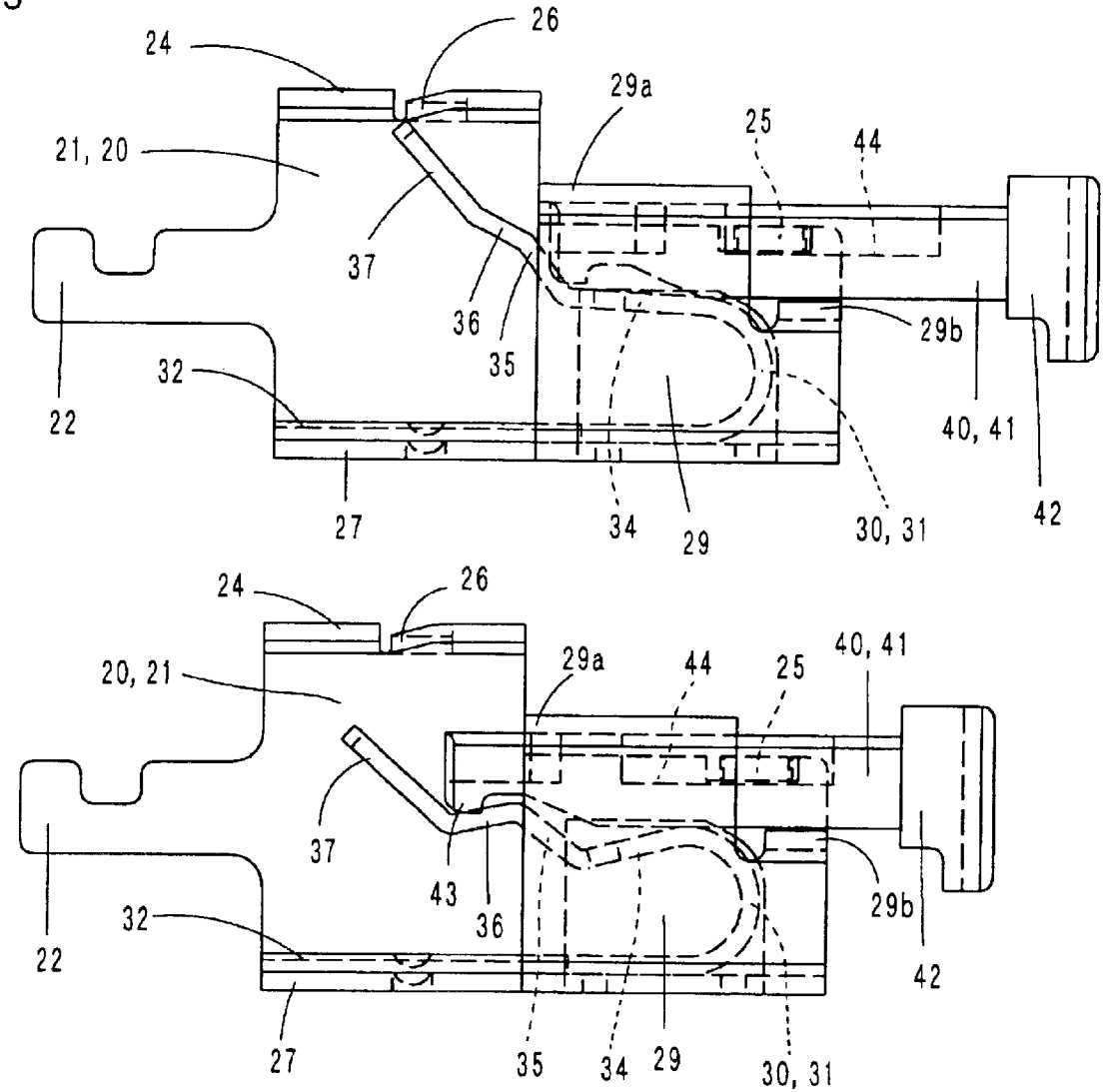
Figure 26:
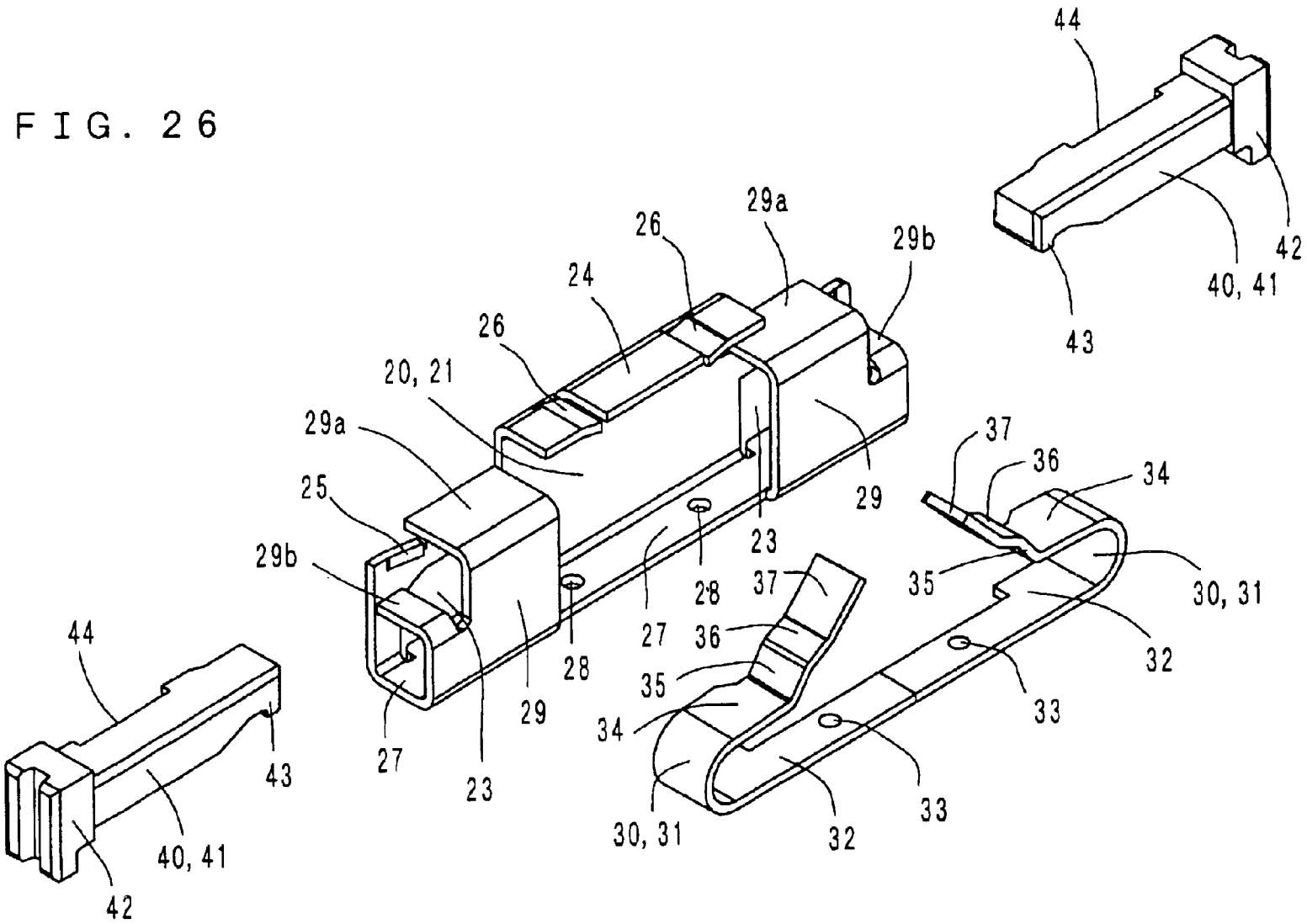
FIG. 26 is an exploded perspective view showing a connector for wire connection of the fifth embodiment of the wire connector according to the present invention.
Figure 27:
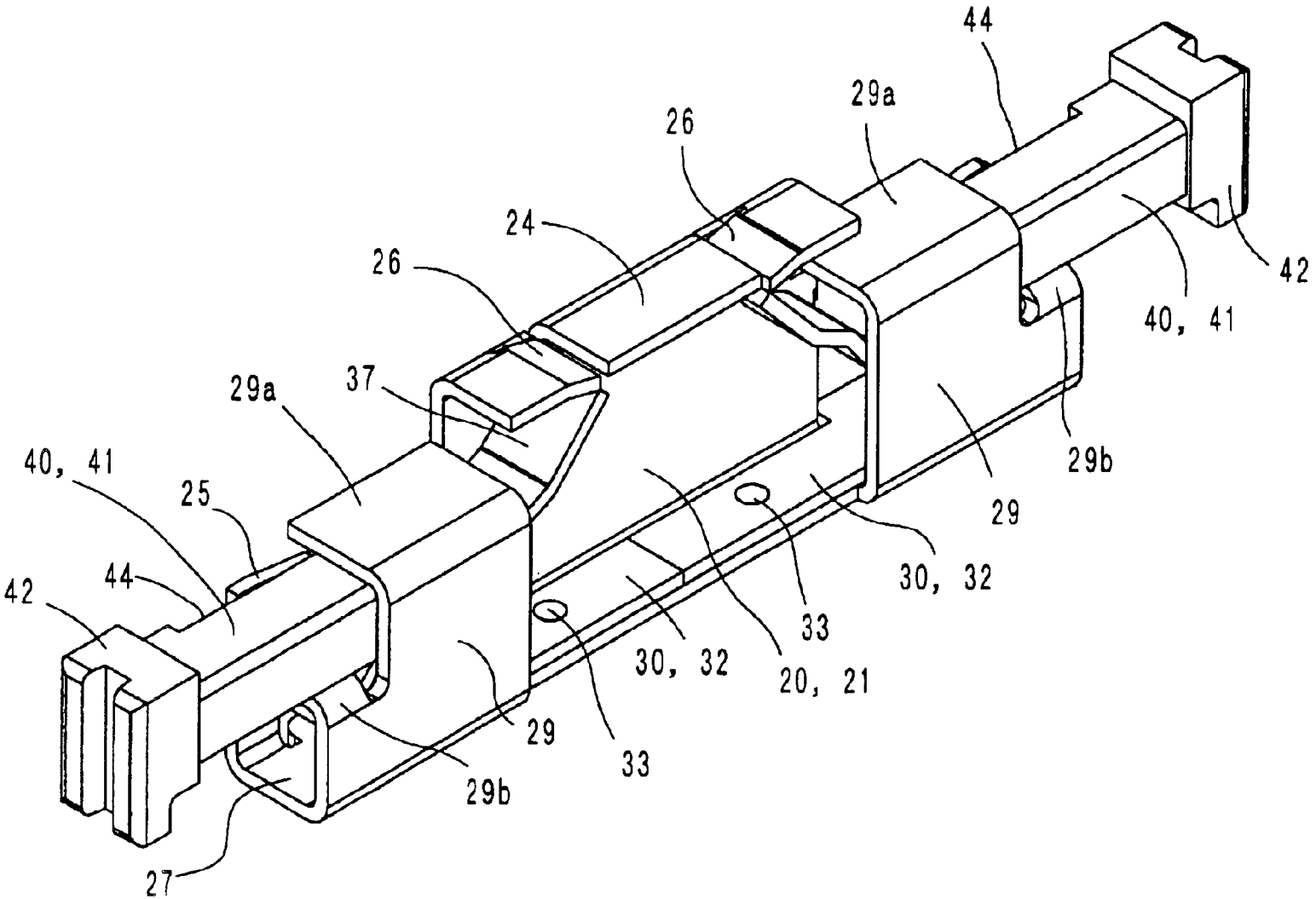
FIG. 27 is a perspective view before performing the operation of the connector for wire connection shown in FIG. 26.
Figure 28:
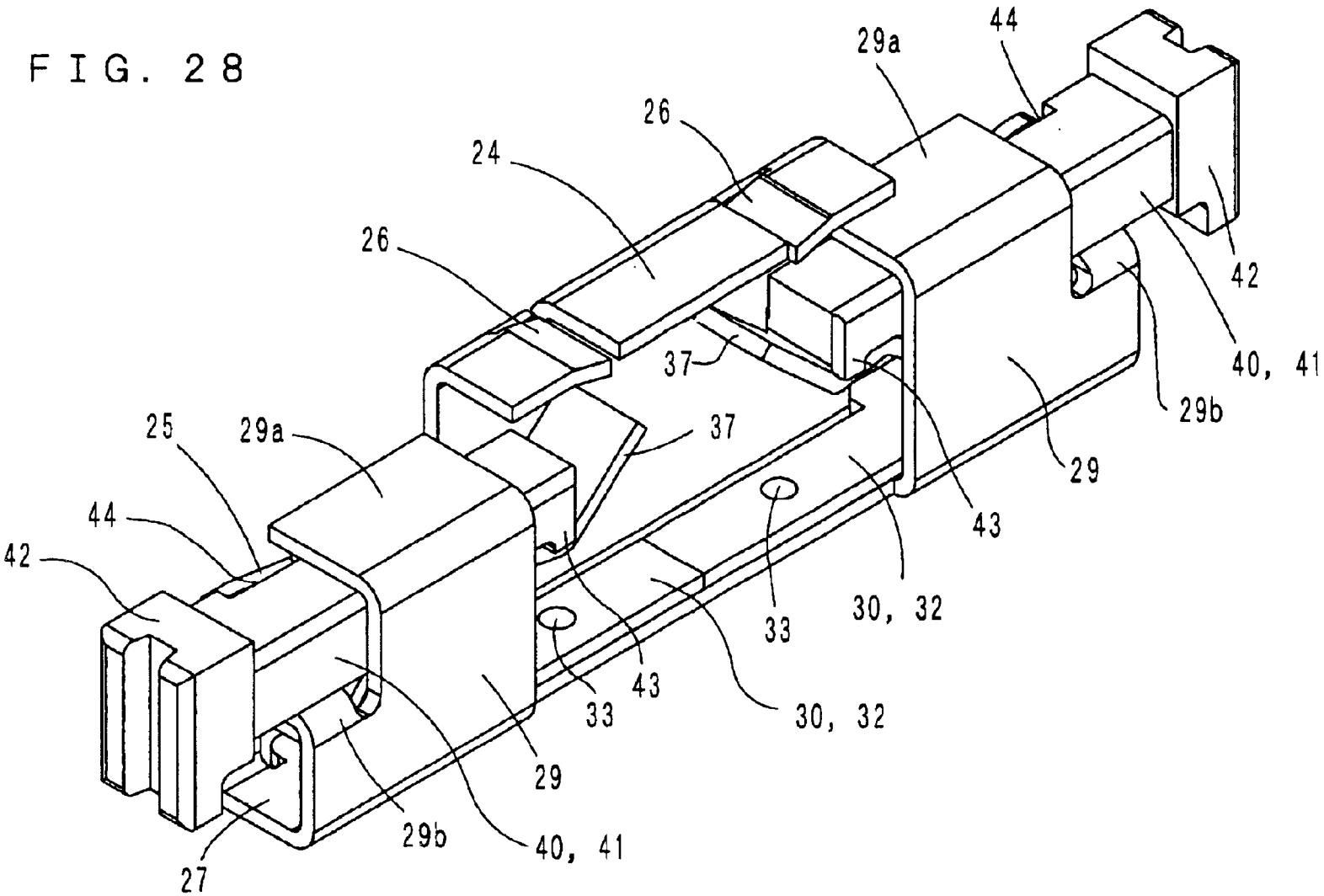
FIG. 28 is a perspective view after performing the operation of the connector for wire connection shown in FIG. 26.

A connector 1 for wire connection according to the fourth embodiment of the present invention is directed to a case in which, as shown in FIG. 23 to FIG. 25, a manipulation button 40 is supported only by a conductive fitting 20.

That is, the connector 1 for wire connection according to this embodiment is substantially comprised of a casing not shown in the drawing, the conductive fitting 20, a leaf spring 30, a manipulation button 40 and a cover not shown in the drawing.

The conductive fitting 20 includes a front face portion 21 having a shape which allows the conductive fitting 20 to be fitted into a recessed portion of the casing not shown in the drawing. A fitting opening 23 is formed in a right side of the front face portion 21. Further, with respect to an upper end peripheral portion of the front face portion 21, an upper bent lug 24 is formed on a left side peripheral portion, while a stopper pawl 25 is formed in an erected shape on both side peripheral portions. On the above-mentioned upper bent lug 24, a stopper projection 26 which prevents the removal of a wire not shown in the drawings is formed by projection machining. On the other hand, a lower bent lug 27 is formed on a lower end peripheral portion of the front face portion 21. A positioning hole 28 is formed in the lower bent lug 27. An erected lug 29 is formed on a right side peripheral portion of the lower bent lug 7 and position restricting tongues 29*a*, 29*b* which differ in height are respectively extended in the horizontal direction from an upper end peripheral portion of the erected lug 29.

The leaf spring 30 is bent in an approximately V shape, wherein a bent portion 31 thereof has a large width and can be fitted into the fitting opening 23 of the conductive fitting 20. Then, a positioning projection 33 which is engaged with the positioning hole 28 of the conductive fitting 20 is formed in a bottom face portion 32 of the leaf spring 30 by projection machining. Further, in a bridging portion 34 extending from the bent portion 31, a first bent portion 35, a second bent portion 36 and a pushing tongue portion 37 are sequentially formed.

Accordingly, when the positioning projection 33 of the leaf spring 30 is fitted into the positioning hole 28 of the lower bent lug 27, the pushing tongue portion 37 is brought into pressure contact with a lower face of the upper bent lug 24 due to a spring force of the leaf spring 30 and hence, both ends of the leaf spring 30 are brought into pressure contact with the conductive fitting 20 and are held by the conductive fitting 20. Then, the above-mentioned conductive fitting 20 is assembled to the casing not shown in the drawing such that the conductive fitting 20 is fitted into a recessed portion of the casing.

The manipulation button 40 is constituted of a shaft portion 41 which can be inserted into the insertion hole 15 of the above-mentioned casing 10 and a head portion 42 which is integrally formed on one end of the shaft portion 41 and defines an insertion position of the above-mentioned shaft portion 41. The manipulation button 40 defines a manipulation portion 43 on a distal end of a lower face of the shaft portion 41 and a stepped portion 44 for preventing removal is formed on an upper end peripheral portion of an inwardly directed face in a sliding direction.

Accordingly, when the shaft portion 41 of the manipulation button 40 is pushed into the casing through a space defined between the above-mentioned position restricting tongues 29*a*, 29*b*, the stepped portion 44 is engaged with the stopper pawl 25 of the conductive fitting 20 and, at the same time, the shaft portion 41 is brought into contact with the first bent portion 35 after reaching the bridging portion 34 of the leaf spring 30. In this state, the removal of the manipulation button 40 is prevented by the stopper pawl 25 (25A).

Further, as shown in FIG. 25B, when the manipulation button 40 is pushed into the casing, the manipulation portion 43 gets over the first bent portion 35 and reaches the second bent portion 36 against the spring force of the bent portion 31 and, at the same time, the head portion 42 is brought into contact with an outer face of the casing 10 and the position thereof is restricted. Accordingly, the pushing tongue portion 37 is pressed downwardly thus giving rise to a gap between the pushing tongue portion 37 and the upper bent lug 24 of the conductive fitting 20. Here, the manipulation portion 43 is pressed upwardly due to the spring force of the leaf spring 30 and hence, an upper face of the shaft portion 41 is brought into pressure contact with the peripheral portion of the position restricting tongue 29*a* and is locked thereto. Accordingly, there is no possibility that the manipulation button 40 is freely restored. Subsequently, when the manipulation button 40 is retracted after inserting a wire not shown in the drawing between the stopper projection 26 and the pushing tongue portion 37, the leaf spring 30 is restored due to the spring force thereof. As a result, the upper bent lug 24 of the conductive fitting 20 and the pushing tongue portion 37 of the leaf spring 27 clamp the wire not shown in the drawing thus establishing an electric connection. Here, since the stepped portion 44 of the manipulation button 40 is engaged with the stopper pawl 25 of the conductive fitting 20, there is no possibility that the manipulation button 40 is removed.

According to the fourth embodiment, since the manipulation button 40 is supported only by the conductive fitting 20, a shape of the casing can be simplified and, at the same time, the selection of material of the casing is facilitated, and the degree of freedom in designing is increased. Still further, since the positional relationship between both of the metal-made conductive fitting and the manipulation button is determined by the conductive fitting and the manipulation button, it is possible to obtain an advantage that the mounting accuracy can be enhanced.

The fifth embodiment of the present invention is, as shown in FIG. 26 to FIG. 30, directed to a connector for wire connection which is applicable to a case in which two wires are connected substantially coaxially. Here, manipulation buttons 40 are supported only by a conductive fitting 20.

That is, the connector for wire connection according to this embodiment is substantially comprised of a casing not shown in the drawings, the conductive fitting 20, a pair of leaf springs 30, 30, a pair of manipulation buttons 40, 40 and a cover not shown in the drawings.

The conductive fitting 20 includes a front-face portion 21 having a shape which allows the conductive fitting 20 to be fitted into the recessed portion of the casing not shown in the drawings. A pair of fitting openings 23 are respectively formed in both sides of the front face portion 21. Further, with respect to an upper end peripheral portion of the front-face portion 21, an upper bent lug 24 is formed at a central peripheral portion and, at the same time, stopper pawls 25 are respectively formed at both side peripheral portions in an erected manner by cutting. On the above-mentioned upper bent lug 24, a pair of stopper projections 26, 26 which prevent the withdrawal of wires not shown in the drawings are formed by projection machining. On the other hand, a lower bent lug 27 is formed on a lower end peripheral portion of the front face portion 21. Positioning holes 28, 28 are formed in the lower bent lug 27. Erecting lugs 29 are formed on both side peripheral portions of the lower bent lug 7 and position restricting tongue lugs 29*a*, 29*b* which differ in height respectively extend in the horizontal direction from the upper end peripheral portions of the erecting lugs.

The leaf springs 30 are formed by bending thereof in an approximately V shape and bent portions 31 thereof have a wide width and can be fitted into the fitting openings 23 of the conductive fitting 20. Further, on the bottom face portions 32 of the leaf spring 30, positioning projections 33 which are engaged with the positioning holes 28 of the conductive fitting 20 are formed by projection machining. Further, in a bridging portion 34 which is extended from the above-mentioned bent portion 31, a first bent portion 35, a second bent portion 36 and a pushing tongue portion 37 are sequentially formed.

Accordingly, when the positioning projections 33 of the leaf springs 30 are fitted into the positioning holes 28 of the lower bent lug 27, the pushing tongue portions 37 are brought into pressure contact with a lower face of the upper bent lug 24 due to the spring force of the leaf spring 30 and hence, both ends of the leaf springs 30 are brought into pressure contact with the conductive fitting 20 and held by the conductive fitting 20. Then, the conductive fitting 20 is assembled to the casing not shown in the drawings such that the conductive fitting 20 is fitted into the recessed portion of the above-mentioned casing.

The manipulation button 40 is constituted of a shaft portion 41 which can be inserted into the insertion hole 15 of the casing 10 and a head portion 42 which is integrally formed on one end of the shaft portion 41 and defines an insertion position of the above-mentioned shaft portion 41. The manipulation button 40 defines a manipulation portion 43 on a distal end of a lower face of the shaft portion 41 and a stepped portion 44 for preventing removal is formed on an upper end peripheral portion of an inwardly directed face in a sliding direction.

Figure 29:
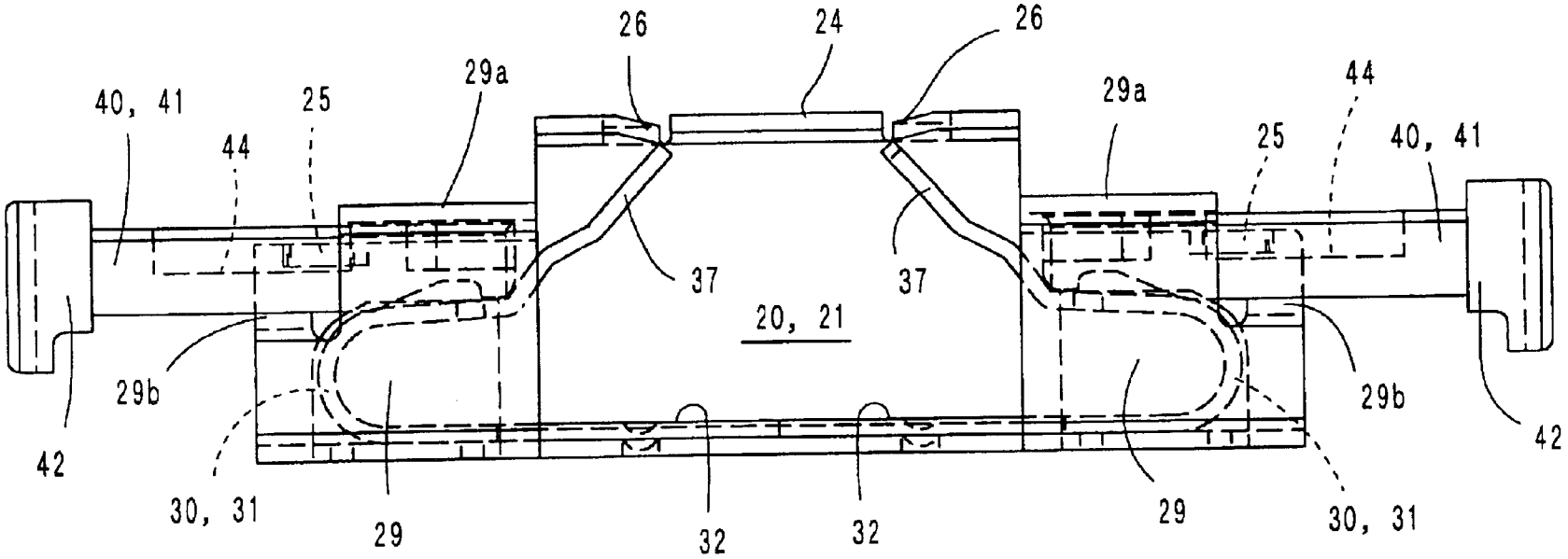
FIG. 29 is a front view before performing the operation of the connector for wire connection shown in FIG. 26.

Accordingly, when the shaft portions 41 of the manipulation buttons 40 are pushed into spaces defined between the position restricting tongues 29*a*, 29*b*, the stepped portions 44 are engaged with the stopper pawls 25 of the conductive fitting 20, and the shaft portions 41 are brought into contact with the first bent portions 35 after reaching the bridging portions 34 of the leaf springs 30. In this state, the removal of the manipulation buttons 40 are prevented by the stopper pawls 25 (FIG. 29).

Figure 30:
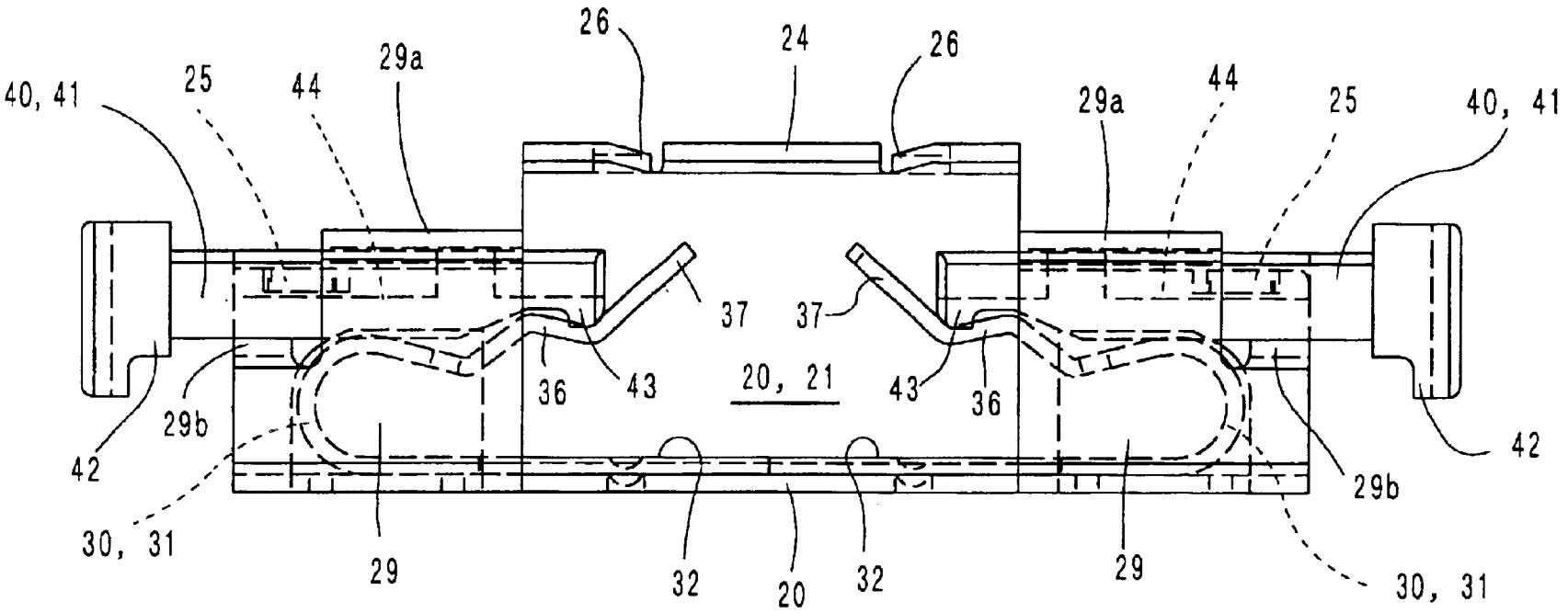
FIG. 30 is a front view after performing the operation of the connector for wire connection shown in FIG. 26.
Figure 31:
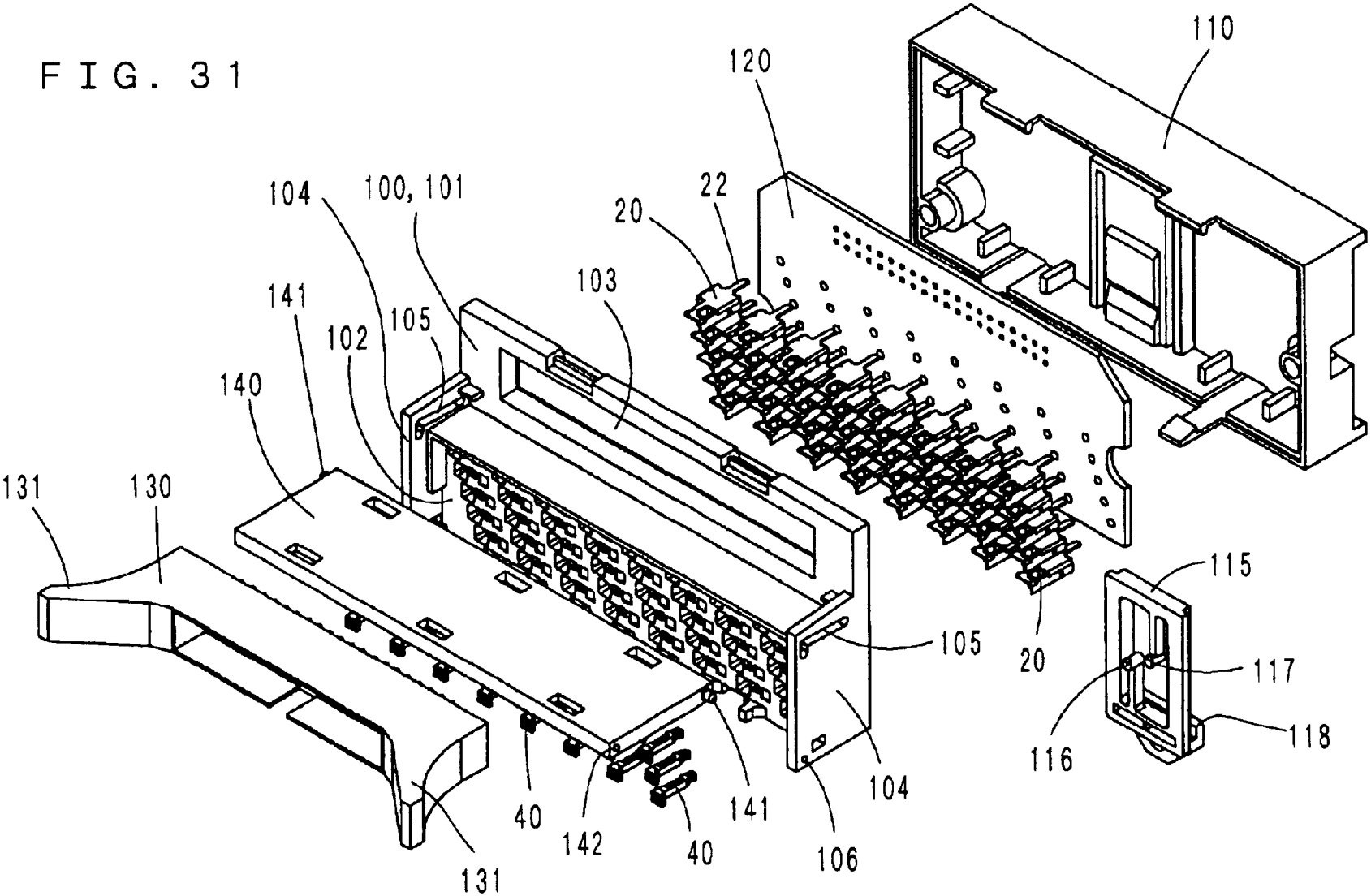
FIG. 31 is an exploded perspective view showing a relay terminal which constitutes the sixth embodiment of a wire connector according to the present invention.

Further, as shown in FIG. 30, when the manipulation buttons 40 are pushed into the casing 10, the manipulation portions 43 get over the first bent portions 35 and reach the second bent portions 36 against the spring force of the bent portions 31 and, at the same time, the head portions 42 are brought into contact with outer side faces of the casing 10 so that the positions of the manipulation buttons 40 are restricted. Accordingly, the pushing tongue portions 37 are pressed downwardly thus giving rise to gaps between the pushing tongue portions 37 and the upper bent lug 24 of the conductive fitting 20. Here, the manipulation portions 43 are pressed upwardly due to the spring force of the leaf springs 30 and hence, upper faces of the shaft portions 41 are brought into pressure contact with the peripheral portions of the position restricting tongue 29*a* and are locked thereto. Accordingly, there is no possibility that the manipulation buttons 40 are freely restored. When the manipulation buttons 40 are pulled back after inserting the wires not shown in the drawing between the stopper projections 26 and the pushing tongue portions 37, the leaf springs 30 are restored due to the spring force thereof. Accordingly, the upper bent lug 24 of the conductive fitting 20 and the pushing tongue portions 37 of the leaf spring 27 clamp leads not shown in the drawing thus establishing an electric connection. Here, since the stepped portions 44 of the manipulation buttons 40 are engaged with the stopper pawls 25 of the conductive fitting 20, there is no possibility that the manipulation buttons 40 are removed.

Further, according to the fifth embodiment, since a pair of wires can be connected substantially coaxially, it is possible to take the connection mode different from the connection mode of the fourth embodiment and hence, the application of the wire connector is expanded. Still further, according to the fifth embodiment, since the manipulation buttons 40 are supported only by the conductive fitting 20, a shape of the casing can be simplified and, at the same time, the selection of material of the casing is facilitated, and the degree of freedom in designing is increased. Still further, since the positional relationship between both of the metal-made conductive fitting and the manipulation buttons is determined by the conductive fitting and the manipulation buttons, it is possible to obtain an advantage that the assembling accuracy can be enhanced.

The sixth embodiment of the wire connector according to the present invention is, as shown in FIG. 31 to FIG. 44, directed to a case in which the present invention is applied to a relay terminal which incorporates a large number of sets of connections units in a housing 100, wherein each connection unit is comprised of a conductive fitting 20, a leaf spring 30 and a manipulation button 40.

Figure 36:
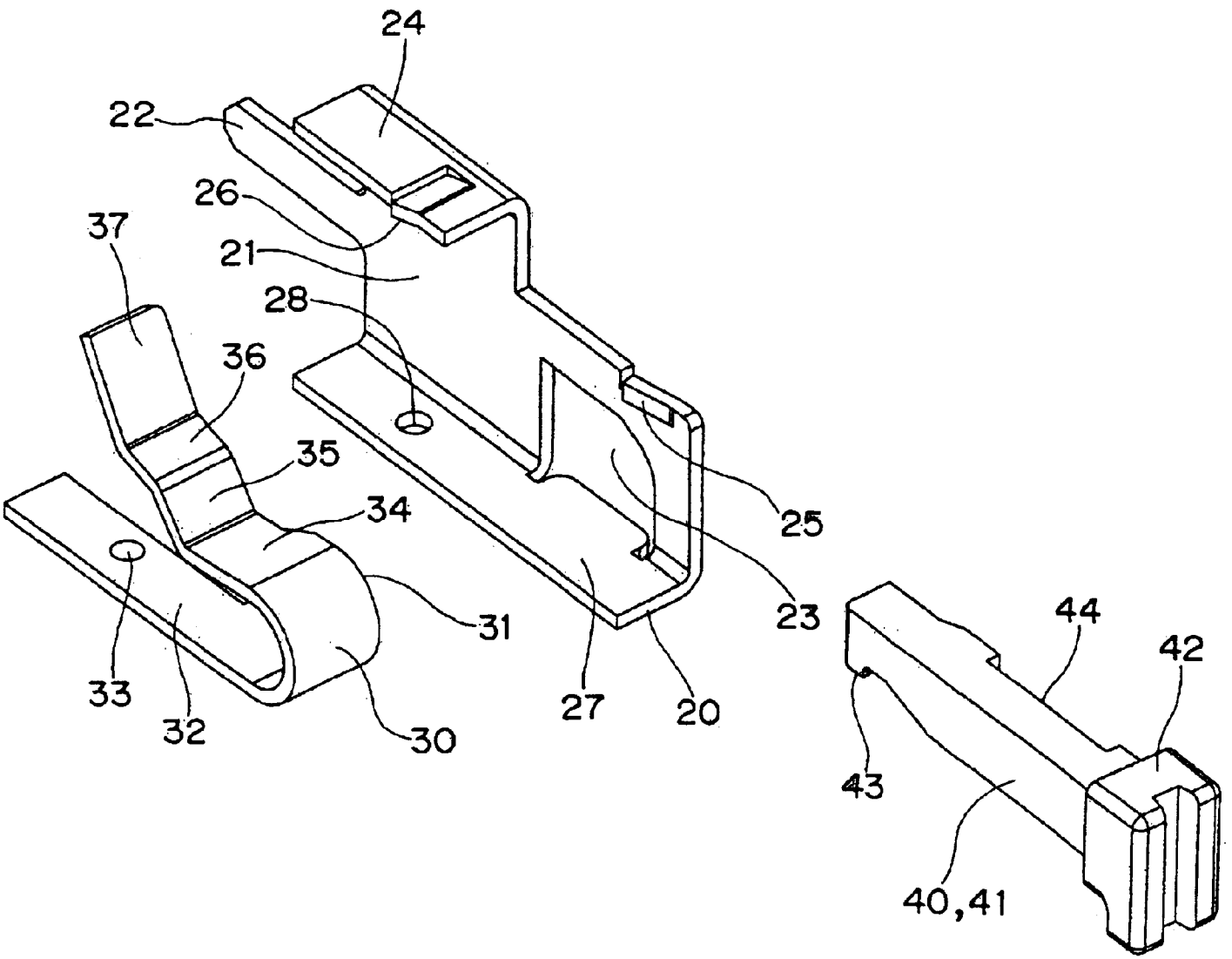
FIG. 36 is an exploded perspective view showing a junction unit of the sixth embodiment.
Figure 37:
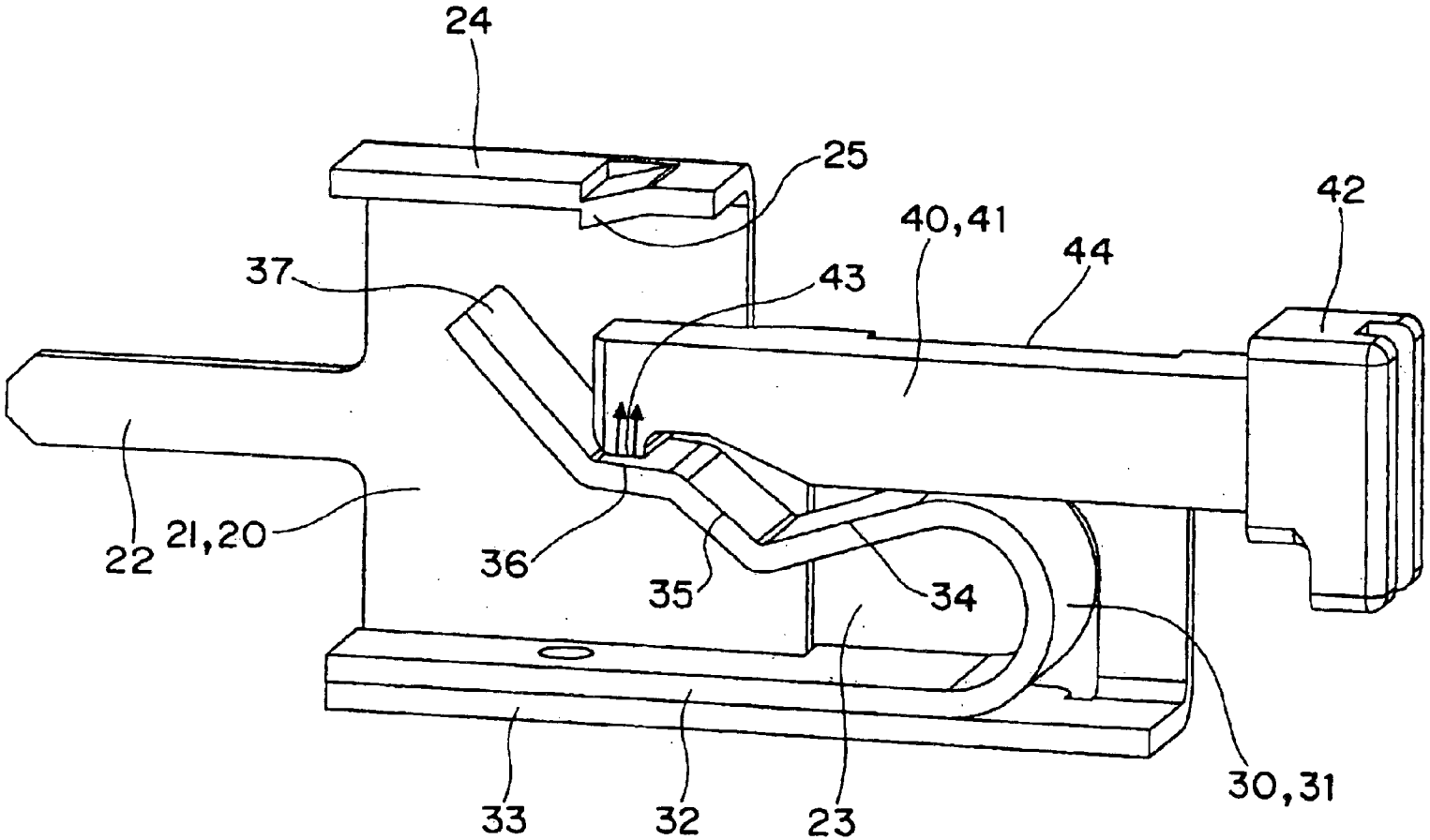
FIG. 37 is a perspective view showing a state in which constitutional parts in FIG. 36 are assembled.
Figure 38:
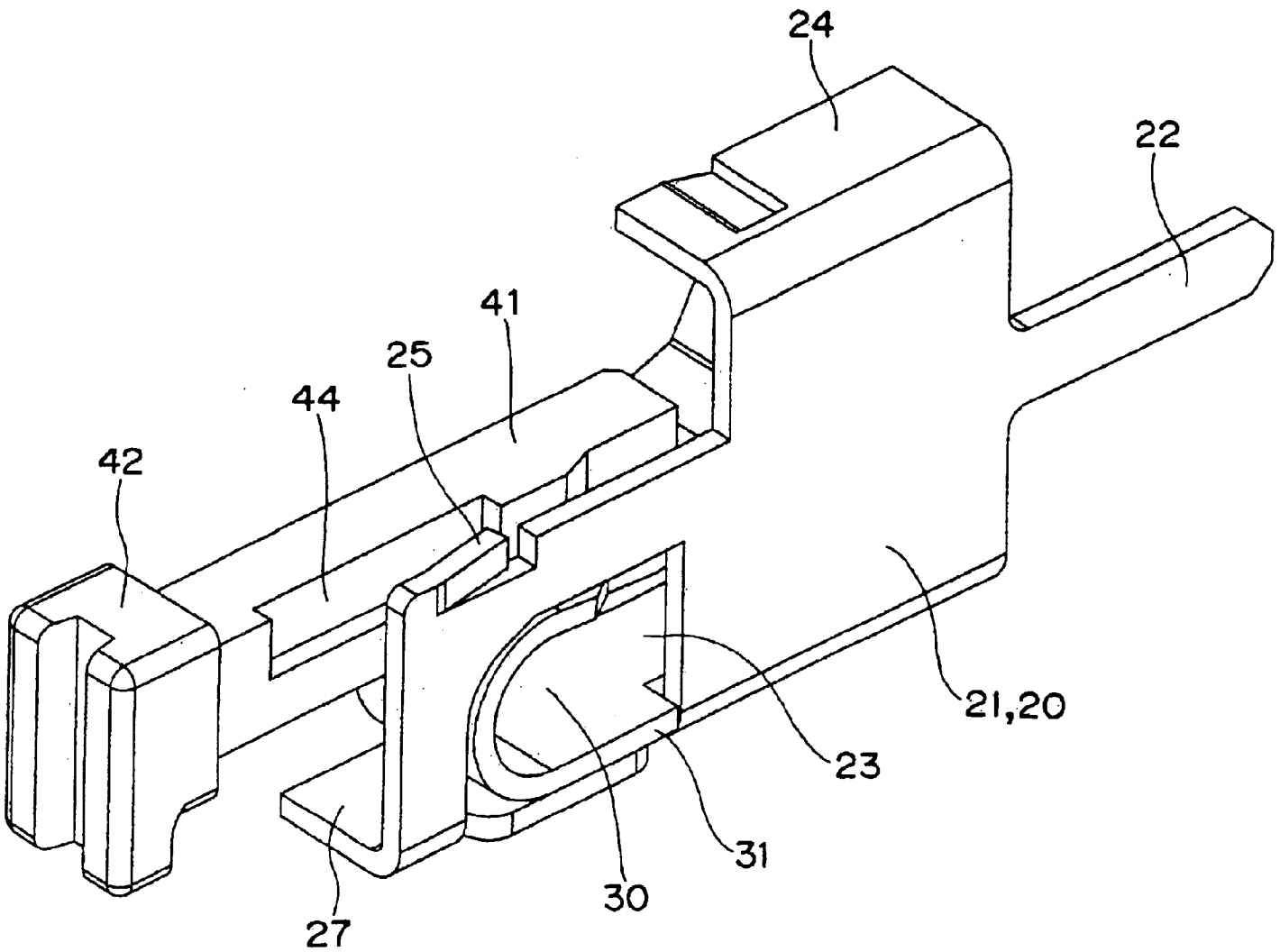
FIG. 38 is a perspective view as viewed from a different angle showing a state in which the constitutional parts in FIG. 36 are assembled.
Figure 39:
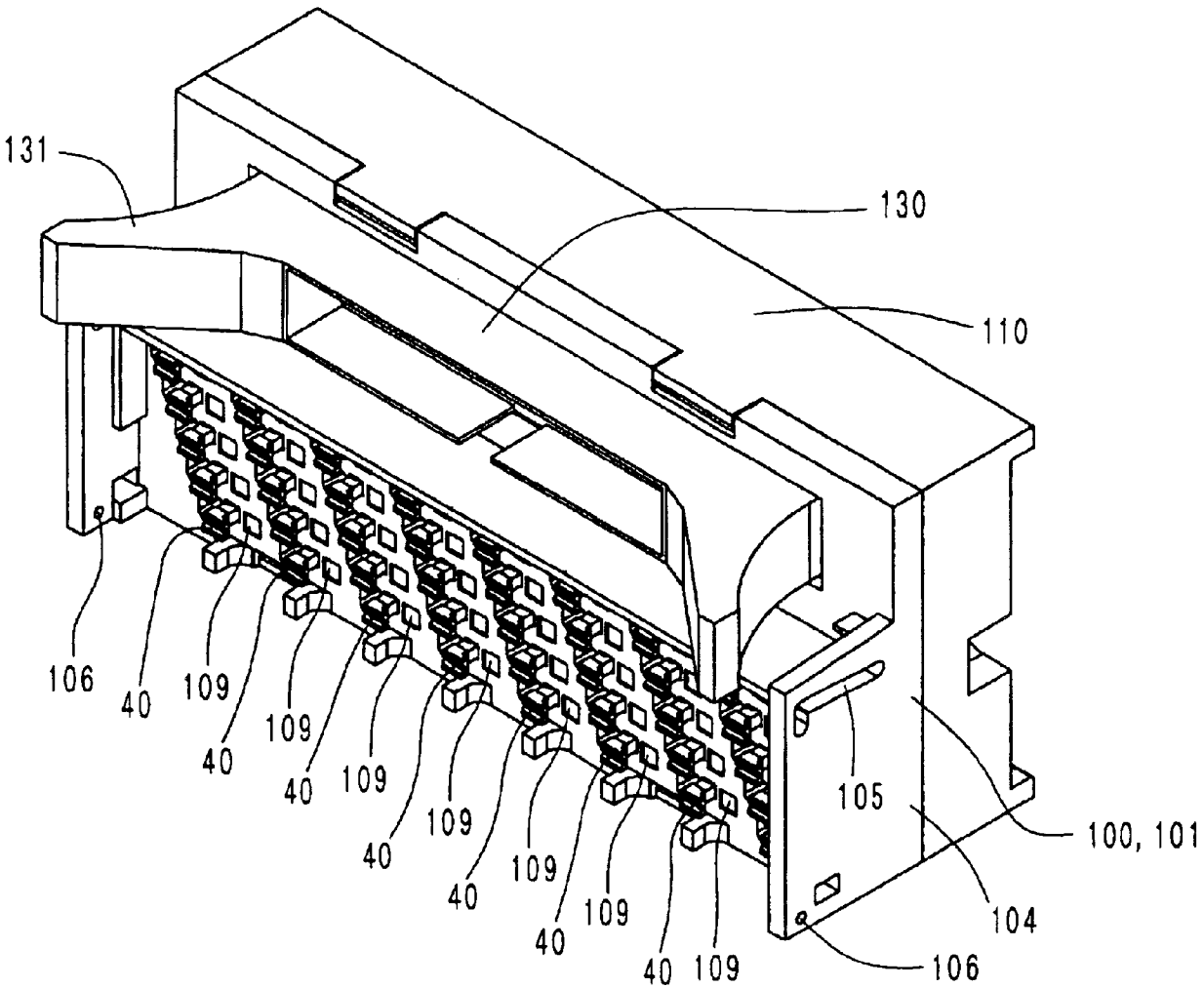
FIG. 39 is a perspective view showing the sixth embodiment according to the present invention.
Figure 40:
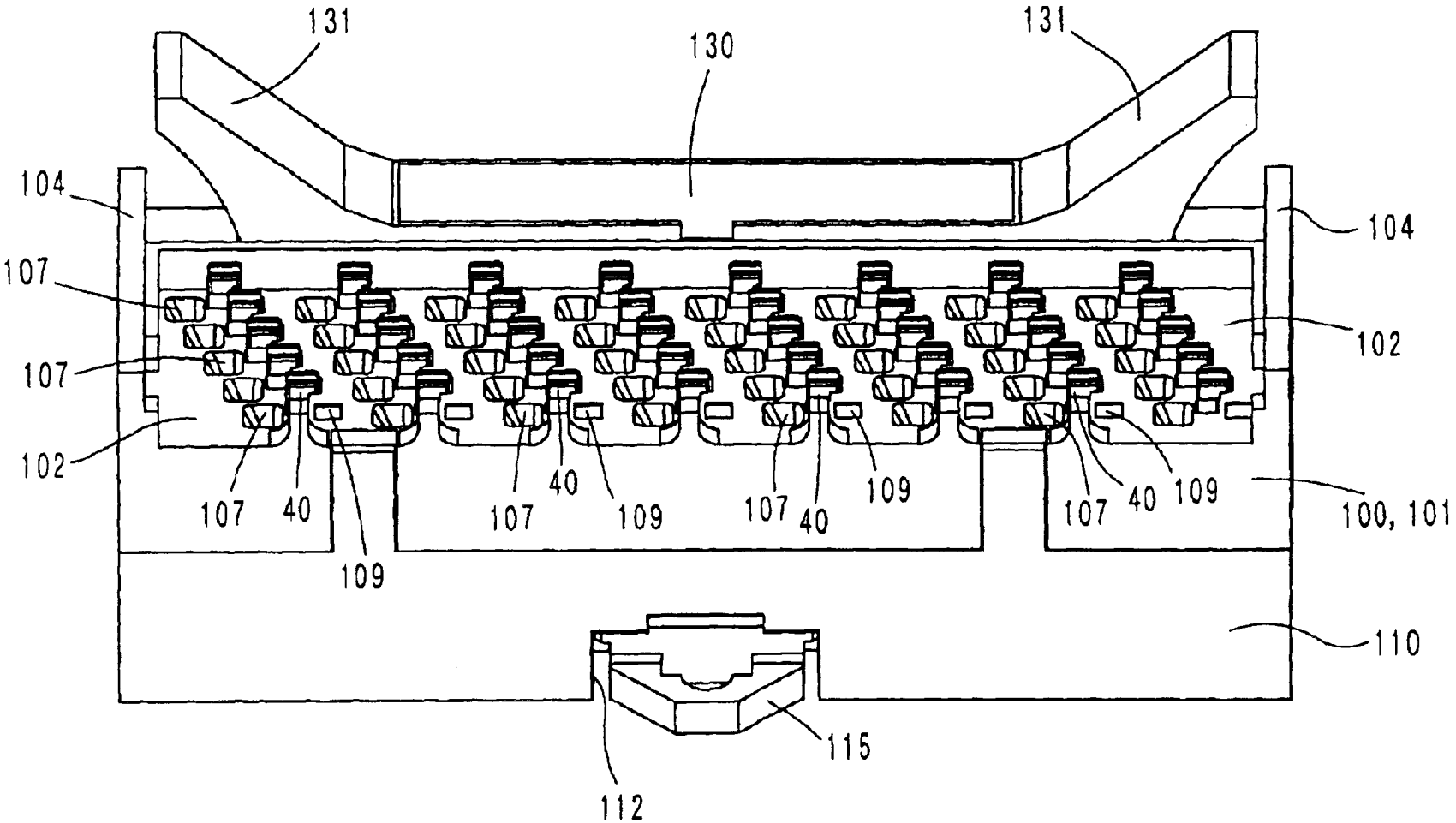
FIG. 40 is a perspective view as viewed from an angle different from a viewing angle of FIG. 39.

Here, the conductive fitting 20, the leaf spring 30 and the manipulation button 40 adopt, as shown in FIG. 36, FIG. 37 and FIG. 38, the substantially same shape and the manner of operation as the above-mentioned first embodiment and hence, the detailed explanation thereof is omitted.

The housing 100 is comprised of a casing 101 and a base 110 and houses a printed circuit board 120 in the inside thereof and, at the same time, a connector receiving fitting 130 and a transparent cover 140 are mounted on the housing 100.

The casing 101 has a connection face 102 which is elevated by one stage at one side of an upper surface thereof and, at the same time, has an elongated hole 103 which allows an insertion of the connector receiving fitting 130 which will be explained later at the remaining side of the casing 101. Further, with respect to the above-mentioned casing 101, approximately L-shaped guide grooves 105 and stopper holes 106 for supporting the transparent cover 140 which will be explained later are formed in side walls 104, 104 formed at both sides of the casing 101.

Figure 32:
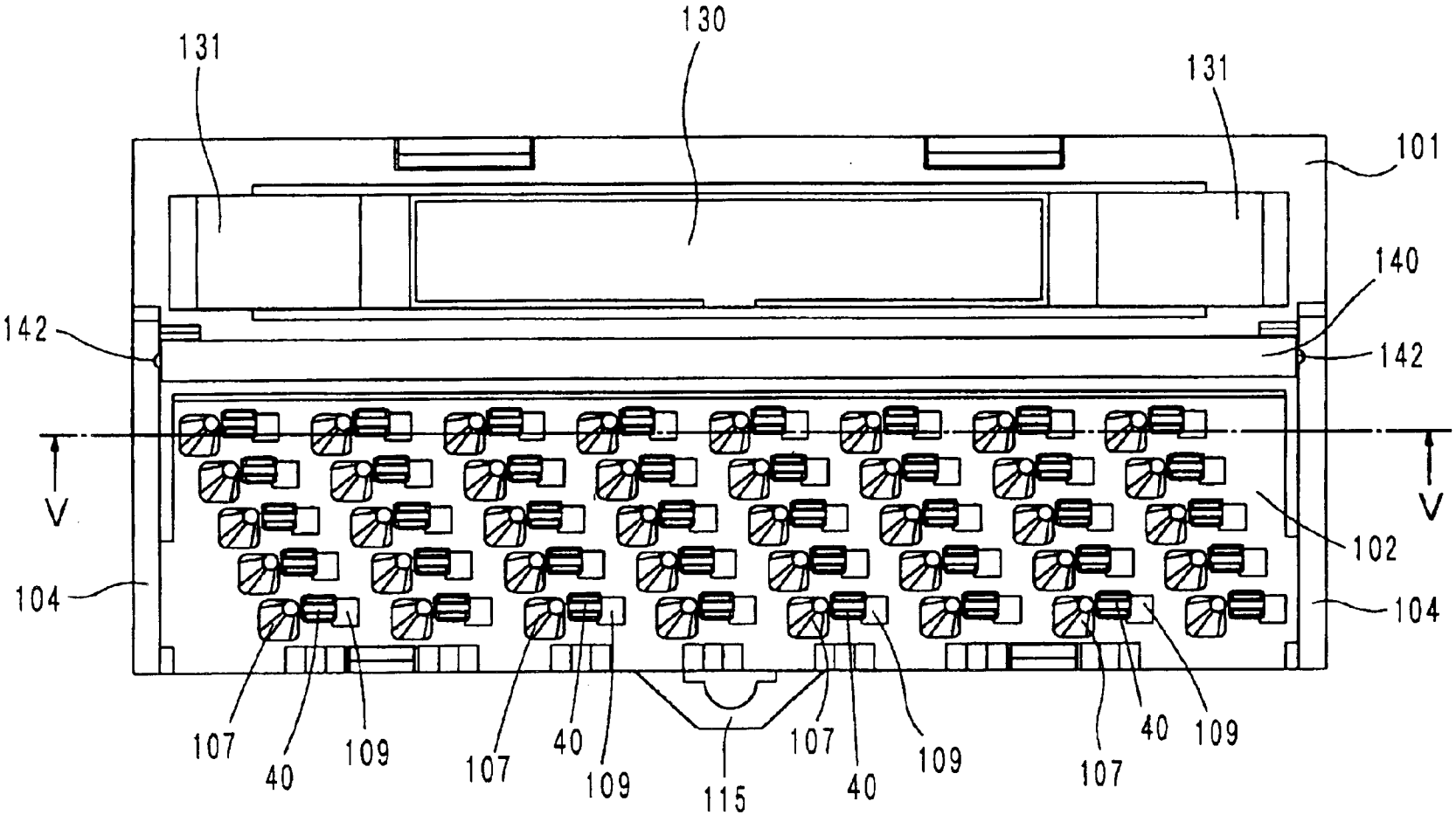
FIG. 32 is a plan view showing the relay terminal of the sixth embodiment according to the present invention.

In the connection face 102, as shown in FIG. 32, for arranging the connection units, sets each of which is comprised of a wire insertion hole 107, a manipulation button insertion hole 108 (FIG. 35) and a recessed portion 109 are arranged at a given pitch in parallel in the lateral direction. Further, the wire insertion holes 107, the manipulation button insertion holes 108 and the recessed portion 109 are arranged in five rows such that they are displaced from each other by a given size in the right downward direction.

According to the present invention, even when wires (not shown in the drawing) are inserted into the wire insertion holes 107 to establish the electric connection, there is no possibility that the pulled-out wires are overlapped with no manipulation buttons 40. Accordingly, not to mention a case that the wires are connected, the operability is not deteriorated also in a case that the wires are removed.

Here, in addition to a case that the wire insertion holes 107 are arranged in the right downward direction, the wire insertion holes 107 may be arranged in the left downward direction. When the wire insertion holes 107 are arranged in the left downward direction, by arranging the manipulation button insertion holes 108 and the recessed portions 109 at the left side of the wire insertion holes 107, it is possible to obtain a relay terminal having high operability in the same manner as mentioned above.

Figure 35:
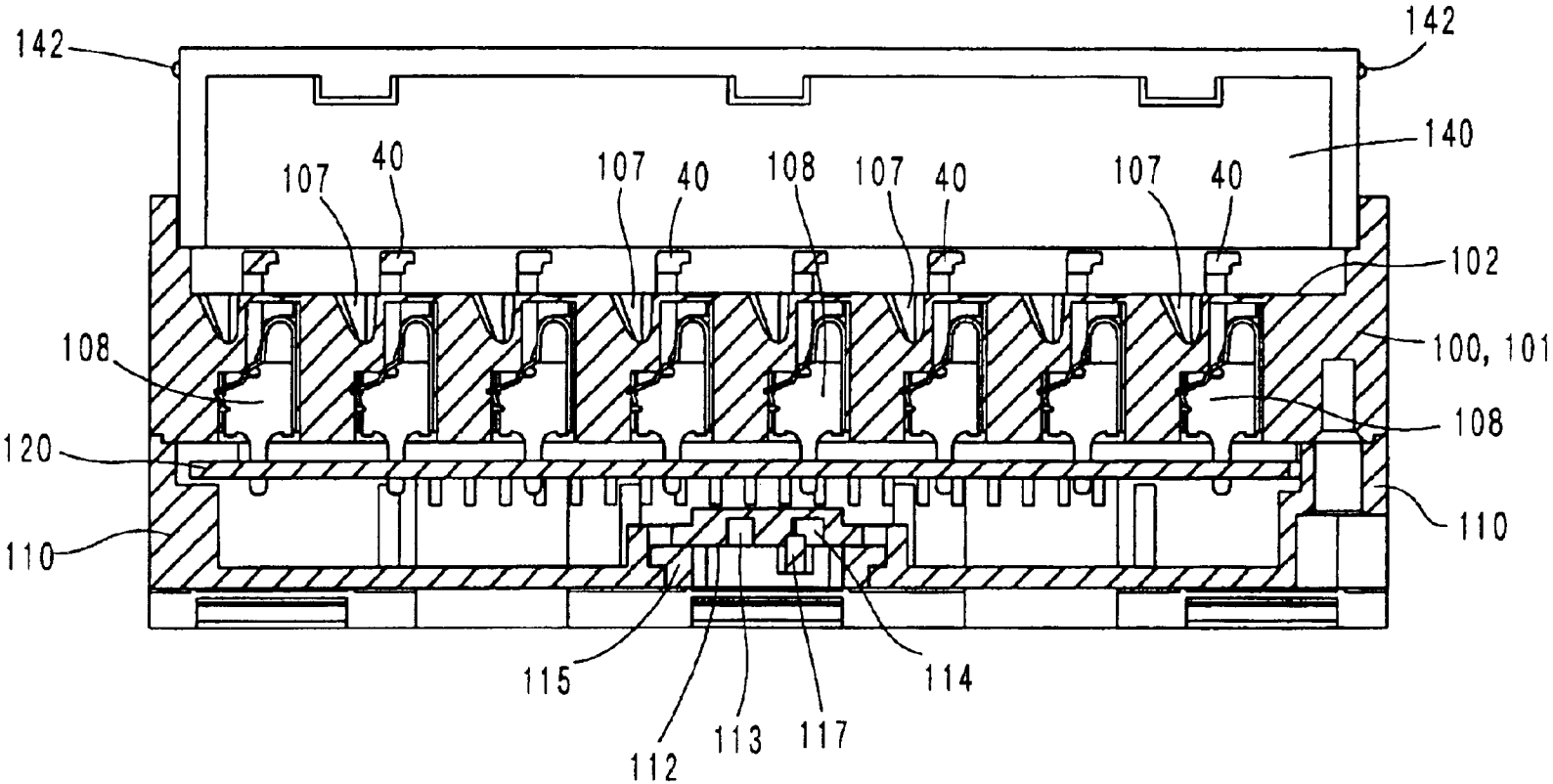
FIG. 35 is a cross-sectional view taken along a line V—V in FIG. 32.

The wire insertion hole 107 has, as shown in FIG. 35, an approximately V-shaped cross section and has a lower opening portion thereof offset toward the manipulation button insertion hole 108 side and is communicated with the manipulation button insertion hole 108.

With respect to the manipulation button insertion hole 108, an opening portion thereof at the connection face 102 side has a shape which allows an insertion of the manipulation button 40 thereto, while an opening portion 108*a* thereof at a back face side has a shape which allows an insertion of the above-mentioned conductive fitting 20 thereto.

The recessed portion 109 is used not only as a space for explicitly indicating a terminal number but also as means for positioning the lever 60 pushed downwardly in the embodiment 7 which will be explained later.

Subsequently, the manner of assembling the conductive fittings 20, leaf springs 30 and the manipulation buttons 40 to the casing 101 is explained.

Figure 41:
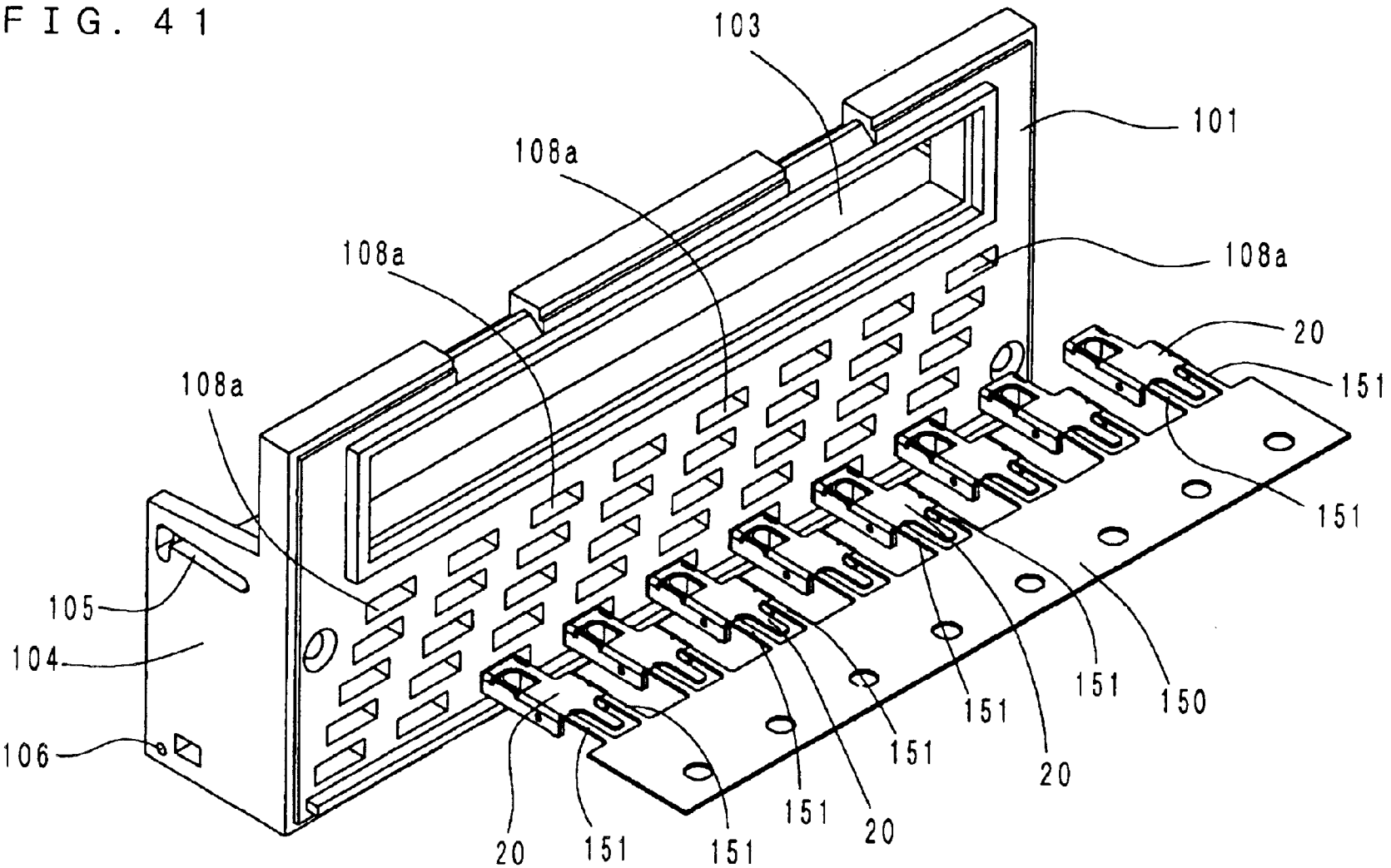
FIG. 41 is a perspective view for explaining the method for assembling a conductive fitting.
Figure 42:
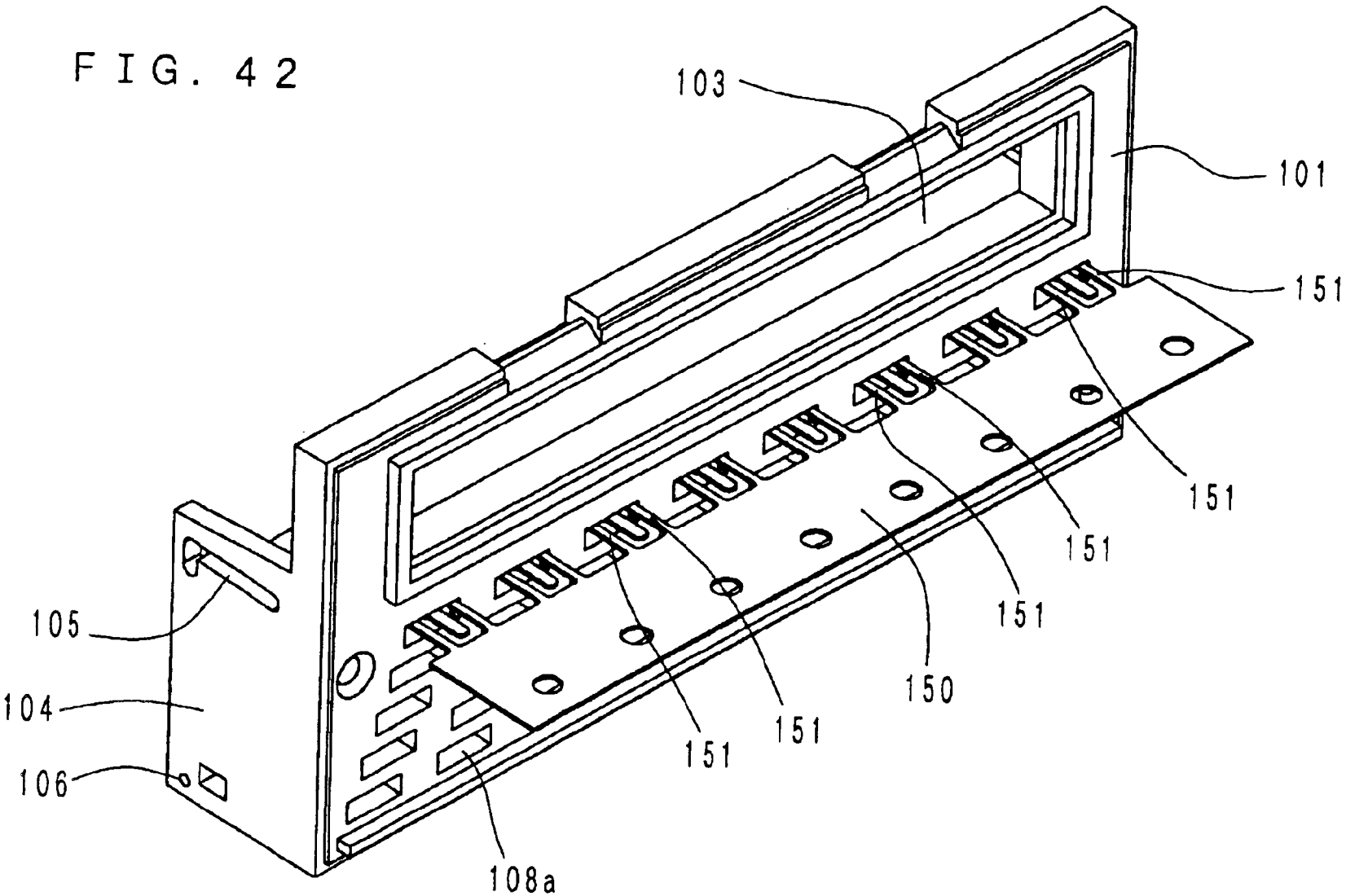
FIG. 42 is a perspective view for explaining the method for assembling a conductive fitting.
Figure 43:
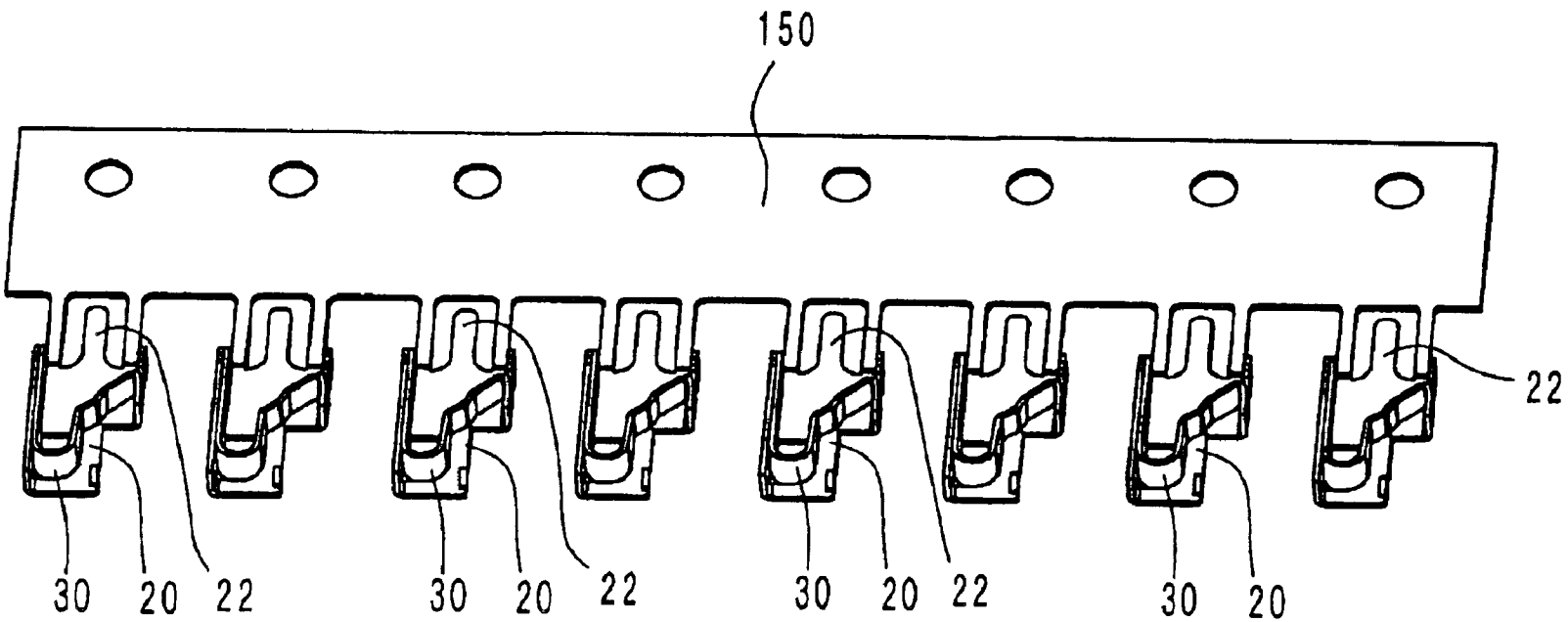
FIG. 43 is a perspective view of a lead frame on which the conductive fitting is integrally formed.
Figure 44:
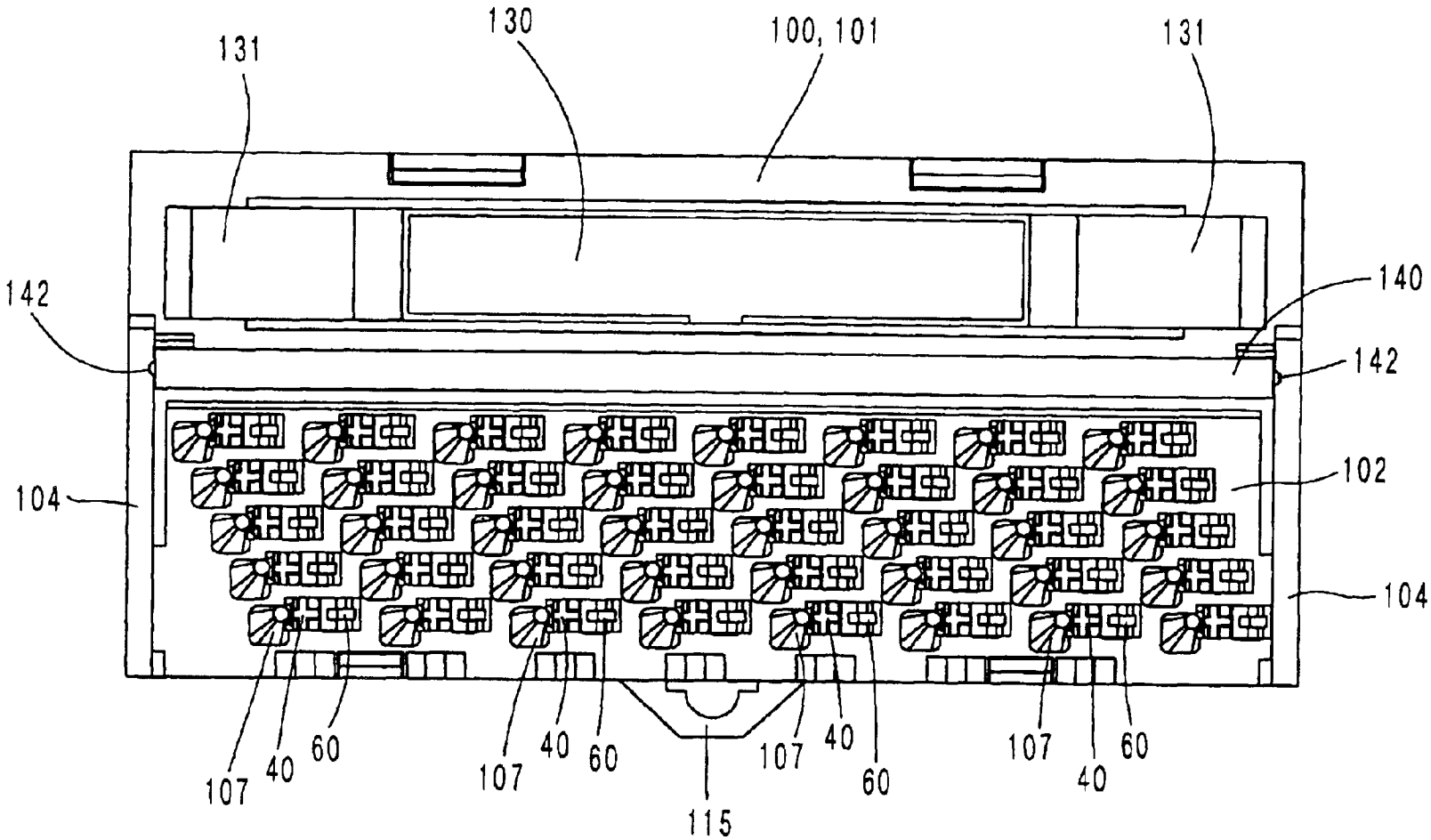
FIG. 44 is a plan view showing a relay terminal which constitutes the seventh embodiment of a wire connector according to the present invention.
Figure 45:
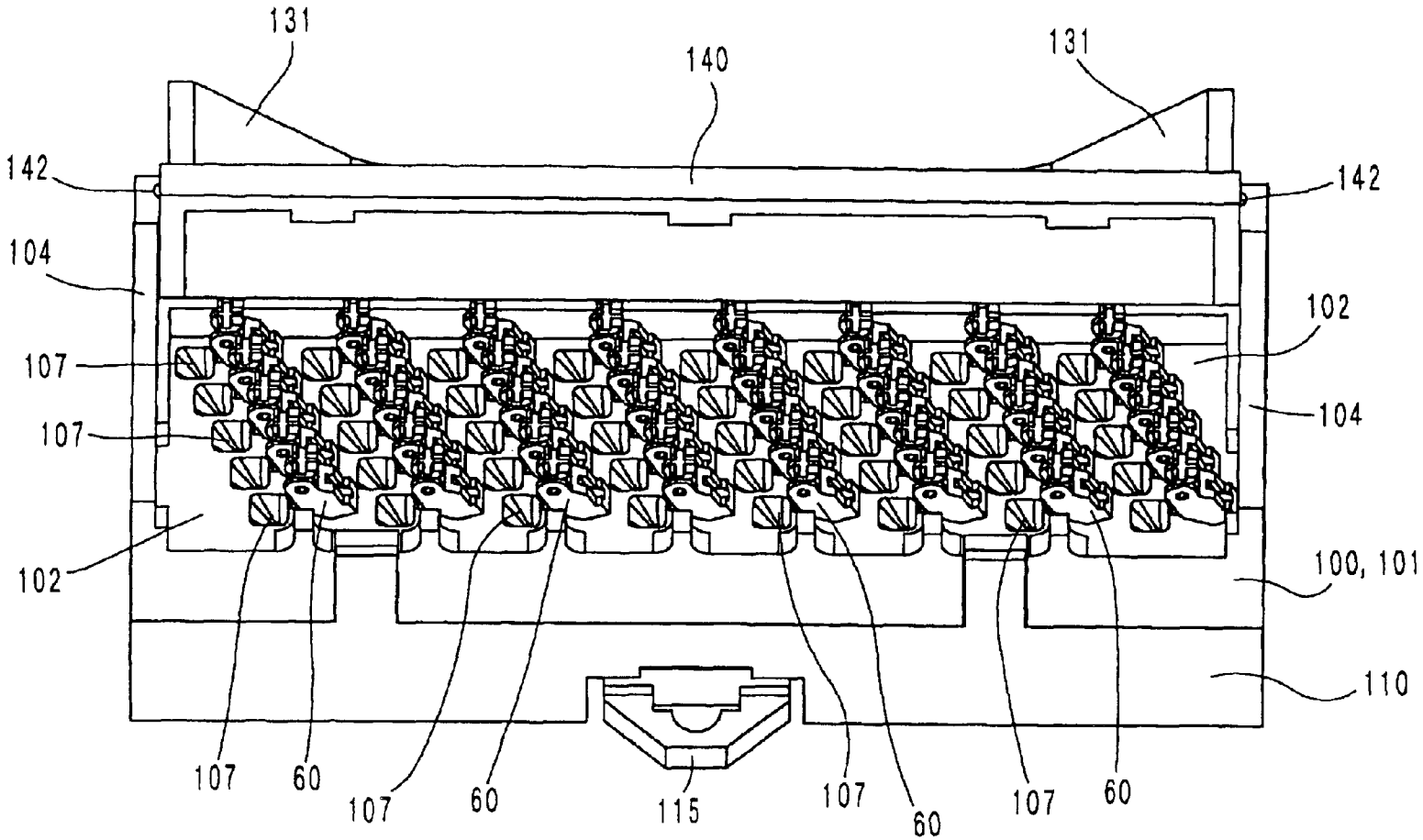
FIG. 45 is a perspective view of the relay terminal shown in FIG. 44.

As shown in FIG. 43, the conductive fittings 20 which are connected to a lead frame 150 at a given pitch by way of connection portions 151 are positioned and, at the same time, the leaf springs 30 having an approximately V shape are preliminarily assembled to the conductive fittings 20 using a spring force of the leaf springs 30 per se. Then, as shown in FIG. 41 and FIG. 42, the conductive fittings 20 are pushed into back-face-side opening portions 108*a* of the manipulation button insertion holes 108 which are arranged on a bottom face of the casing 101 in a row laterally at a given pitch. Further, the lead frame 150 is reciprocated in the upward and downward directions so as to cut the connection portions 151 by making use of fatigue rupture. Thereafter, a plurality of conductive fittings 20 are simultaneously mounted on the casing 101 by repeating the same manipulations.

Then, terminals 22 of the conductive fittings 20 which are projected from a bottom face of the casing 101 are inserted into terminal holes formed in the printed circuit board 120. In the same manner, the terminals of the connector receiving fittings 130 which are assembled to the elongated holes 103 of the casing 101 are inserted into terminal holes formed in the printed circuit board 120. Then, the terminals 22 of the conductive fittings 20 and the terminals of the connector receiving fittings 130 are soldered to the printed circuit board 120.

The base 110 has a planar shape which allows an assembling of the base 110 to a bottom face of the casing 101. Further, the above-mentioned base 110 is, as shown in FIG. 34, provided with pawl portions 111 at one-side peripheral portion of the bottom face thereof and a guide groove 112 (FIG. 33, FIG. 35) for allowing slide fitting of a stopper pawl fitting 115 at the center of an opposing peripheral portion. Further, a pair of approximately V-shaped cam grooves 113, 114 are arranged in parallel in the bottom face of the guide groove 112 (FIG. 33).

Figure 33:
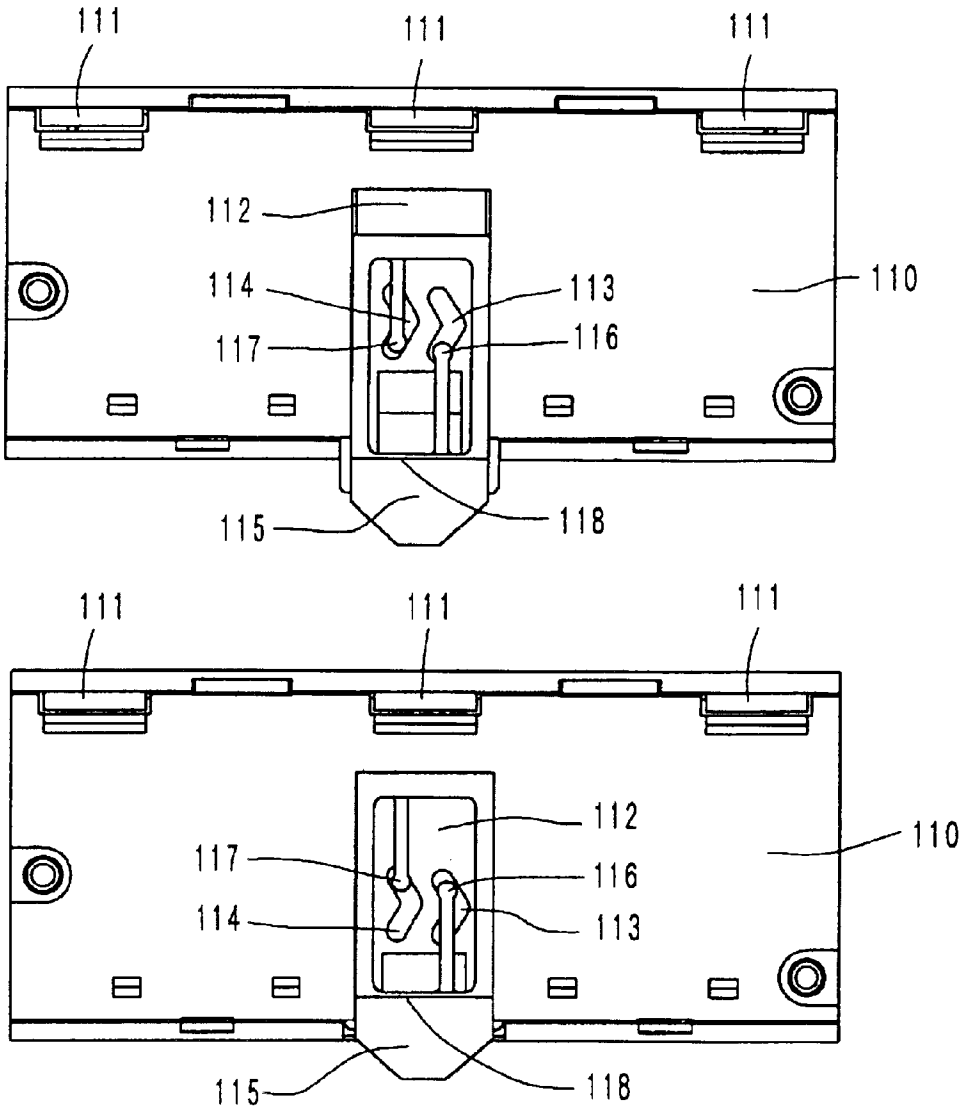
Figure 34:
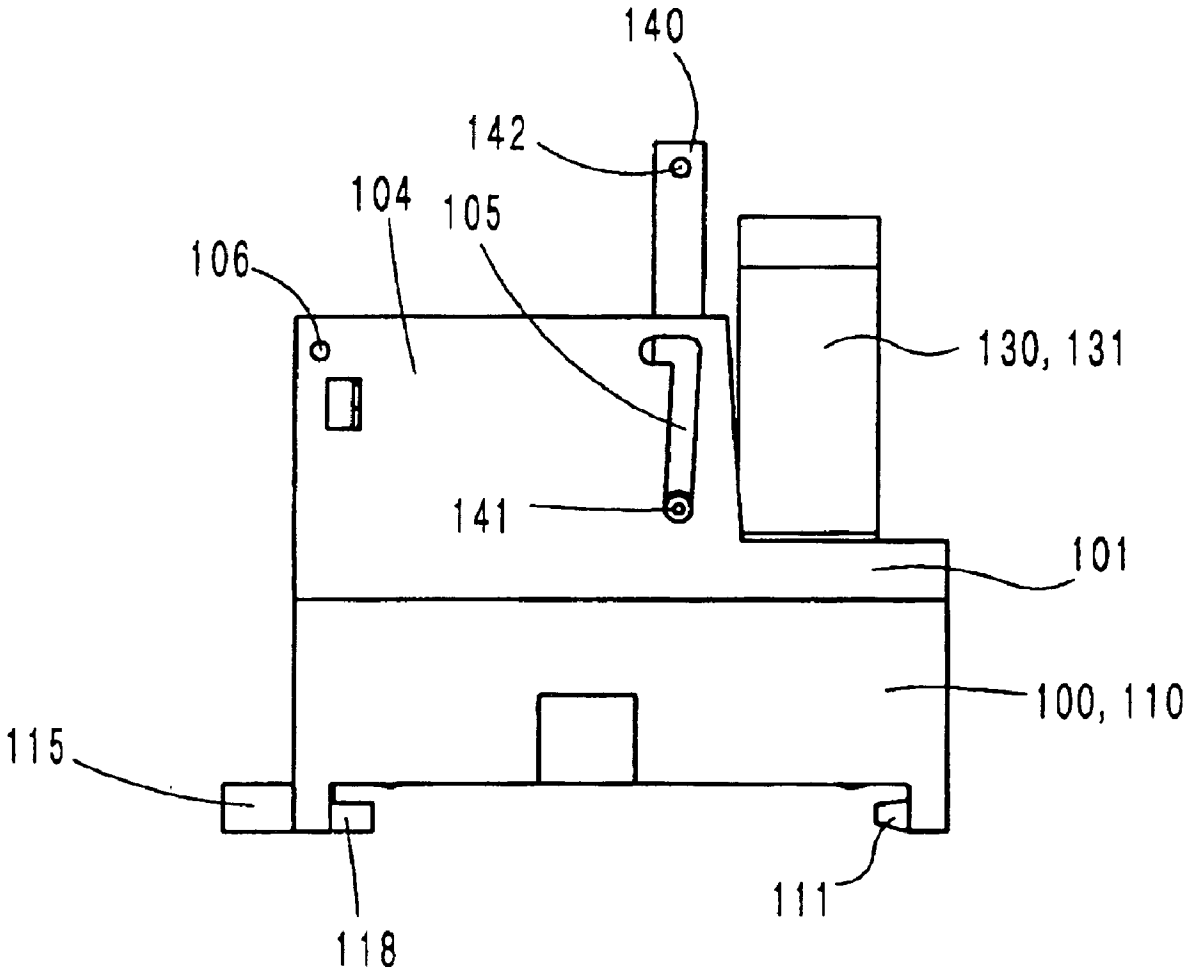
FIG. 34 is a right-side view showing the relay terminal of the sixth embodiment according to the present invention.

The stopper pawl fitting 115 is, as shown in FIG. 32 and FIG. 33, formed of a frame having an outer peripheral contour which allows the stopper pawl fitting 115 to be slidably fitted into the guide groove 112 formed in the base 110. The above-mentioned stopper pawl fitting 115 arranges a pair of resilient pawl portions 116, 117 in the inside thereof in a point symmetry and has a pawl portion 118 which is engaged with a guide rail not shown in the drawing. Then, by having the stopper pawl fitting 115 slidably fitted into the guide groove 112, distal end portions of the above-mentioned resilient pawl portions 113, 114 are respectively engaged with the cam grooves 113, 114 of the above-mentioned guide groove 112.

Accordingly, in mounting the housing 100 to which the base 110 is integrally provided on the guide rail, after releasing a locking state by pulling out the above-mentioned stopper pawl fitting 115, the pawl portions 111 of the base 110 are engaged with the above-mentioned guide rail. Then, by engaging and locking the pawl portion 118 to the guide rail by pushing the above-mentioned stopper pawl fitting 115, it is possible to prevent the removal of base 110 while enabling the sliding thereof.

Then, while fitting and fixing the base 110 to the above-mentioned casing 101, the manipulation buttons 40 are assembled into the manipulation button insertion holes 108 formed in the connection face 102 of the above-mentioned casing 101 by pushing. Further, by making a pair of support projections 141 which are formed on both-side end faces of the transparent cover 140 engage with the guide grooves 105 formed in both side walls of the casing 101, the transparent cover 140 is slidably supported. Here, projections 142 which are engaged with stopper holes 106 formed in the casing 101 are formed in both-side end faces of the above-mentioned cover 140.

According to this sixth embodiment, the wire insertion holes 107 and the manipulation button insertion holes 108 which are provided for arranging the constitutional parts of the connection units are arranged in a large number on a connection face coplanar with the casing 101 in the front-and-rear direction as well as in the left-and-right direction at a given pitch. Particularly, since the insertion holes 107 of the front row and the insertion holes 108 of the rear row are displaced from each other in the lateral direction at a given pitch, there is no possibility that the wires which are inserted into the insertion holes 107 of the front row are overlapped to the manipulation buttons 40 of the rear row. Accordingly, the connected wires do not hamper the maintenance operation. Further, it gives rise to an advantage that it is possible to obtain a relay terminal exhibiting high operability even when the device is miniaturized.

The seventh embodiment is, as shown in FIG. 44 to FIG. 49, directed to a relay terminal having the substantially same structure as the above-mentioned sixth embodiment. A point which makes the seventh embodiment different from the sixth embodiment lies in that with respect to constitutional parts of a connection unit which is comprised of a conductive fitting 20, a leaf spring 30 and a manipulation button 40, the manipulation button 40 includes a lever 60 and a manipulation recessed portion 46 having a cruciform shape is formed in an end face of the lever 60.

Particularly, the seventh embodiment is provided for solving a task drawback that when the device is miniaturized and the packing density of wiring is high, it is difficult to manipulate the manipulation button 40. Further, the seventh embodiment adopts the structure which does not obstruct the wiring operation even when a large number of manipulation buttons 40 are arranged on one housing.

Figure 46:
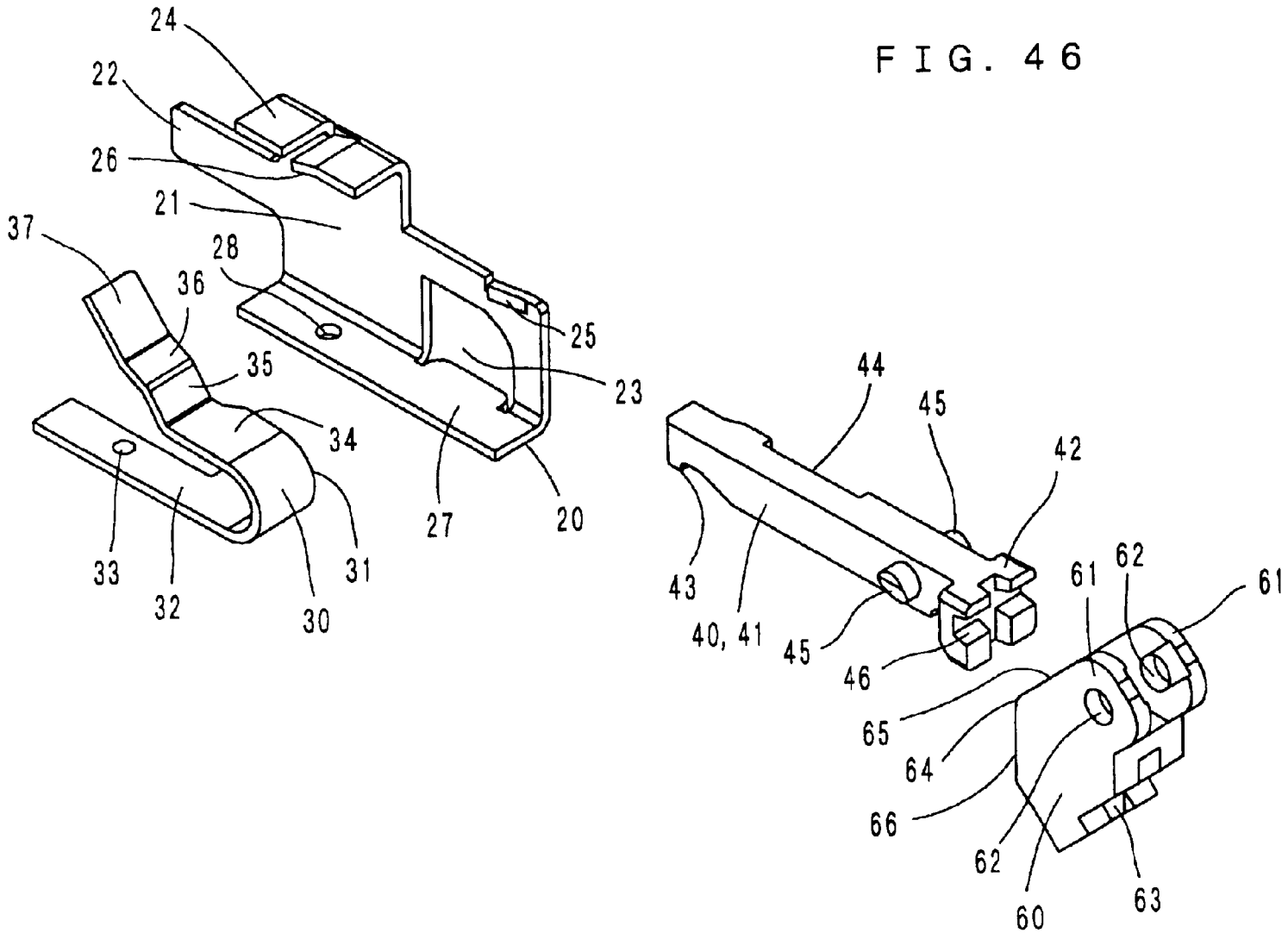
FIG. 46 is an enlarged exploded perspective view of parts constituting a connection unit according to the seventh embodiment of the present invention.
Figure 49:
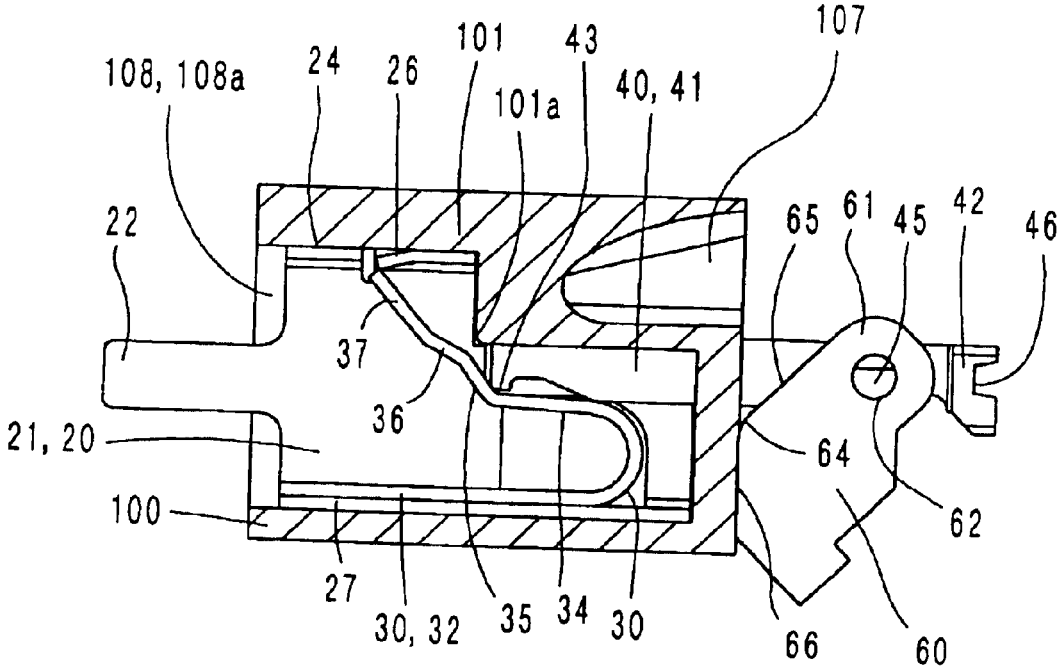
Figure 49:
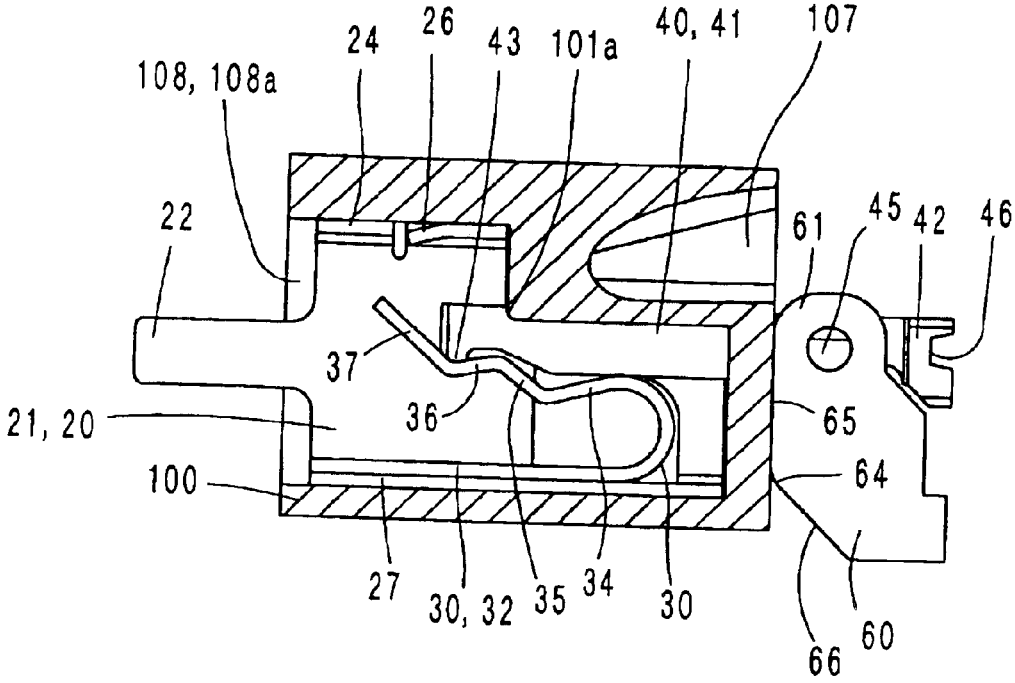

The conductive fitting 20 includes, as shown in FIG. 46 and FIG. 49, a front face portion 21 having a shape which allows the insertion of the conductive film 20 through an opening portion 108*a* of the above-mentioned casing 101. While a terminal 22 extends from a left end peripheral portion of the front face portion 21 in the sideward direction, a fitting opening 23 is formed in a right half portion of one side of the front face portion 21. Further, with respect to an upper end peripheral portion of the above-mentioned front face portion 21, an upper bent lug 24 is formed at a left side peripheral portion and a stopper pawl 25 is formed in an erected manner by cutting at a right side peripheral portion. A stopper projection 26 which prevents the removal of a wire explained later is formed on the upper bent lug 24. On the other hand, on a lower end peripheral portion of the front face portion 21, a lower bent lug 27 is formed. A positioning hole 28 is formed in the lower bent lug 27.

A leaf spring 30 is bent in an approximately V shape, wherein a bent portion 31 has a large width and can be fitted into the fitting opening 23 of the conductive fitting 20. Then, a positioning projection 33 which is engaged with the positioning hole 28 of the conductive fitting 20 is formed in a bottom face portion 32 of the leaf spring 30 by projection machining. Further, in a bridging portion 34 extending from the bent portion 31, a first bent portion 35, a second bent portion 36 and a pushing tongue portion 37 are sequentially formed.

Accordingly, when the positioning projection 33 of the leaf spring 30 is fitted into the positioning hole 28 of the lower bent lug 27, the pushing tongue portion 37 is brought into pressure contact with the stopper projection 26 of the upper bent lug 24 due to a spring force of the leaf spring 30 and hence, both ends of the leaf spring 30 are brought into pressure contact with the conductive fitting 20 and are held by the conductive fitting 20.

Figure 47:
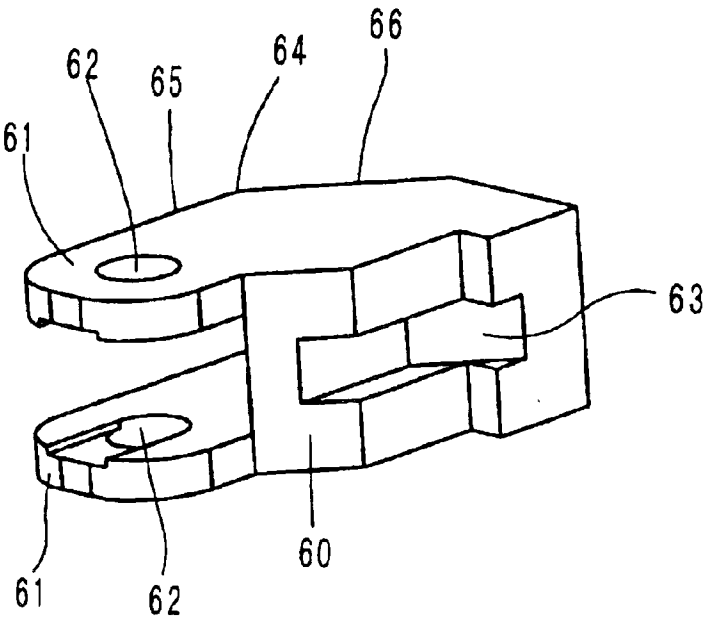
Figure 47:
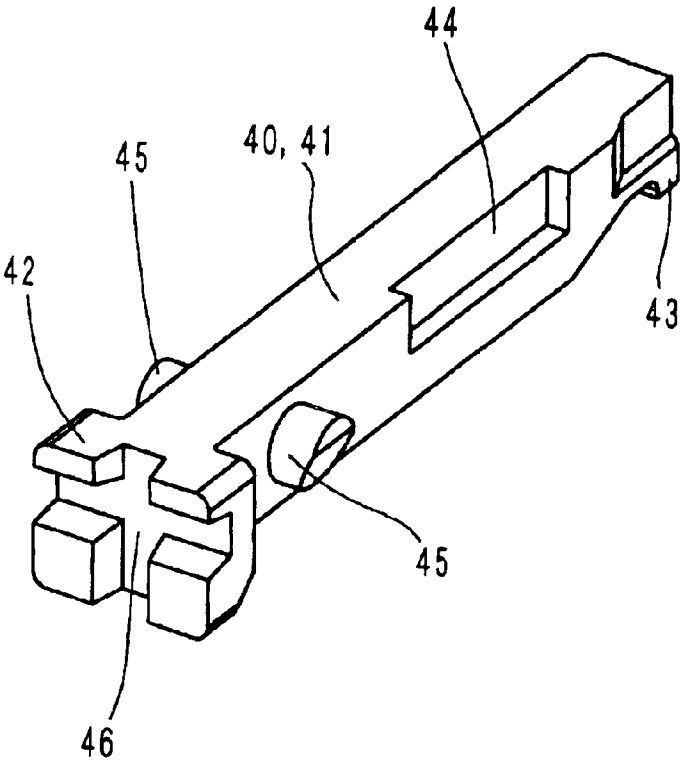
Figure 48:
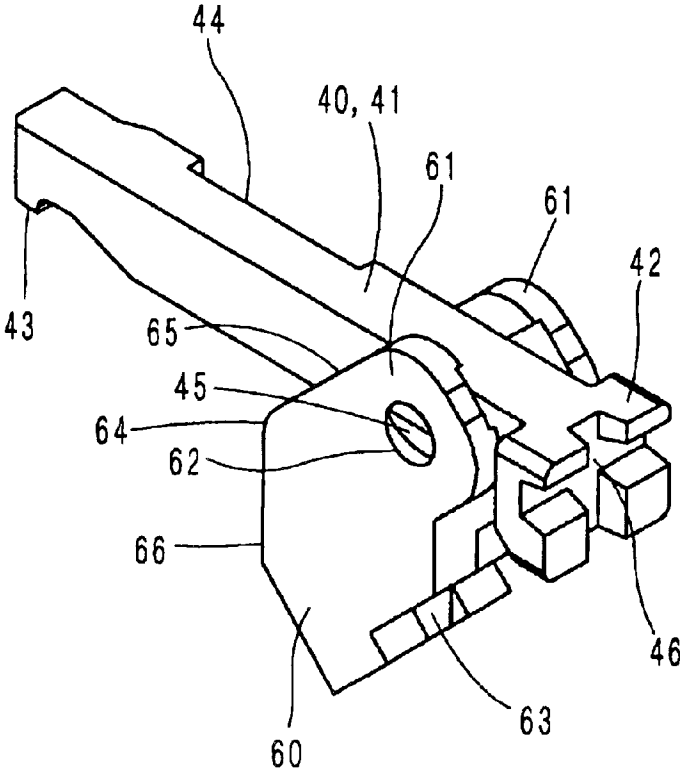
Figure 48:
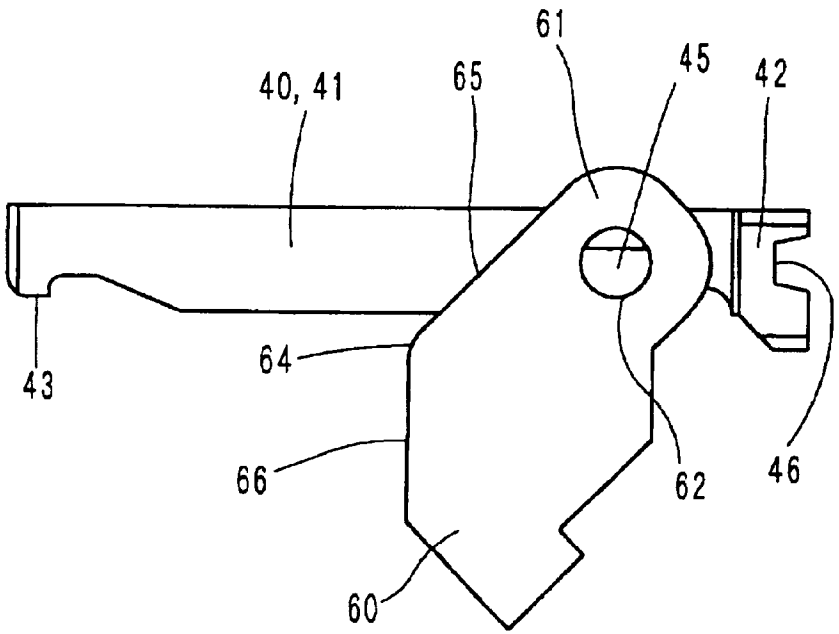

The manipulation button 40 is, as shown in FIG. 46 and FIG. 47, constituted of a shaft portion 41 and a head portion 42. The shaft portion 41 has a cross-sectional shape which allows an insertion thereof into an opening portion of the above-mentioned manipulation button insertion hole 108 at the connection face 102 side. Further, the above-mentioned head portion 42 is integrally formed on one end of the shaft portion 41 for restricting the insertion position of the shaft portion 41. Further, the manipulation button 40 forms a manipulation portion 43 at a distal end of a lower face of the shaft portion 41 and, at the same time, forms a removal preventing stepped portion 44 in the sliding direction on an upper end peripheral portion of one side face thereof. Further, the shaft portion 41 is provided with a pair of support projections 45, 45 which rotatably support the lever 60 explained later on respective opposing side faces in the vicinity of the head portion 42. Still further, the cruciform manipulation recessed portion 46 is formed in a distal end face of the above-mentioned head portion 42. Here, the shape of the manipulation recessed portion 46 is not limited to the above-mentioned shape and may be formed of a simple straight groove or a simple circular recessed portion.

Accordingly, as shown in FIG. 49, when the shaft portion 41 of the manipulation button 40 is pushed into the casing 101 through the insertion opening 108 of the casing 101, the stepped portion 44 is engaged with the stopper pawl 25 of the conductive fitting 20, and the shaft portion 41 is brought into contact with the first bent portion 35 after reaching the bridging portion 34 of the leaf spring 30. In this state, since the stopper pawl 25 of the conductive fitting 20 is engaged with the stepped portion 44 of the manipulation button 40, the removal of the manipulation button 40 is prevented by the stopper pawl 25.

The lever 60 is, as shown in FIG. 46 to FIG. 49, a member for pulling up the above-mentioned manipulation button 40.

Shaft holes 62 which allow the engagement of support projections 45 of the manipulation button 40 therewith are formed in a pair of extending arm portions 61, 61. Accordingly, by engaging the shaft holes 62 of the lever 60 with the support projections 45, 45 of the above-mentioned manipulation button 40, the lever 60 is rotatably supported. Further, the lever 60 includes a manipulation groove 63 extending from base portions of the arms 61 and arranges rotatable fulcrums 64 on surfaces thereof opposed to the manipulating groove 63. At both sides of the rotatable fulcrum 64, position restricting tapered faces 65, 66 are formed at given angles (FIG. 48B).

Subsequently, the manner of using the above-mentioned relay terminal is explained. However, for facilitating the understanding of explanation, the wire is not shown.

First of all, when the head portion 42 of the manipulation button 40 shown in FIG. 49A is pushed, the manipulation portion 43 gets over the first bent portion 35 and reaches the second bent portion 36 against the spring force of the leaf spring 30 (FIG. 49B). Along with such an operation, the lever 60 is simultaneously rotated using the projections 45 as fulcrums and the tapered faces 65 are brought into pressure contact with outer faces of the casing 10 so as to restrict the position of the manipulation button 40. Accordingly, the pushing tongue portion 37 is pressed downwardly thus giving rise to a gap between the pushing tongue portion 37 and the stopper projection 26 of the conductive fitting 20. Here, the manipulation portion 43 is pressed upwardly due to the spring force of the leaf spring 30 and hence, an upper face of the shaft portion 41 is brought into pressure contact with a corner portion 101*a* of the casing 101 and is locked thereto. Accordingly, there is no possibility that the manipulation button 40 is freely or naturally restored.

Subsequently, when a tool (not shown in the drawing) is positioned and pushed into the manipulation groove 63 of the lever 60 after inserting the wire not shown in the drawing into the casing 101 through the insertion hole 107 of the casing 101, due to a principle of lever, the lever 60 is rotated using the rotatable fulcrums 64 as a fulcrum. Accordingly, the manipulation button 40 is pulled upwardly and hence, the leaf spring 30 is restored due to the spring force thereof. As a result, the stopper projection 26 of the conductive fitting 20 and the pushing tongue portion 37 of the leaf spring 30 clamp the wire thus establishing an electric connection. Here, since the stepped portion 44 of the manipulation button 40 is stopped by the stopper pawl 25 of the conductive fitting 20, there is no possibility that the manipulation button 40 is removed.

According to this embodiment, by only performing the same operation that the manipulation button 40 and the lever 60 are alternately pushed downwardly, it is possible to perform mounting and dismounting of the wire. Accordingly, it is possible to perform the mounting and dismounting of the wire using the same tool and hence, it is unnecessary to change the tools whereby the relay terminal which can be easily handled and exhibits the high operability can be obtained.

Further, the pulling out of the manipulation button 40 is performed by making use of the principle of lever such that one end portion of the lever 60 which is rotatably supported on the manipulation button 40 is pressed downwardly. Accordingly, a pulling-out quantity of the manipulation button 40 is limited and hence, it is possible to prevent the occurrence of drawback that the manipulation button 40 ruptures due to an excessive pulling-out of the manipulation button 40 by an error.

Further, according to this embodiment, the position of the lever 60 differs corresponding to the position of the manipulation button 40. Accordingly, it is possible to judge a state such as whether the wire can be inserted or not based on the position of the lever 60 whereby it is possible to obtain the relay terminal having the favorable availability.

Still further, according to this embodiment, the manipulation recessed portions 46 are formed in one end portions of the manipulation button 40 and the lever 60. Accordingly, it is possible to perform the positioning of the manipulation tool rapidly and accurately thus giving rise to an advantage that the relay terminal which exhibits the further improved operability can be obtained.

INDUSTRIAL APPLICABILITY

The wire connector according to the present invention is not limited to the above-mentioned embodiments and is applicable to other relay connector, other connectors for wire connection, other relay terminals and the like.

What is claimed is:

1. A wire connector comprising a housing, a conductive fitting which is housed in the inside of the housing, a leaf spring which is bent in an approximately V shape and has a one-side end portion thereof brought into pressure contact with the conductive fitting, and a manipulation button which is slidably inserted into the housing in an axial direction, wherein by pushing one end portion of the manipulation button in the direction toward the housing, the other end portion of the manipulation button pushes a one-side end portion of the leaf spring downwardly to generate the resilient deformation of the leaf spring, an upper face of a shaft portion of the manipulation button is pressed to a fixed part by a reaction of the resilient deformation so as to lock the manipulation button, while by pulling out the manipulation button from the housing, the one end portion of the leaf spring is resiliently restored and a wire which is inserted into the inside of the housing is clamped by the one-side end portion of the leaf spring and the conductive fitting.

2. A wire connector comprising a box-shaped casing having an approximately L-shaped recessed portion which is formed by providing a corner portion at a side corner portion thereof, a conductive fitting which has a front face portion capable of being housed in the recessed portion of the casing and forms a bent lug on an upper end peripheral portion thereof, a leaf spring which is bent in an approximately V shape and brings a one-side end portion thereof into pressure contact with a lower face of the bent lug of the conductive fitting, and a manipulation button which has a shaft portion thereof inserted into the casing such that the shaft portion is slidable in a sideward direction and has a distal end portion of a lower face of the shaft portion formed into a manipulation portion which is capable of pushing an upper face of one side of the leaf spring, wherein when the manipulation button is pushed into the inside of the casing, the manipulation portion pushes down the one side of the leaf spring, whereas an upper face of the shaft portion of the manipulation button is pushed and locked to the corner portion of the casing due to a reaction of the leaf spring.

3. A wire connector comprising a box-shaped casing having an approximately L-shaped recessed portion which is formed by providing a corner portion at a side corner portion thereof, a conductive fitting which has a front face portion capable of being housed in the recessed portion of the casing and forms a bent lug on an upper end peripheral portion thereof, a leaf spring which is bent in an approximately V shape and brings a one-side end portion thereof into pressure contact with a lower face of the bent lug of the conductive fitting, and a manipulation button which has a shaft portion thereof inserted into the casing such that the shaft portion is slidable in a sideward direction and has a distal end portion of a lower face of the shaft portion formed into a manipulation portion which is capable of pushing an upper face of one side of the leaf spring, wherein a bent portion of the leaf spring has a wide width and, at the same time, a fitting opening which allows the fitting of the bent portion thereinto is formed on the front face portion of the conductive fitting.

4. A wire connector comprising a box-shaped casing having an inverted T-shaped recessed portion which is formed while providing corner portions at both side corner portions thereof, a conductive fitting which has a front face portion capable of being housed in the recessed portion of the casing and has an upper-end center peripheral portion formed into a bent lug, a pair of leaf springs which are bent in an approximately V shape and bring one-side end portions into pressure contact with a lower face of the bent lug of the conductive fitting, and a pair of manipulation buttons which have shaft portions thereof slidably inserted into the casing and form manipulation portions which are capable of pushing one-side upper faces of the leaf springs on lower-face distal end portions of the shaft portions, wherein when the manipulation buttons are pushed into the inside of the casing, each manipulation portion pushes down one-side of the leaf spring, whereas an upper face of the shaft portion of the manipulation button is pressed and locked to the corner portion of the casing due to a reaction of the leaf spring.

5. A wire connector comprising a box-shaped casing having an inverted T-shaped recessed portion which is formed while providing corner portions at both side corner portions thereof, a conductive fitting which has a front face portion capable of being housed in the recessed portion of the casing and has an upper-end center peripheral portion formed into a bent lug, a pair of leaf springs which are bent in an approximately V shape and bring one-side end portions into pressure contact with a lower face of the bent lug of the conductive fitting, and a pair of manipulation buttons which have shaft portions thereof slidably inserted into the casing and form manipulation portions which are capable of pushing one-side upper faces of the leaf springs on lower-face distal end portions of the shaft portions, wherein the bent portions of the leaf springs have a wide width and a fitting openings which allow fitting of the bent portions thereinto are formed in the front face portion of the conductive fitting.

6. A wire connector according to claim 2, wherein a stopper pawl portion is formed on the conductive fitting and a groove portion which is capable of being engaged with the stopper pawl portion is formed in the shaft portion of the manipulation button in the sliding direction.

7. A wire connector according to claim 2, wherein a terminal platform is formed by integrally connecting a plurality of casings.

8. A wire connector according to claim 2, wherein into a connection fitting receiving portion which surrounds a terminal of the conductive fitting which projects from the casing, a connection fitting projection which projects from other casing and covers a terminal receiving portion of the conductive fitting is fitted thus establishing an electric connection.

9. A wire connector according to claim 2, wherein into a connection fitting receiving portion which surrounds a terminal mounted on a printed circuit board, a connection fitting projection which projects from the casing and covers a terminal receiving portion of the conductive fitting is fitted thus establishing an electric connection.

10. A wire connector in which by pushing one end portion of a manipulation button which is slidably inserted into a housing in an axial direction toward the housing, one end portion of a leaf spring which is housed in the housing is resiliently deformed and locked by the other end portion of the manipulation button, while by pulling out the manipulation button from the housing, one end portion of the leaf spring is resiliently restored and a wire which is inserted into the housing is clamped by one end portion of the leaf spring and the conductive fitting housed in the housing, wherein one end portion of a lever is rotatably supported in the vicinity of one end portion of the manipulation button, by pushing down the other end portion of the lever toward the housing, the manipulation button is pulled out by making use of a principle of lever.

11. A wire connector in which by pulling out one end portion of a manipulation button which is slidably inserted into a housing in an axial direction from the housing, one end portion of a leaf spring which is housed in the housing is resiliently deformed and locked by the other end portion of the manipulation button, while by pushing the manipulation button into the housing, one end portion of the leaf spring is resiliently restored and a wire which is inserted into the housing is clamped by one end portion of the leaf spring and the conductive fitting housed in the housing, wherein one end portion of a lever is rotatably supported in the vicinity of one end portion of the manipulation button, and by pushing down the other end portion of the lever toward the housing, the manipulation button is pulled out by making use of a principle of lever.

12. A wire connector according to claim 10, wherein an approximately cruciform manipulation recessed portion is formed in a end face of one end portion of the manipulation button.

13. A wire connector according to claim 10, wherein a manipulation recessed portion is formed in the other end portion of the lever.

14. A wire connector comprising a conductive fitting which has a front face portion capable of being housed in the inside of a housing, forms a bent lug horizontally on an upper-end left side peripheral portion thereof, and forms a position restricting tongue horizontally at a neighboring position which is lower than the bent lug by one stage, a leaf spring which is bent in an approximately V shape, is mounted on the conductive fitting, and brings a one-side end portion thereof into pressure contact with a lower face of the bent lug of the conductive fitting, and a manipulation button which is slidably inserted into the housing in an axial direction, wherein by pushing one end portion of the manipulation button in the axial direction, the other end portion of the manipulation button pushes down one side of the leaf spring, whereas an upper face of the shaft portion of the manipulation button is pressed and locked to the position restricting tongue of the conductive fitting due to a reaction of the leaf spring, while by pulling out the manipulation button in the axial direction, one end portion of the leaf spring is resiliently restored so that a wire which is inserted into the inside of the housing is clamped by one end portion of the leaf spring and the bent lug of the conductive fitting.

15. A wire connector comprising a conductive fitting which has a front face portion capable of being housed in the inside of a housing, forms a bent lug horizontally on an upper-end center peripheral portion thereof, and forms position restricting tongues horizontally respectively at both neighboring sides of the upper-end center peripheral portion which are lower than the bent lug by one stage, a pair of leaf springs which are bent in an approximately V shape, are mounted on the conductive fitting, and bring one-side end portions thereof into pressure contact with a lower face of the bent lug of the conductive fitting, and a pair of manipulation buttons which are slidably inserted into the housing in an axial direction, wherein by pushing one end portions of the manipulation buttons in the axial direction, the other end portions of the manipulation buttons push down one sides of the leaf springs, whereas upper faces of the shaft portions of the manipulation buttons are pressed and locked to the position restricting tongue of the conductive fitting due to a reaction of the leaf spring, while by pulling out the manipulation buttons in the axial direction, one end portions of the leaf springs are resiliently restored so that wires which are inserted into the inside of the housing are clamped by one end portions of the leaf springs and the bent lug of the conductive fitting.

16. A wire connector according to claim 14, wherein a stopper pawl portion is formed on the conductive fitting and a groove portion which is capable of being engaged with the stopper pawl portion is formed in the shaft portion of the manipulation button in the sliding direction.

17. A wire connector comprising a housing, a connector which is mounted on the housing and to which input/output lines which are connected to an external equipment are capable of being connected, a printed circuit board which is arranged substantially parallel to a connection face of the housing and is electrically connected to a terminal of the connector, and a large number of connection units which are arranged on the connection face of the housing, are electrically connected to the connector by way of the printed circuit board, and are respectively connected to input/output lines of a large number of electric equipments, wherein the connection unit comprises conductive fittings which are respectively arranged below a large number of wire insertion holes which are formed in parallel in the left and right direction at a given pitch on a connection face which is coplanar with the connection face of the housing thus forming a row and also forms rows in front of and behind the row, and are connected to the printed circuit board, holding spring portions which are respectively arranged below the wire insertion holes and are mounted on the conductive fittings, and manipulation buttons which are axially movably inserted into manipulation button insertion holes which are respectively arranged in parallel at positions adjacent to the wire insertion holes, wherein by manipulating the holding spring portions by moving the manipulation buttons having upper end portions thereof projected from the connection face of the housing in the axial direction, holding and releasing of the wires inserted through the wire insertion holes are performed.

18. A wire connector comprising a housing, a connector which is mounted on the housing and to which input/output lines which are connected to an external equipment are capable of being connected, a printed circuit board which is arranged substantially parallel to a connection face of the housing and is electrically connected to a terminal of the connector, and a large number of connection units which are arranged on the connection face of the housing, are electrically connected to the connector by way of the printed circuit board, and are respectively connected to input/output lines of a large number of electric equipments, wherein the connection unit comprises conductive fittings which are respectively arranged below a large number of wire insertion holes which are formed in parallel in the left and right direction at a given pitch on a connection face which is coplanar with the connection face of the housing thus forming a row and forms another separate rows in front of and behind the row by displacing the wire insertion holes in the lateral direction by a given size, and are connected to the printed circuit board, holding spring portions which are respectively arranged below the wire insertion holes and are mounted on the conductive fittings, and manipulation buttons which are axially movably inserted into manipulation button insertion holes which are respectively arranged in parallel at positions adjacent to the wire insertion holes, wherein by manipulating the holding spring portions by moving the manipulation buttons having upper end portions thereof projected from the connection face of the housing in the axial direction, holding and releasing of the wires inserted through the wire insertion holes are performed.

19. A wire connector according to claim 16, wherein a lever which is operated to pull out the shaft portion in the axial direction is rotatably mounted on an upper end portion of the manipulation button.

20. A wire connector according to claim 3, wherein a stopper pawl portion is formed on the conductive fitting and a groove portion which is capable of being engaged with the stopper pawl portion is formed in the shaft portion of the manipulation button in the sliding direction.

21. A wire connector according to claim 4, wherein a stopper pawl portion is formed on the conductive fitting and a groove portion which is capable of being engaged with the stopper pawl portion is formed in the shaft portion of the manipulation button in the sliding direction.

22. A wire connector according to claim 5, wherein a stopper pawl portion is formed on the conductive fitting and a groove portion which is capable of being engaged with the stopper pawl portion is formed in the shaft portion of the manipulation button in the sliding direction.

23. A wire connector according to claim 3, wherein a terminal platform is formed by integrally connecting a plurality of casings.

24. A wire connector according to claim 4, wherein a terminal platform is formed by integrally connecting a plurality of casings.

25. A wire connector according to claim 5, wherein a terminal platform is formed by integrally connecting a plurality of casings.

26. A wire connector according to claim 6, wherein a terminal platform is formed by integrally connecting a plurality of casings.

27. A wire connector according to claim 3, wherein into a connection fitting receiving portion which surrounds a terminal of the conductive fitting which projects from the casing, a connection fitting projection which projects from other casing and covers a terminal receiving portion of the conductive fitting is fitted thus establishing an electric connection.

28. A wire connector according to claim 4, wherein into a connection fitting receiving portion which surrounds a terminal of the conductive fitting which projects from the casing, a connection fitting projection which projects from other casing and covers a terminal receiving portion of the conductive fitting is fitted thus establishing an electric connection.

29. A wire connector according to claim 5, wherein into a connection fitting receiving portion which surrounds a terminal of the conductive fitting which projects from the casing, a connection fitting projection which projects from other casing and covers a terminal receiving portion of the conductive fitting is fitted thus establishing an electric connection.

30. A wire connector according to claim 6, wherein into a connection fitting receiving portion which surrounds a terminal of the conductive fitting which projects from the casing, a connection fitting projection which projects from other casing and covers a terminal receiving portion of the conductive fitting is fitted thus establishing an electric connection.

31. A wire connector according to claim 7, wherein into a connection fitting receiving portion which surrounds a terminal of the conductive fitting which projects from the casing, a connection fitting projection which projects from other casing and covers a terminal receiving portion of the conductive fitting is fitted thus establishing an electric connection.

32. A wire connector according to claim 3, wherein into a connection fitting receiving portion which surrounds a terminal mounted on a printed circuit board, a connection fitting projection which projects from the casing and covers a terminal receiving portion of the conductive fitting is fitted thus establishing an electric connection.

33. A wire connector according to claim 4, wherein into a connection fitting receiving portion which surrounds a terminal mounted on a printed circuit board, a connection fitting projection which projects from the casing and covers a terminal receiving portion of the conductive fitting is fitted thus establishing an electric connection.

34. A wire connector according to claim 5, wherein into a connection fitting receiving portion which surrounds a terminal mounted on a printed circuit board, a connection fitting projection which projects from the casing and covers a terminal receiving portion of the conductive fitting is fitted thus establishing an electric connection.

35. A wire connector according to claim 6, wherein into a connection fitting receiving portion which surrounds a terminal mounted on a printed circuit board, a connection fitting projection which projects from the casing and covers a terminal receiving portion of the conductive fitting is fitted thus establishing an electric connection.

36. A wire connector according to claim 7, wherein into a connection fitting receiving portion which surrounds a terminal mounted on a printed circuit board, a connection fitting projection which projects from the casing and covers a terminal receiving portion of the conductive fitting is fitted thus establishing an electric connection.

37. A wire connector according to claim 8, wherein into a connection fitting receiving portion which surrounds a terminal mounted on a printed circuit board, a connection fitting projection which projects from the casing and covers a terminal receiving portion of the conductive fitting is fitted thus establishing an electric connection.

38. A wire connector according to claim 11, wherein an approximately cruciform manipulation recessed portion is formed in a end face of one end portion of the manipulation button.

39. A wire connector according to claim 11, wherein a manipulation recessed portion is formed in the other end portion of the lever.

40. A wire connector according to claim 12, wherein a manipulation recessed portion is formed in the other end portion of the lever.

41. A wire connector according to claim 15, wherein a stopper pawl portion is formed on the conductive fitting and a groove portion which is capable of being engaged with the stopper pawl portion is formed in the shaft portion of the manipulation button in the sliding direction.

42. A wire connector according to claim 17, wherein a lever which is operated to pull out the shaft portion in the axial direction is rotatably mounted on an upper end portion of the manipulation button.

* * * * *